US005192971A

United States Patent [19]

Smimizu et al.

[11] Patent Number: 5,192,971

[45] Date of Patent: Mar. 9, 1993

[54] IMAGE FORMING APPARATUS WITH IMAGE FORMING INTERRUPTION CAPABILITIES

[75] Inventors: Katsuichi Smimizu, Hoya; Osamu Sawamura, Atsugi; Shunichi Masuda, Tokyo; Masahiro Tomosada, Kawasaki; Hisashi Sakamaki, Yokohama, all of Japan

[73] Assignee: Canon Kabushiki Kaisha, Tokyo, Japan

[21] Appl. No.: 477,113

[22] Filed: Feb. 7, 1990

Related U.S. Application Data

[63] Continuation of Ser. No. 280,497, Dec. 6, 1988, abandoned, which is a continuation of Ser. No. 28,025, Mar. 17, 1987, Pat. No. 4,816,868, which is a continuation of Ser. No. 604,924, Apr. 27, 1984, abandoned, which is a continuation of Ser. No. 329,019, Dec. 9, 1981, abandoned, which is a continuation of Ser. No. 882,626, Mar. 1, 1978, Pat. No. 4,314,754.

[30] Foreign Application Priority Data

Mar. 2, 1977 [JP] Japan ..... 52-22982

[51] Int. Cl.[5] ..... G03G 21/00; G03G 15/04

[52] U.S. Cl. ..... 355/206; 355/234; 355/311

[58] Field of Search ..... 355/204, 208, 209, 234, 355/311, 206, 203, 205, 3 R, 8, 14 R, 14 C

[56] References Cited

U.S. PATENT DOCUMENTS

| | | | |
|---|---|---|---|
| 3,588,472 | 6/1971 | Glaster et al. | 355/308 X |
| 3,669,535 | 6/1972 | Hyosaka et al. | 355/235 |
| 3,898,003 | 8/1975 | Aronson et al. | 355/271 X |
| 3,900,740 | 8/1975 | Akimoto et al. | 307/112 |
| 3,936,182 | 2/1976 | Sheikh | 355/204 |
| 3,944,360 | 3/1976 | Deetz et al. | 355/204 X |
| 3,944,794 | 3/1976 | Reehil et al. | 355/309 X |
| 3,950,090 | 4/1976 | Washio et al. | 355/234 |
| 3,989,368 | 11/1976 | Sohm | 355/309 |
| 4,008,957 | 2/1977 | Summers | 271/9 X |
| 4,044,232 | 8/1977 | Hubbard | 355/208 X |
| 4,057,341 | 11/1977 | Sohn | 355/234 |
| 4,062,061 | 12/1977 | Batchelor et al. | 235/92 SB X |
| 4,077,714 | 3/1978 | Komori et al. | 355/230 X |
| 4,099,860 | 7/1978 | Connin | 355/314 |
| 4,305,654 | 12/1981 | Shimizu et al. | 355/204 |
| 4,314,754 | 2/1982 | Shimizu et al. | 355/209 X |
| 4,470,692 | 9/1984 | Shimizu et al. | 355/209 |
| 4,521,099 | 6/1985 | Katayama et al. | 355/234 |
| 4,685,796 | 8/1987 | Shimizu et al. | 355/205 |
| 4,794,423 | 12/1988 | Shimizu et al. | 355/208 |
| 4,937,621 | 6/1990 | Shimizu et al. | 355/206 |

FOREIGN PATENT DOCUMENTS

| | | |
|---|---|---|
| 2654076 | 6/1977 | Fed. Rep. of Germany . |
| 2658819 | 7/1977 | Fed. Rep. of Germany . |

OTHER PUBLICATIONS

Hubbard, et al., "Diagnosing Document Reproduction Machines," IBM Technical Disclosure Bulletin, vol. 19, No. 3, Aug. 1976, pp. 818–820.

Hubbard, et al., "Restarting Interrupted Copy Production," IBM Technical Disclosure Bulletin, vol. 19, No. 4, Sep. 1976, pp. 1154–1156.

*Primary Examiner*—Fred L. Braun

*Attorney, Agent, or Firm*—Fitzpatrick, Cella, Harper & Scinto

[57] ABSTRACT

An image processing apparatus having various interrupt-handling capabilities when image formation is interrupted. In one aspect, image formation is interrupted after completion of a predetermined number of image formations when the size of a recording material is indicated as a first size, and image formation is interrupted after a completion of a predetermined number of image formations when a recording material is indicated as a second size. In another aspect, a condition for image formation is selected whereby in the case the selected condition is prevented (e.g., recording on wrong-sized paper), the condition is stored, and after the image formation has commenced, a stop command is inhibited and stored. In another aspect, data concerning image information is entered, the entered data is displayed, and images are formed sequentially in accordance with the data whereby the formation of the images may be interrupted and the remaining number of image formations may be stored and displayed. It is also possible to interrupt the image formation for a predetermined image formation count without entry by the operator.

22 Claims, 43 Drawing Sheets

| FIG. 3-1A | FIG. 3-1B |
|---|---|

| | |
|---|---|
| FIG. 3-2A | FIG. 3-3A |
| FIG. 3-2B | FIG. 3-3B |

FIG. 3—2B
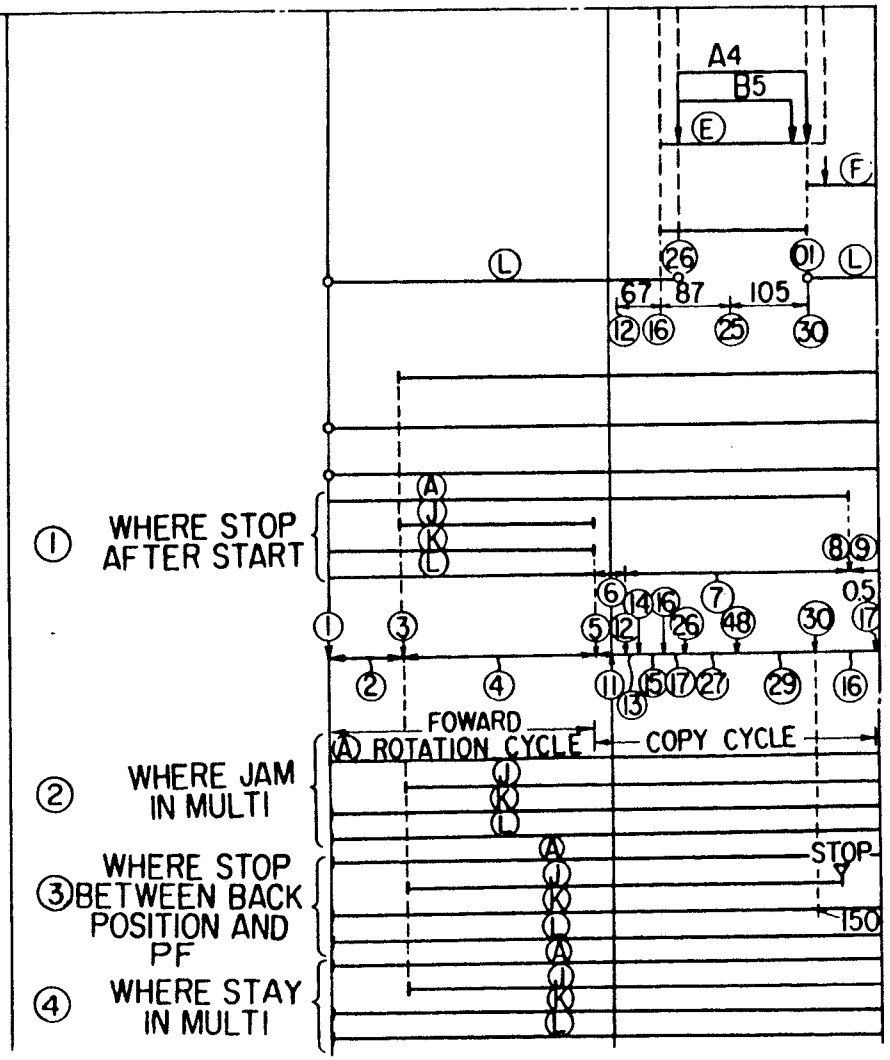

| FIG. 4-1A | FIG. 4-1B |
|---|---|

| | |
|---|---|
| FIG. 4-2 A | FIG. 4-3 A |
| FIG. 4-2 B | FIG. 4-3 B |

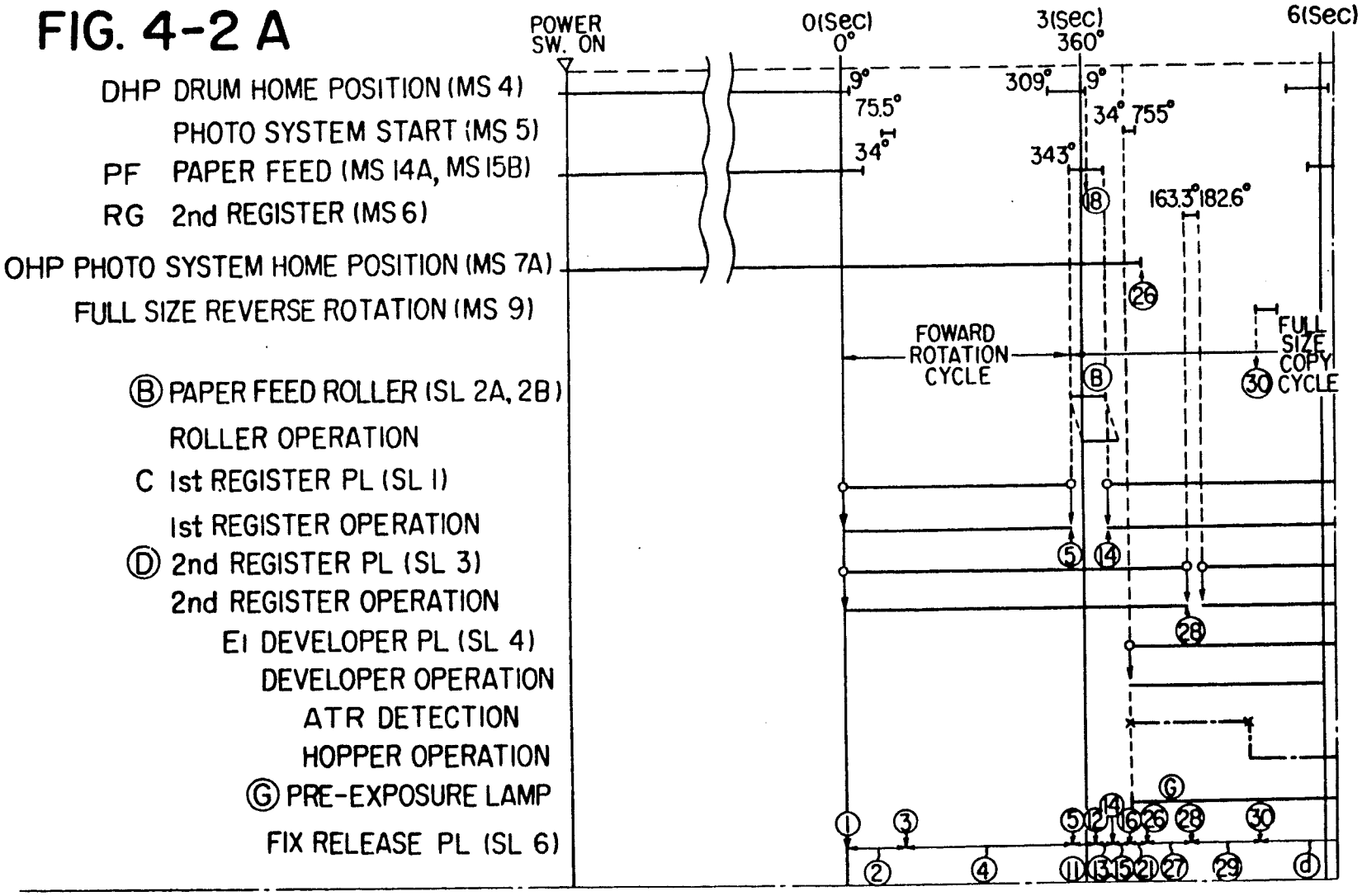
FIG. 4-2 A
POWER SW. ON
DHP DRUM HOME POSITION (MS 4)
PHOTO SYSTEM START (MS 5)
PF PAPER FEED (MS 14A, MS 15B)
RG 2nd REGISTER (MS 6)
OHP PHOTO SYSTEM HOME POSITION (MS 7A)
FULL SIZE REVERSE ROTATION (MS 9)
Ⓑ PAPER FEED ROLLER (SL 2A, 2B)
ROLLER OPERATION
C 1st REGISTER PL (SL 1)
1st REGISTER OPERATION
Ⓓ 2nd REGISTER PL (SL 3)
2nd REGISTER OPERATION
E1 DEVELOPER PL (SL 4)
DEVELOPER OPERATION
ATR DETECTION
HOPPER OPERATION
Ⓖ PRE-EXPOSURE LAMP
FIX RELEASE PL (SL 6)
0(Sec)
0°
3(Sec)
360°
6(Sec)
9°
75.5°
34°
309°
343°
34.755°
163.3°
182.6°
FOWARD ROTATION CYCLE
FULL SIZE COPY CYCLE EXPOSURE A3
EXPOSURE B4
Ⓔ PHOTO SYSTEM ADVANCE MOTOR
Ⓕ PHOTO SYSTEM RETIRE MOTOR
E2 EXPOSURE LAMP
Ⓛ BLANK EXPOSURE LAMP
Ⓘ JAM SOLENOID
Ⓙ A.C TRANSFORMER SWITCHING SIGNAL
Ⓚ PRIMARY TRANSFORMER
H WHOLE EXPOSURE LAMP

| FIG. 5-1A |
|---|
| FIG. 5-1B |
| FIG. 5-1C |

FLAG I SET
30
A, L, K ON
SuBP
CP=60
NO
YES
J ON
SuBP
PF=1
NO
YES
STOP=1
YES
44
NO
26
B ON
2
26
17
19
20
21
22
23
24
25
FLAG2=1
NO (HALF-SIZE)
YES (FULL-SIZE)
CT2=CT2-2
16
CT2=CT2-1
1
43
44
SuBP
CP=67
NO
YES
OHP=1
NO
YES
F OFF
TC, I OFF
E ON
a
50
46
47
48
49
CT1: SET COUNT
CT2: COPY COUNT
45

| | | |
|---|---|---|
| FIG. 5-2 A | FIG. 5-2 B | FIG. 5-2 C |

a
FLAG 5=1
NO
YES
FLAG 6 SET
FLAG 2-1
NO
YES
G ON
87—CP
SuBP
OHP=1
NO
YES
CP=CP-1
L OFF
63
64
65
66
67
68
69
70
71
b
FULL ?
YES
NO
(HALF)
93
FLAG 2 SET
26
E.G OFF
F.L ON
FLAG2 RESET
150—CP
FLAG 1=1
YES
NO
FLAG 4=1
YES
NO
FLAG 8=1
YES
NO
CT2=CT2+1
102
FLAG 3 SET
92
94
95
96
97
98
99
J OFF
SuBP
CP=150
NO
OHP=1
NO
YES
F OFF
SUBI
FLAG 11=1
YES
NO
FLAG 4=1
NO
YES
FLAG 6=1
NO
YES
112
113
114
115
116
117
118
120

FLAG2=1
FLAG6=1
FLAG8=1
FLAG19=1
CPOS=1
FLAG 4 SET
FLAG1=1
CT2=CT2-1
I ON
CT1=CT2
STOP=1
SuBP
CP=150
STOP=1
J.OFF
PF=1
FLAG5 SET
26
FLAG19=1
CPOS=1
TC ON
FLAG 8 SET
CT2=CT2-2
I ON
J.K OFF
FLAG 1 SET
SUBH
FLAG3=1
FLAG1=1
YES
NO
72
73
74
76
75
77
78
79
80
100
101
103
104
105
106
107
108
119
121
122
123
124
125
126
127
128

| | | |
|---|---|---|
| FIG. 5-3A | FIG. 5-3B | FIG. 5-3C |

165 0.5 sec TIMER
166 TC OFF
167 FLAG 3=1
168 CT2 CREAR
169 FLAG 7=1
170 (SINGLE)
FLAG 9=1
(MULTI)
171 FLAG I RESET
172 FLAG I SET
173 CT I=0
175 FLAG CLEAR (EXCEPT FLAG I)
22
177 FLAG I=1
178 CT2=CT2-1
179 0.5 sec TIMER
180 I OFF
181 FLAG CLEAR (EXCEPT FLAG I)
182 SuBP
183 FLAG16=1
184 JAM SW OFF
143 FLAG8=1
144 FLAG19=1
145 CPOS=1
146 FLAG 4 SET
147 FLAG I=1
148 CT2=CT2-1
149 I ON
YES
NO

| | | |
|---|---|---|
| FIG. 5-4A | FIG. 5-4B | FIG. 5-4C |

PF=1
NO
YES
227
STOP=1
NO
YES
228
FLAG 5,6 SET
230
26
J,K OFF
229
f
1
SuBP
DHP=1
NO
YES
217
218
5msec TIMER
219
SuBP
DHP=1
YES
NO
220
221
I OFF
222
43
CT1=CT2
YES
NO
197
FLAG 3 SET
STOP=1
YES
NO
199
198
J OFF
23
SuBP
231
200
CP=38
NO
YES
201
FLAG8=1
NO
202
FLAG19=1
NO
203

| | |
|---|---|
| FIG. 5-7A | FIG. 5-7B |
| FIG. 5-7C | FIG. 5-7D |

FLAG 23=1
YES
NO
FLAG 23 RESET
i
h
CLEAR KEY ?
JAM CHECK OMIT SW ?
STOP=1
SINGLE KEY ?
(SIMGLE)
(MULTI KEY)
SET COUNT 0 ?
(RAM 10,11 ADDRESS)
FLAG 1 RESET
FLAG 1 SET
END
DEPRESSED KEY ?
FLAG 22=1
FLAG 22 RESET
FLAG 21 RESET
FLAG 23=1
FLAG 23 SET
FLAG 19 SET
SET COUNT (RAM 10,11 ADDRESS) CLEAR
5m Sec TIMER
J

FIG. 6-1
FIG. 6-1A
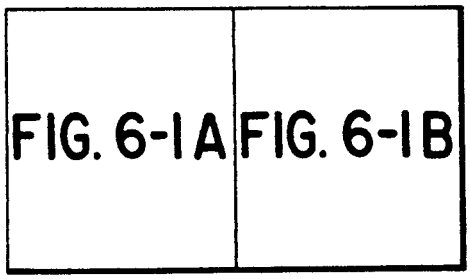
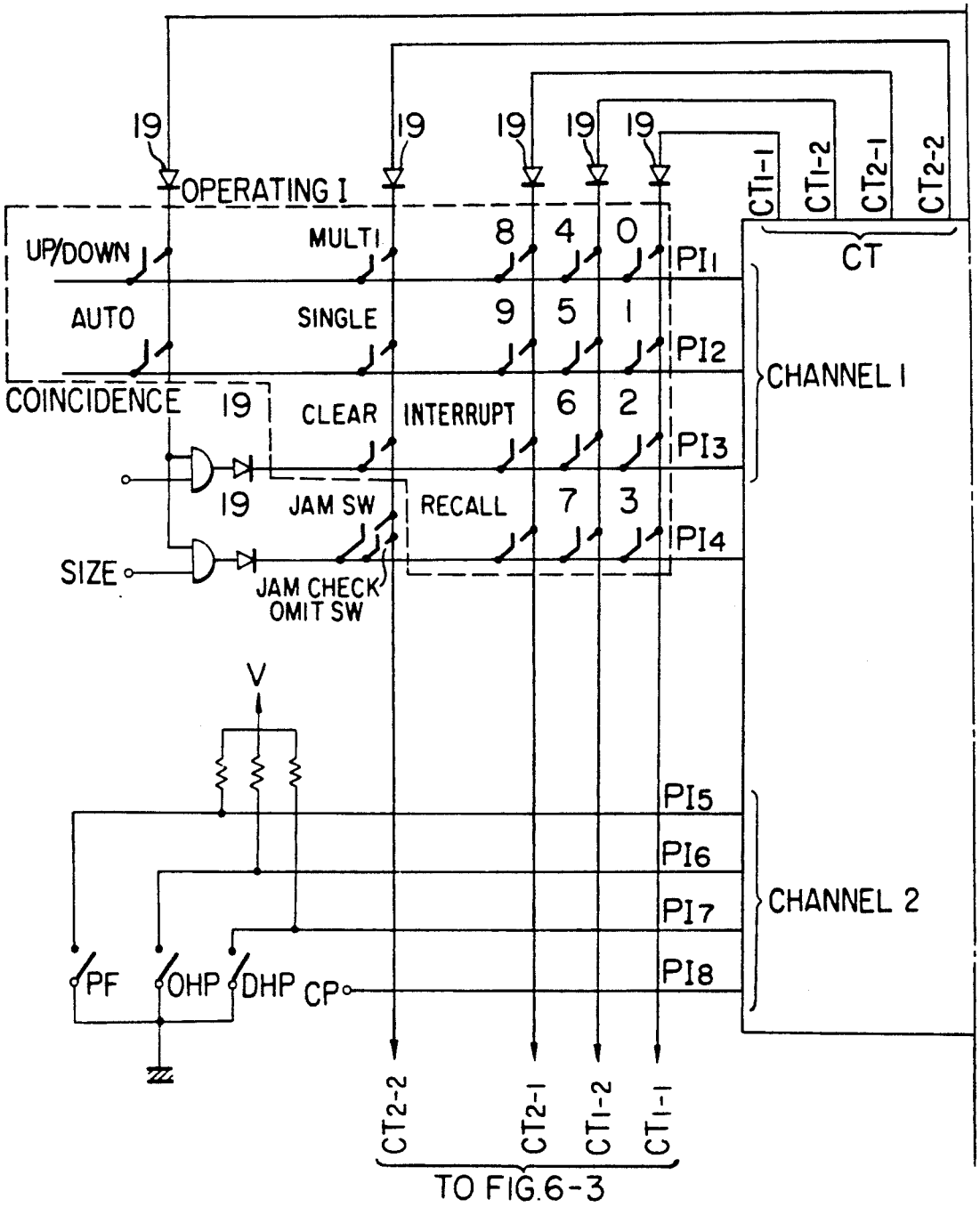

FIG. 6-4
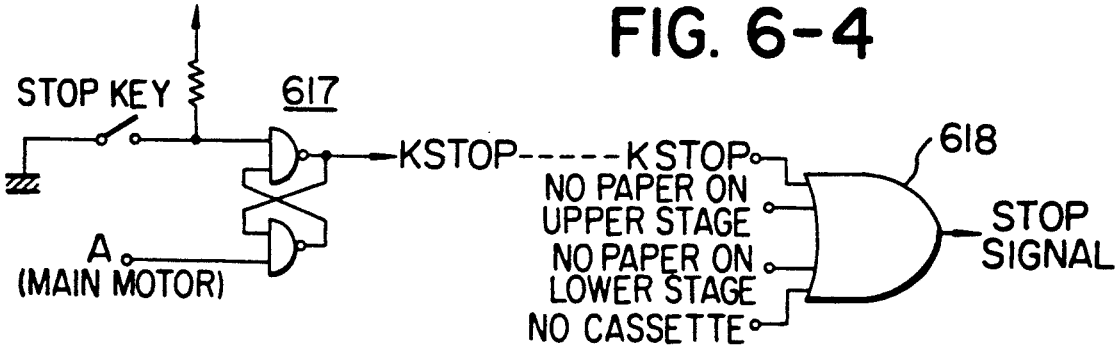
FIG. 6-5
| | A3 | A4 | U1 | U2 | B4 | B5 | NO CASSETTE |
|---|---|---|---|---|---|---|---|
| MS13 | off | on | off | on | off | on | |
| MS19 | off | off | on | on | off | off | |
| MS21 | off | off | off | off | on | on | |
| MS15 | off | off | off | off | off | off | on |
FIG. 6-6
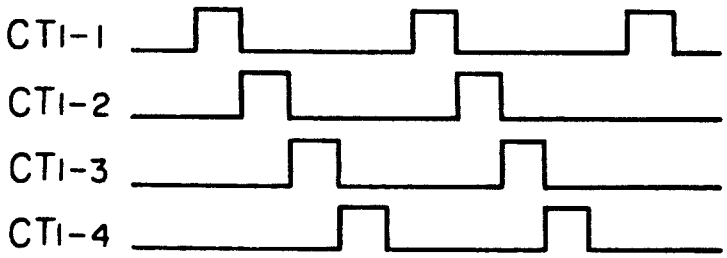

IMAGE FORMING APPARATUS WITH IMAGE FORMING INTERRUPTION CAPABILITIES

This application is a continuation of application Ser. No. 07/280,497 filed Dec. 6, 1988, now abandoned, which was a continuation of application Ser. No. 07/028,025 filed Mar. 17, 1987, now U.S. Pat. No. 4,816,868, which was a continuation of application Ser. No. 06/604,924 filed Apr. 27, 1984, now abandoned, which was a continuation of application Ser. No. 06/329,019 filed Dec. 9, 1981, now abandoned, which was a continuation of application Ser. No. 05/882,626 filed Mar. 1, 1978, now U.S. Pat. No. 4,314,754.

BACKGROUND OF THE INVENTION

1. Field of the Invention

The present invention relates to an image forming apparatus such as a copying machine including a control system which is very simple in construction yet capable of controlling various processes with a higher degree of accuracy in a very reliable manner.

2. Description of the Prior Art

In the prior copying machines, only the combinations of relay circuits or the so-called hard wire logic circuits have been used for controlling the sequences and timings of processing means which is used in this specification to refer to all of the means required for reproducing a copy from an original such as charging, exposure, developing, and transferring means. Since the relay circuits and the logic circuits are combined in order to attain a specific purpose, the recombination of these circuits for other purposes requires much labor and time. Furthermore the circuit constructions and wiring arrangements for controlling a large number of processing means are very complex so that poor reliability results and inspection and maintenance are difficult.

It has been proposed to control the sequence of operations of the processing means by a use of a program, but the conventional copying machine control systems incorporating the sequence control programs are still very complex in circuit construction.

SUMMARY OF THE INVENTION

Therefore one of the objects of the present invention is to provide an improved image forming apparatus including a control system which may substantially overcome the above and other problems encountered in the prior art copying machine control systems and which may control a plurality of sequences of operations of processing means.

Another object of the present invention is to provide an improved image forming apparatus capable of attaining the control of sequence of operations of processing means which is also referred to as "active loads" in this specification in accordance with a program stored in the image forming apparatus.

A further object of the present invention is to provide an improved image forming apparatus wherein input and output ports of a central processing unit in a control system are so combined through logic circuits that various operations of processing means may be sequentially controlled.

A further object of the present invention is to provide an improved image forming apparatus including various types of display means for facilitating the operations of the apparatus.

A further object of the present invention is to provide an improved image forming apparatus including such a stored program that an operator may enter various instructions during the copying process or during predetermined modes.

A further object of the present invention is to provide an improved image forming apparatus capable of reproducing copies in various sizes in a very simple manner.

A yet further object of the present invention is to provide an improved image forming apparatus capable of the interruption mode wherein the copying operation for obtaining a desired number of copies may be interrupted at any time so that a desired number of copies may be reproduced from another original.

Still another object of the present invention is to provide an improved image forming apparatus wherein a plurality of cassettes containing copying sheets in different and same sizes may be detachably mounted on the apparatus; one of these cassettes containing copying sheets in a desired size may be selected so that the copying sheets may be fed to the image transfer station or device; and when one cassette has been emptied, another cassette containing the copying sheets in the same size as those in the emptied cassette may be automatically selected so that the copies in the same size may be continuously reproduced.

A still further object of the present invention is to provide an improved image forming apparatus wherein when the jamming of a web occurs within the apparatus the contents of a total counter for counting the total number of copies reproduced and the display on a copy number display unit or counter for displaying a number of copies reproduced from a specific original may be decremented by a number depending upon the location at which the jamming is occurred and the size of the jammed copy.

A still further object of the present invention is to provide an improved image forming apparatus including a stored program of the type described above wherein some of the routines included in this program may be selectively omitted or skipped so that a test run may be much simplified.

BRIEF DESCRIPTION OF THE DRAWINGS

FIGS. 3-1, 3-2 and 3-3, each of which comprises segments A and B, show the timing diagram in case of reproducing copies in half size;

FIGS. 4-1, 4-2 and 4-3, each of which comprises segments A and B, show the timing diagram in case of reproducing copies in full size;

FIGS. 5-1 through 5-4, each comprising segment A, B and C, FIGS. 5-5 and 5-6, each comprising segments A and B, and FIG. 5-7, comprising segments A, B, C and D, are flow charts used in the reproduction of copies in half or full size according to the timing diagram shown in FIGS. 3-1 through 3-3 or shown in FIGS. 4-1 through 4-3;

FIGS. 6-1, including segments A and B, and FIGS. 6-2: through 6-8 are views used for the explanation of a control system;

FIG. 8 is a timing diagram for controlling various means when a power switch is turned on;

FIG. 9-1 is a sectional view of safety means;

FIG. 9-2 is a sectional view of a jam release device; and

FIG. 9-3 is a diagram of a jam reset circuit.

DESCRIPTION OF THE PREFERRED EMBODIMENT

The present invention will be described in conjunction with a one-chip microcomputer or a central processing unit for controlling various operations of a copying machine.

Figure 1:
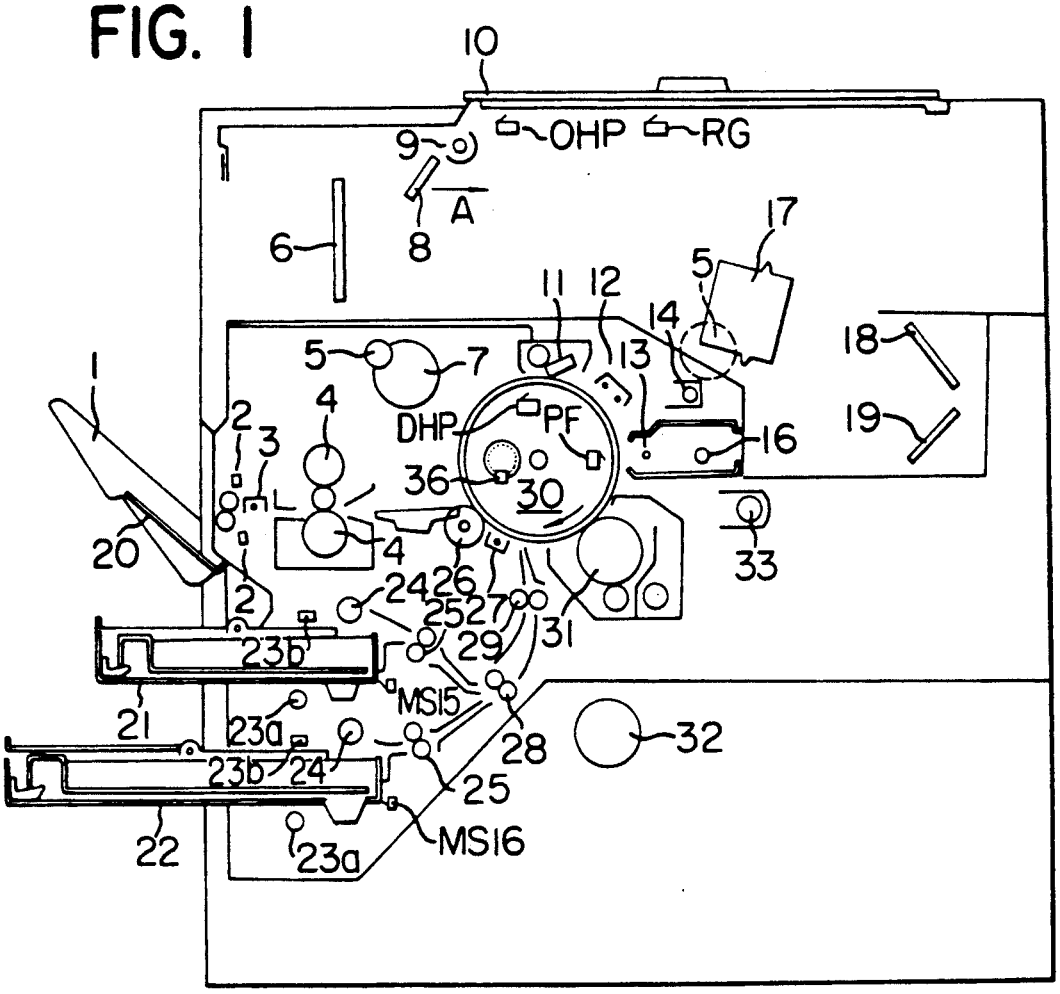
FIG. 1 is a sectional view in elevation of a copying machine incorporating the present invention.

Referring to FIG. 1, the mode of operation of a copying machine incorporating the present invention will be described. A subject or an original is placed on an original holder and is securely held in position with an original pressure plate 10. An optical system consists of an illumination unit 101 including an illumination lamp 9 and a movable reflecting mirror 8, a moveable reflecting mirror 6, a lens 17 and a pair of fixed reflecting mirrors 18 and 19. The moveable reflecting mirror 8 and the illumination lamp 9 are moved in unison in the direction indicated by the arrow A while the moveable reflecting mirror 6 is moved in the same direction at a velocity one half of the velocity of the moveable reflecting mirror 8 so that a predetermined optical length may be maintained. The original exposed through a slit is focused through the lens system 17 and the pair of fixed reflecting mirrors 18 and 19 on a drum 30 having photosensitive member. That is, the original is scanned by the illumination unit and is focused through the slit.

The drum 30 has the photosensitive member consisting of a photoconductive layer coated with a transparent insulating layer. The photosensitive member is positively charged by a positive charger 12 to which is applied a positive high-voltage current from a high voltage source (not shown). The image of the original is focused on the photosensitive member on the drum 30 at an exposure unit through the optical system described above and is discharged by an AC discharger 13 to which is applied a high AC voltage current from a high voltage source (not shown).

Thereafter the drum 30 is subjected to whole surface exposure by a lamp 33 so that an electrostatic latent image is formed on the photosensitive member on the drum 30.

At a developing station 31, the latent image is developed into a visible image by the sleeve type toner development process.

A copying sheet is picked up by a roller 24 and is transported by first and second pairs of feed rollers 25 and 28 to a pair of timing rollers 29 at which the copying sheet is stopped. In response to a registration signal, the timing rollers 29 are rotated so that the copying sheet is transported again in such a manner that the leading edge of the copying sheet may coincide with the leading edge of the developed image. The registration signal is produced by a switch RG which is actuated when the optical system has passed a predetermined point. A switch OHP generates a signal when the optical system has returned to its initial or home position.

The copying sheet is brought into close contact with the drum 30 and is charged by a transfer charging unit 27 which is connected to a high voltage positive current source, whereby the image on the drum is transferred onto the copying sheet.

Thereafter the copying sheet is separated from the drum 30 by a separating roller 26 and is transported into a thermal fixing station consisting of fixing rollers 4 so that the copying sheet may be fixed. The fixed copying sheet is discharged by a discharger 3 in order to remove the remaining charge, and is discharged into a tray 20 by a pair of discharge rollers.

The remaining toner on the drum 30 is removed by a blade 11 pressed against the drum 30, and a next copying cycle is restarted.

The driving system and the sequence of processes will be described later. The copying sheet feed signal is generated when a switch PF is actuated by a cam attached to the drum 30. The switch DHP generates the drum home position signal so that the drum 30 may be stopped at such a position where the joint between the edges of the sensitive member may be brought into contact with the cleaner 11. When the cassette 21 or 22 is empty, a light beam emitted from a lamp 23*a* is received by a photosensor 23*b*. A lamp 2 and a photosensor 2 are provided in order to detect the delay of the discharge of the copying sheet and the jamming thereof. A blanking lamp 16 illuminates the surface of the drum 30 when no image is focused thereon so that the uniform surface potential distribution on the drum may be ensured. A motor 7 drives the fixing rollers 4, and a motor 15 drives the optical system in the manner described elsewhere. A lamp 14 illuminates the photosensitive member before it is exposed so that it may be uniformly fatigued. In order to synchronize the copying processes, a pulse generator 36 is provided which consists of a disk which rotates in unison with the drum 30 and a photosensor for detecting a light beam passing through one of a plurality of circumferentially arranged holes of the disk.

Figure 2:
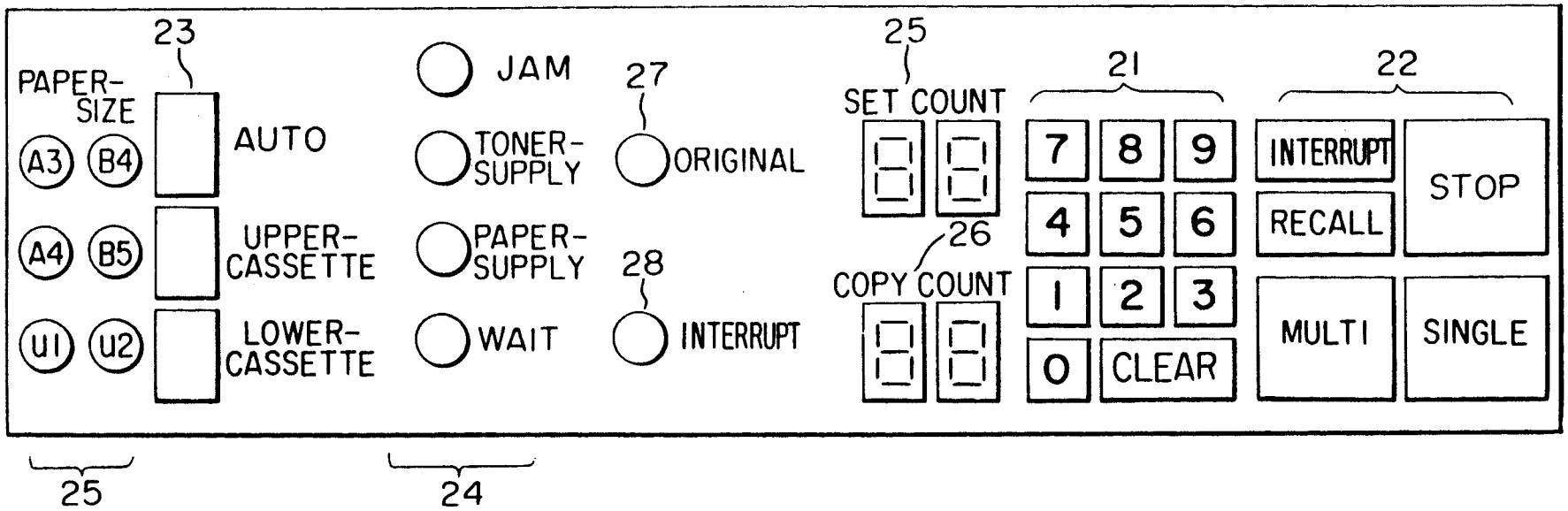
FIG. 2 is a top view of a control board thereof.

Operating Board and Display Unit, FIG. 2

An operator may talk with the central processing unit through the operating board shown in FIG. 2. In response to the inputs entered by key groups 21, 22 and 23, the central processing unit answers with display units 24-28. By depressing the numeral keys 0-9, the operator may set a desired number of copies up to 99 which is displayed on the display unit 25. On depression of the clear key, the display unit 25 is reset to "0". When the copies are required in the number displayed on the display unit 25, the operator depresses the key "MULTI". Once this key is depressed, the copying machine is started and will not respond to the depressions of the key 21 and the start key. When the optical system starts its back stroke, the display on the display unit 26 changes from "0" to "+1". When the number displayed on the display unit 26 coincides with the number displayed on the counter 25, the copying machine is shifted to the "stop" mode and may respond to the key depressions. When the drum 35 is completely stopped, the display on the copy counter 26 is returned to "0", but the number displayed on the counter 25 remains unchanged. Therefore when it is desired to make the same number of copies from a different original, the operator depresses the key "MULTI". However it should be noted that when the set counter 25 is displaying "0" or when any of the display group 24 is turned on, the copying operation will not be started even when the key "MULTI" is depressed.

When the operator stops the "STOP" key in the "MULTI copy" mode before the number displayed on the copy counter 26 reaches the number displayed on the set counter 25 or when any of display units in the group 24 is turned on, the copying cycle is stopped after the copying cycle which is preceding has been finished. For instance, assume that the operator depresses the stop button when the set counter 25 displays "6" and the copy counter 26 displays "3". Then the displays remain unchanged. That is, the counter 25 displays "6" while the copy counter 26 displays "3". In this case, the copying machine may respond to any input entered by the depression of one of the keys in the groups 21 and 22. Therefore when the operator depresses the key "MULTI" again, the copying operation is resumed to reproduce the remaining three copies. After the completion of a predetermined number of copying cycles, the copying machine may respond to the input entered by the depression of one of the keys in the groups 21 and 22.

Regardless of the numbers displayed on the set and copy counters 25 and 26, one copy may be reproduced by the depression of the "SINGLE" key. That is, the operator may interrupt the copying cycles for reproducing a desired number of copies from one original so that a single copy may be reproduced from another original. More particularly, assume that when the set counter 25 displays 6 and the copy counter displays 3, the operator is asked to make a copy from another original. Then the operator depresses the "STOP" key, sets the new original and depresses the "SINGLE" key. Then one copy is reproduced while the set and copy counters 25 and 26 keep displaying "6" and "3", respectively. Thereafter the operator sets the original again and depresses the "MULTI" key again. Then three additional copies are reproduced.

When more than one copy is desired during the interruption, the operator depresses the "INTERRUPT" and the "RECALL" keys. Assume that two copies are desired by the interruption when the set and copy counters 25 and 26 are displaying "6" and "3", respectively. Then the operator depresses the "INTERRUPT" key so that the numbers "6" and "3" are transferred into memories and the interrupt lamp 28 is turned on. Then the operator depresses "2" key so that "2" is displayed on the set counter 25, and he or she depresses "MULTI" key so that two copies are obtained. Thereafter the operator depresses "RECALL" key so that the counters 25 and 26 display "6" and "3" again, and depresses again the "MULTI" key so that three copies are reproduced.

The display lamp 27 "ORIGINAL" which remains turned off during the copying operation is turned on when the optical scanning of the original for the last copy has been completed. Therefore the operator may immediately remove the original and set a new original. The copying operation is resumed when the operator depresses the "MULTI" or "SINGLE" key.

"INTERRUPT" lamp 28 is turned on when the "INTERRUPT" key is depressed but is turned off when the "RECALL" key is depressed.

When jamming of copies occurs, the "JAM" lamp is immediately turned on and the copying machine is shifted to the "STOP" mode. The number displayed on the copy counter 26 is then decremented by 1 or 2 depending upon the number of copies jammed. When jamming occurs, the operator must open a door of the copying machine so as to remove the jammed copy or copies. Therefore, a total counter which counts the copying charge counts the copy after it has been discharged into the tray 20. In other words, the total counter will not count the copy or copies jammed. Neither the total counter now the copy counter 26 will count the jammed copy or copies.

"TONER SUPPLY" lamp is turned on when the toner supply is required. Even when this lamp is turned on, the copying operation will not be interupted.

"PAPER SUPPLY" lamp is turned on when the copying sheet cassette is emptied. When this lamp is turned on, the copying operation cannot be started or the copying operation is stopped.

"WAIT" lamp is kept turned on until the fixing unit 4 reaches a predetermined fixing temperature. Therefore until the "WAIT" lamp has been turned on no copying operation can be started.

By depression of the "UPPER-CASSETTE" or "LOWER-CASSETTE" key, either the upper or lower cassette 21 or 22 is selected. One of these keys or buttons is depressed, the other is released. The sizes of copying sheets stored in the upper and lower cassettes 21 and 22 are displayed by the corresponding lamps in the lamp group 25. When the "AUTO" button is depressed, the feed of copying sheets from one cassette may be automatically shifted to the feed from the other cassette when one cassette is emptied and only when the other cassette contains the copying sheets same in size with those contained in one cassette, whereby the copying operation may be continued even after one cassette is emptied.

Figures 6, 7:
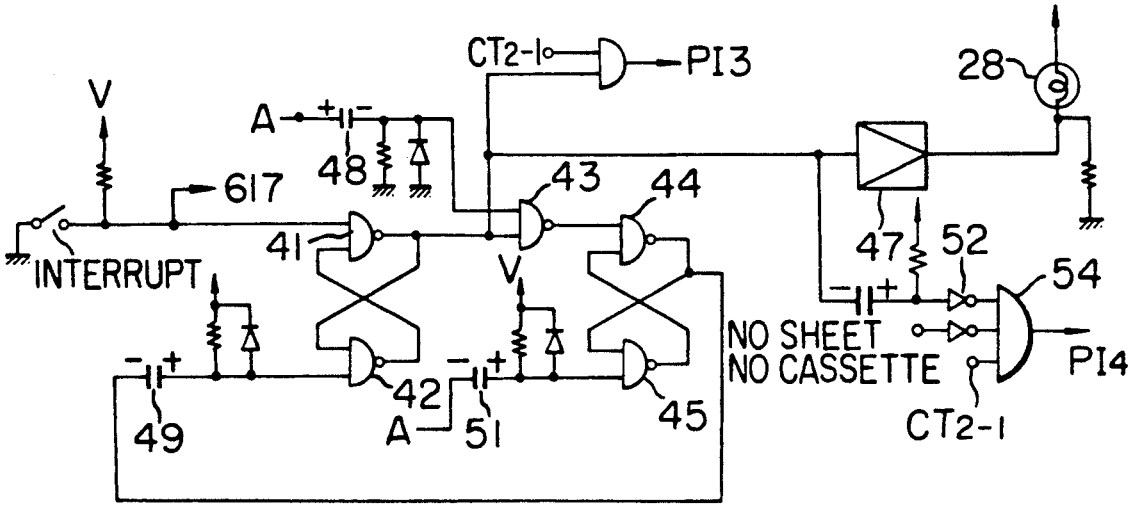

Control Circuit, FIGS. 6-1 and 6-2

In FIGS. 6-1 and 6-2 there is shown a circuit diagram of a central processing unit and its peripheral devices. The central processing unit CPU consists of a single semiconductor chip containing memories storing timings required for execution of a program shown in FIG. 5, memories for storing this program, memories for storing the numbers displayed on the set and copy counters 25 and 26 when the "INTERRUPT" button is depressed in the manner described above, and registers and logic circuits for decoding instructions in the program. Outputs a, b, c and d are connected through a segment decoder 608 to the set and copy counters 25 and 26. Ports CT are connected to input means and display means for scanning an input matrix circuit and for scanning the digits of the set and copy counters 25 and 26. Other ports are connected to an output interface circuit so that various output signals may be derived through gate circuits from various combinations of outputs from the central processing unit CPU. 603 and 604 are AND gates; 601, 602 and 606 are inverters; 605 is a NAND gate; 607 is an OR gate; and 609 is a copying sheet detecting circuits consisting of transistors.

The set and copy counters 25 and 26 are of the seven-bar or segment type. The digit position to be displayed is determined in response to the digit driving signal from one of the CT ports (digit driving signals being shown in FIG. 6—6) and the digit to be displayed is determined by a combination of segment driving signals from the pins a-d. The digits are therefore dynamically and sequentially displayed in the counters 25 and 26.

The inputs entered by the input keys or buttons which are connected to output lines $CT_{1-1}$, $CT_{1-2}$, $CT_{2-1}$ and $CT_{2-2}$ are also dynamically transmitted. As will be described in detail hereinafter, according to the present invention the counters 25 and 26 may display during the copying operation and before the copying operation is completed. In response to the clocks for processing the program, the scanning signals are sequentially generated. The outputs for operating the loads last enough time for turning off the loads.

Included as an interface circuit is a driver circuit (not shown) for increasing in power of the signal from the gate circuit so as to operate the solenoids and lamps. AC loads and the output from an oscillator are applied to the AND gate, and the output from the AND gate is used as a trigger signal for a triac.

The matrix circuit is so constructed that the scanning lines and the input lines of the microprocessor may intersect each other. The intersections which become switches correspond to input commands. With a number of x scanning lines and a number of y input lines, the maximum number of x X y switches are available.

The central processing unit includes a read-only memory (ROM) which stores a master program for executing the sequence of copying processes. Instructions are stored and given addresses so that when a specified memory word is addressed, the contents are read out. That is, various programs such as the key entry program, the machine operation program, the machine stopping program and so on which include binary coded instructions are stored in the memory words starting from the address "0". A random access memory (RAM) is of the conventional type for temporarily storing one binary coded control signal or data or a number of copies desired. It consists of a plurality of flip-flop groups each consisting of a plurality of flip-flops. A desired flip-flop group may be addressed, and data is stored into the flip-flops or read out therefrom.

Figures 1, 1B, 3:
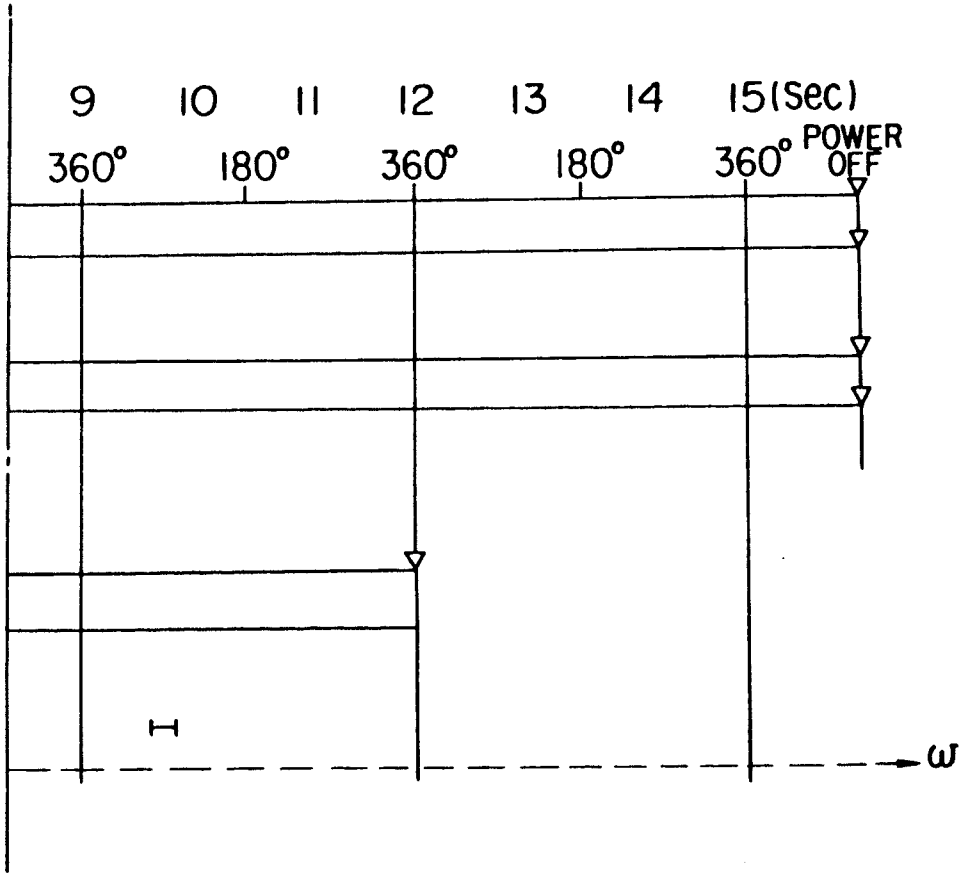
Figures 1A, 3:
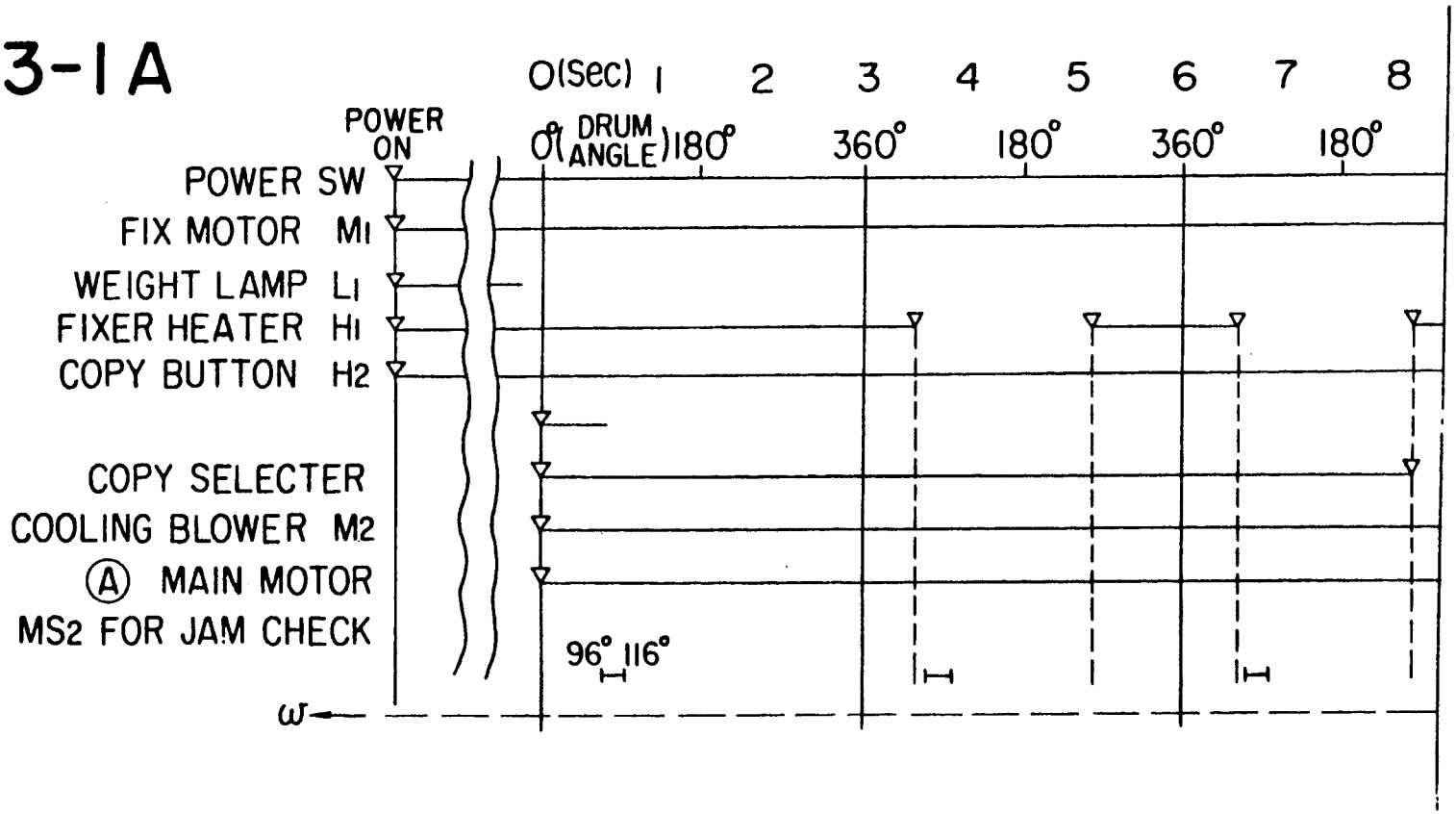
Figures 2, 3, 3B:
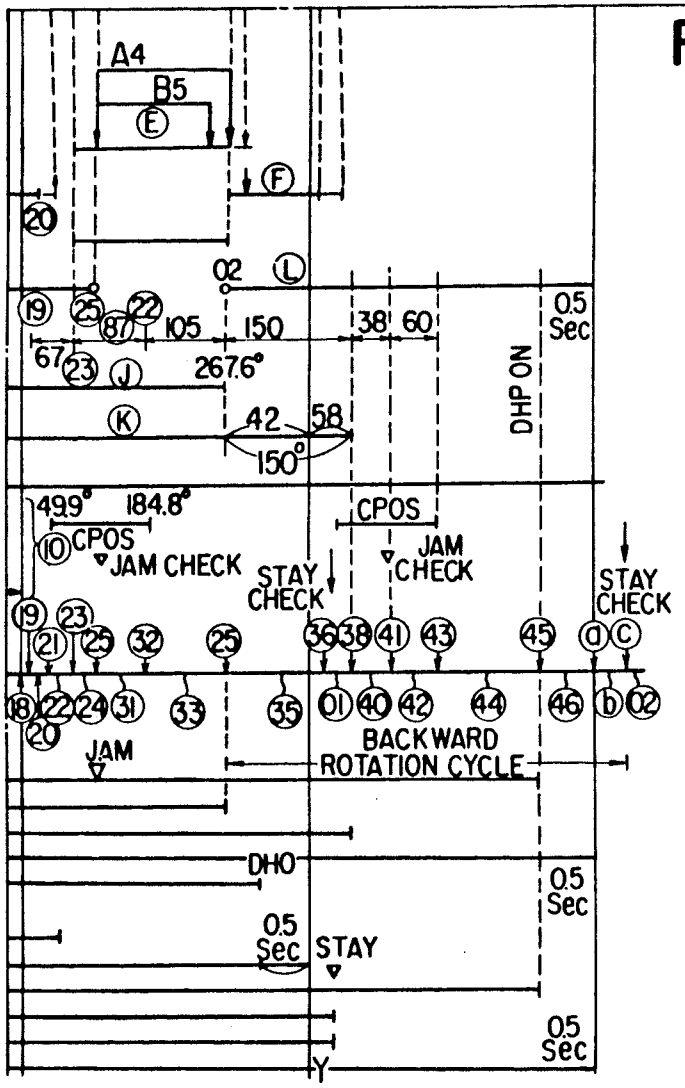
Figures 2, 3:
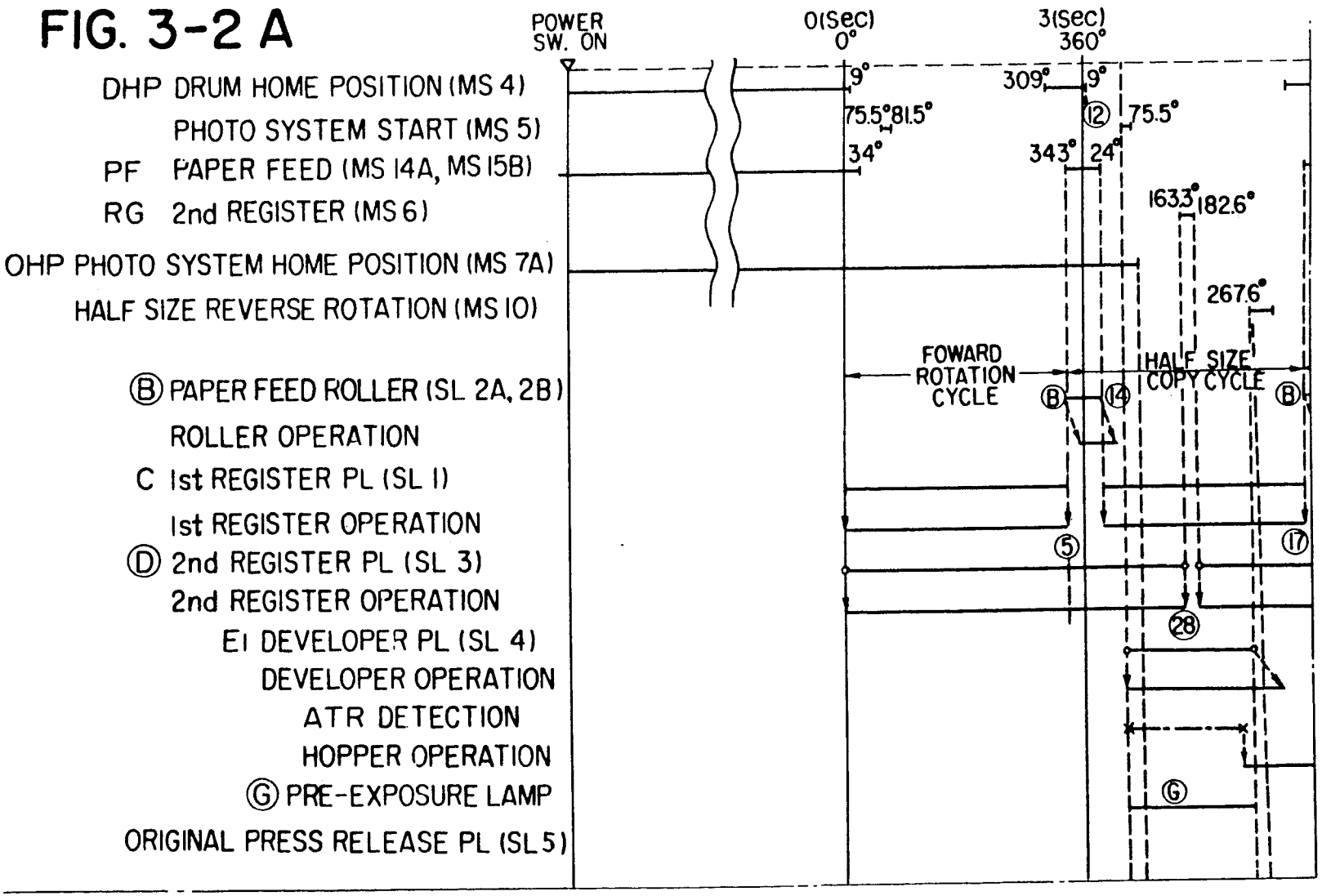
Figure 3:
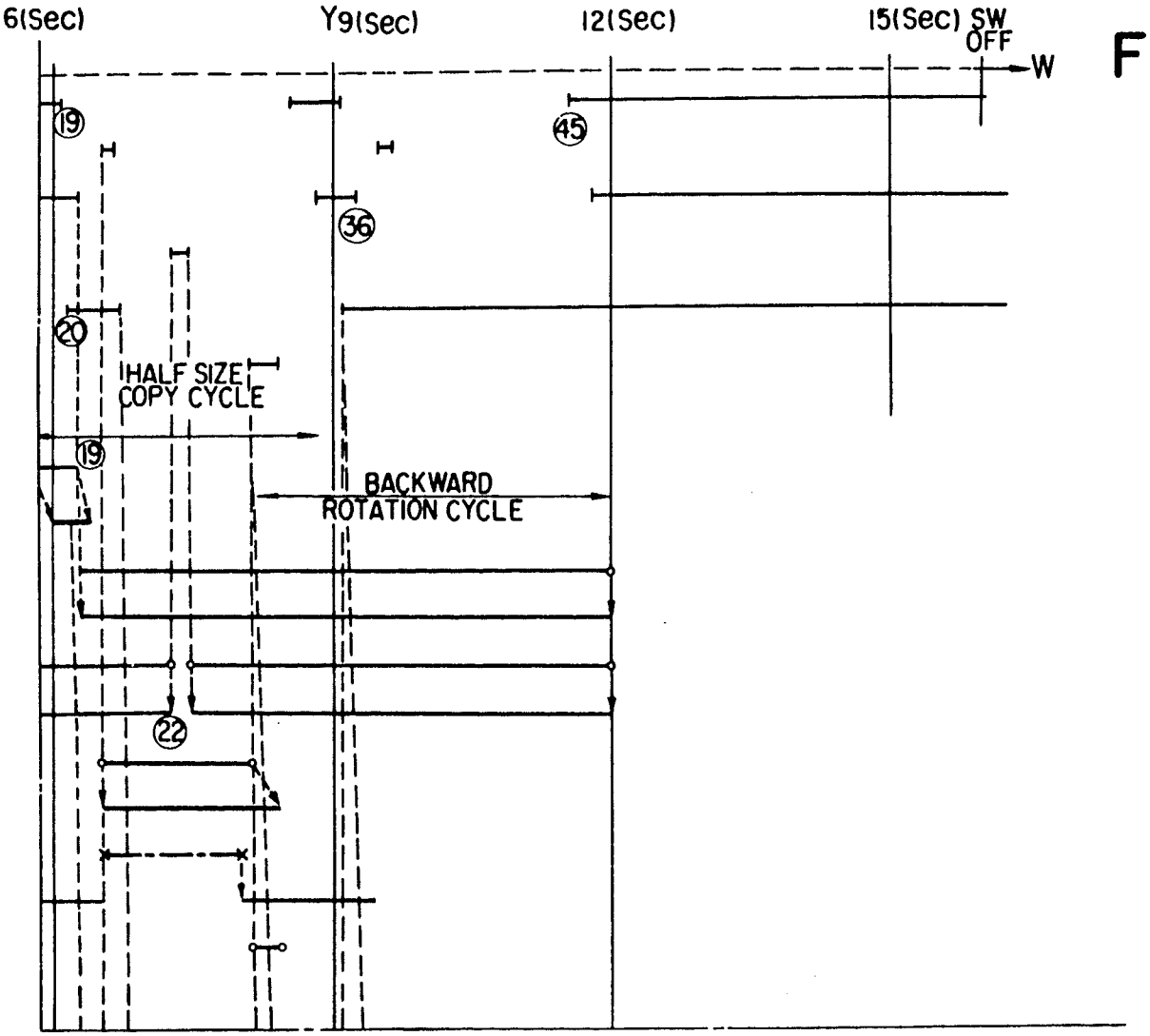
Figures 1, 1B, 4:
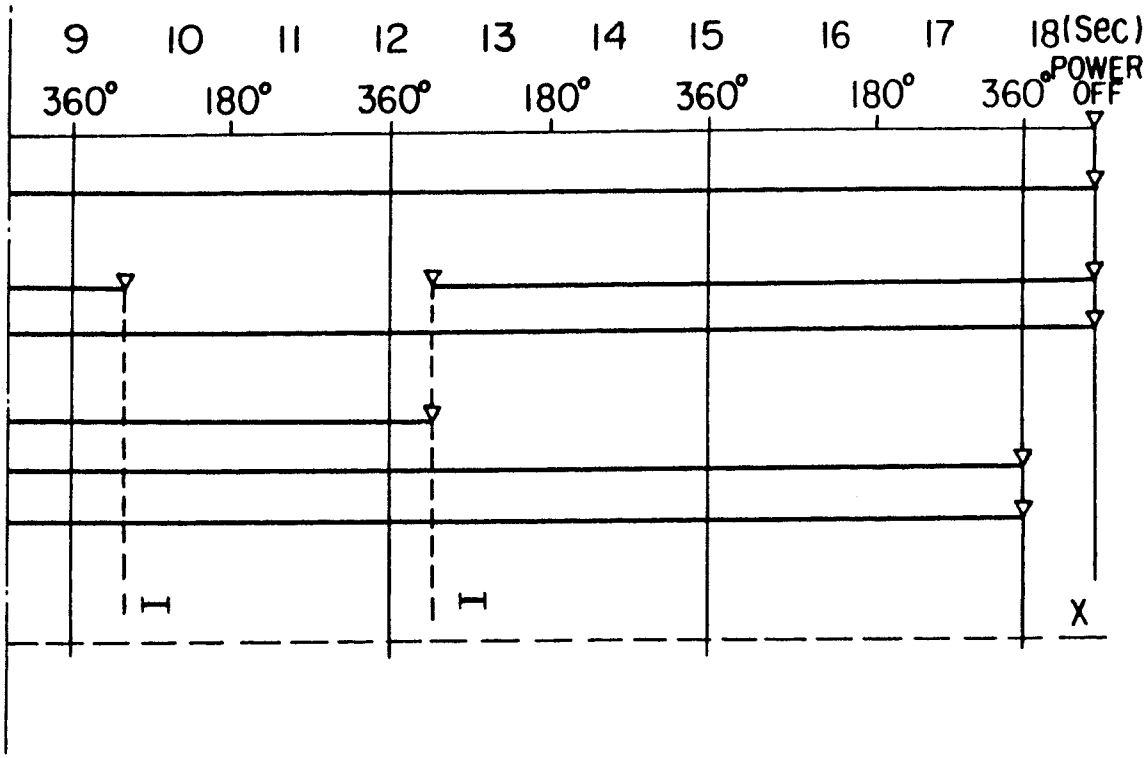
Figures 1A, 4:
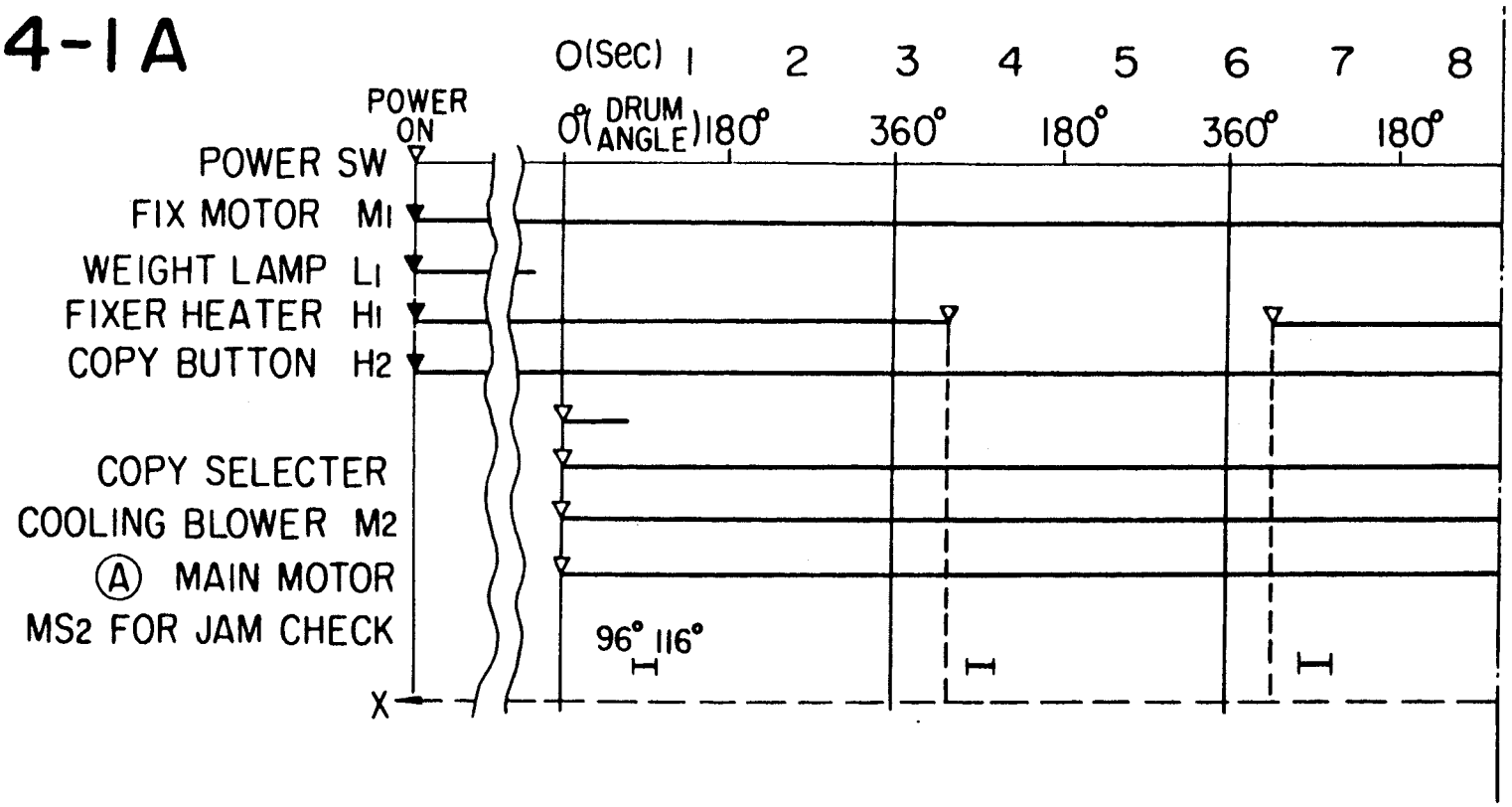
Figures 2, 3, 3B, 4:
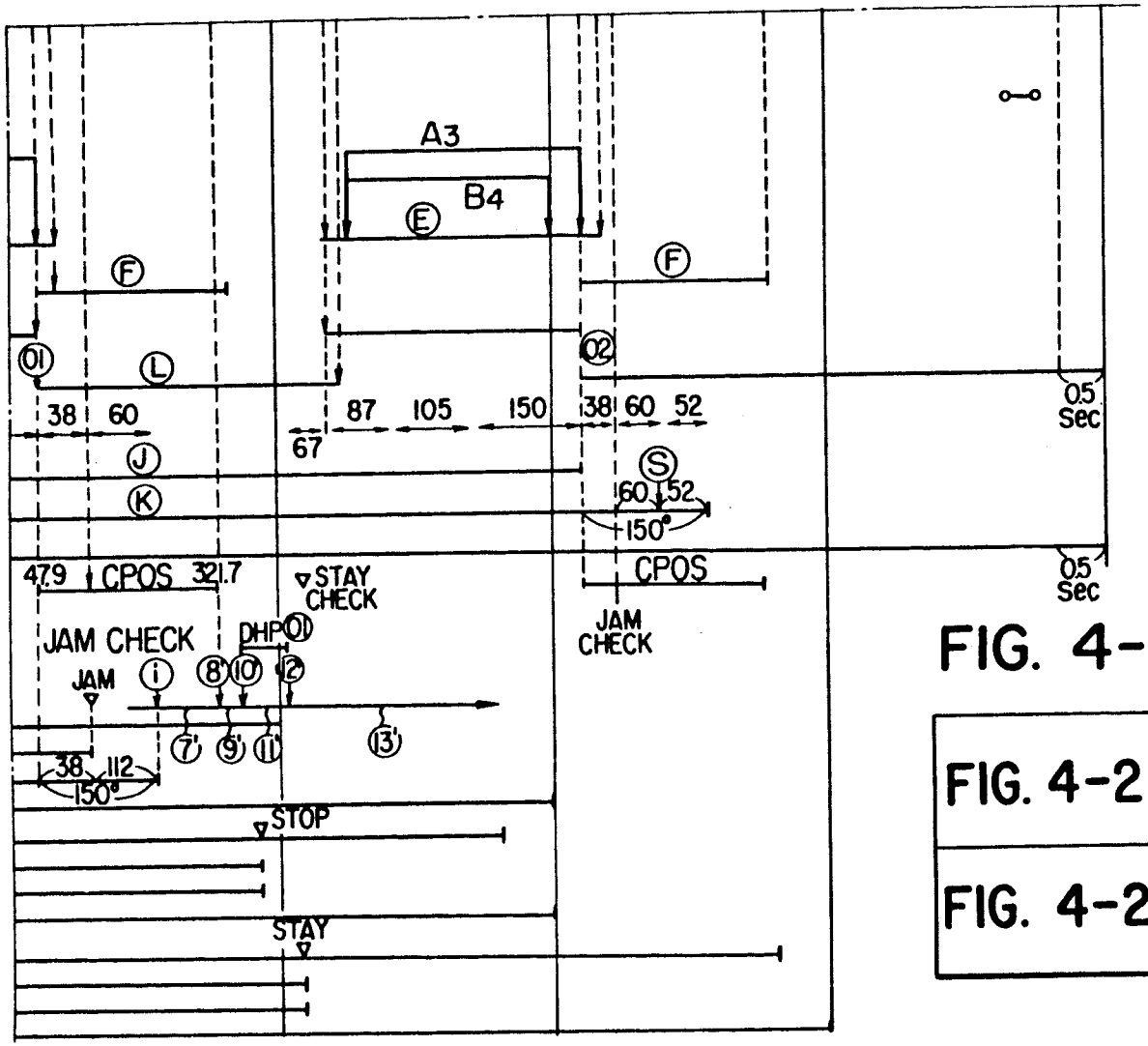
Figures 2, 4:
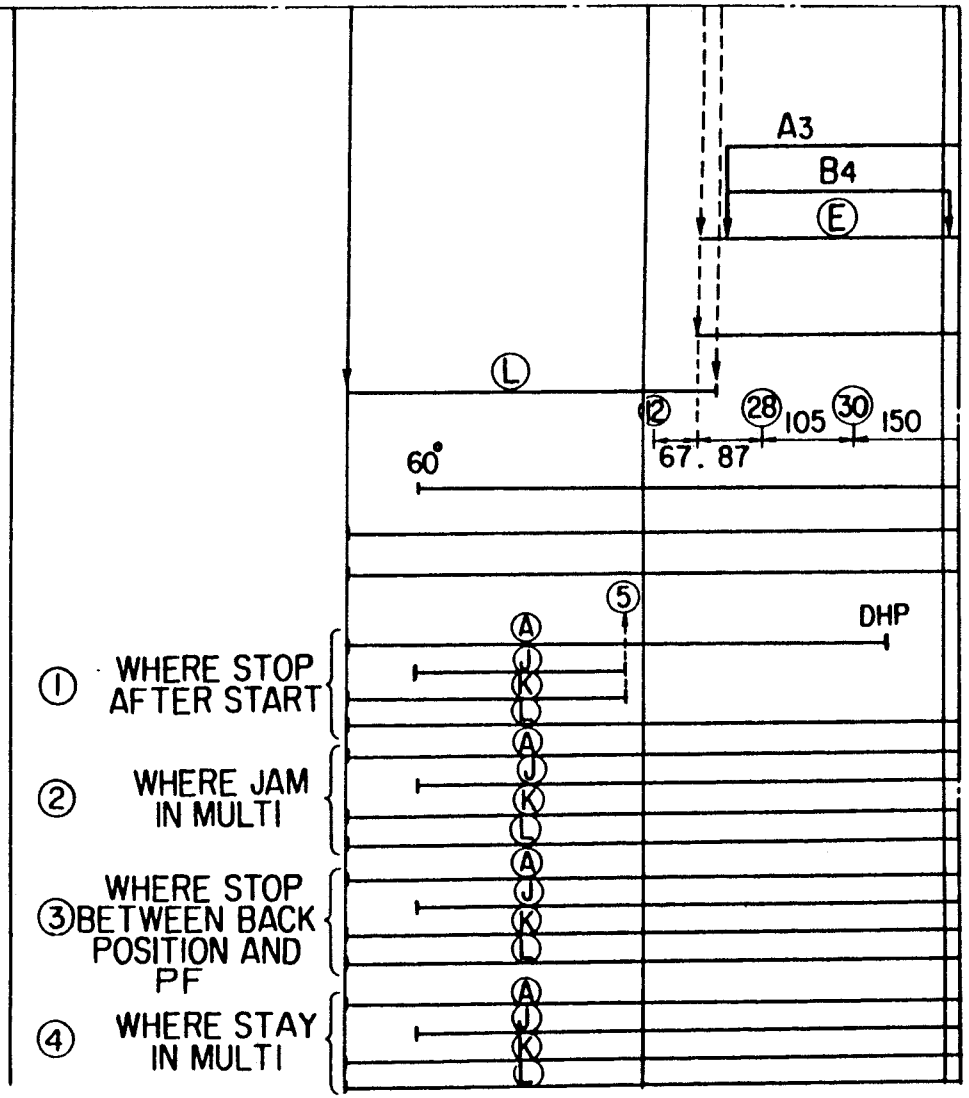
Figures 3A, 4:
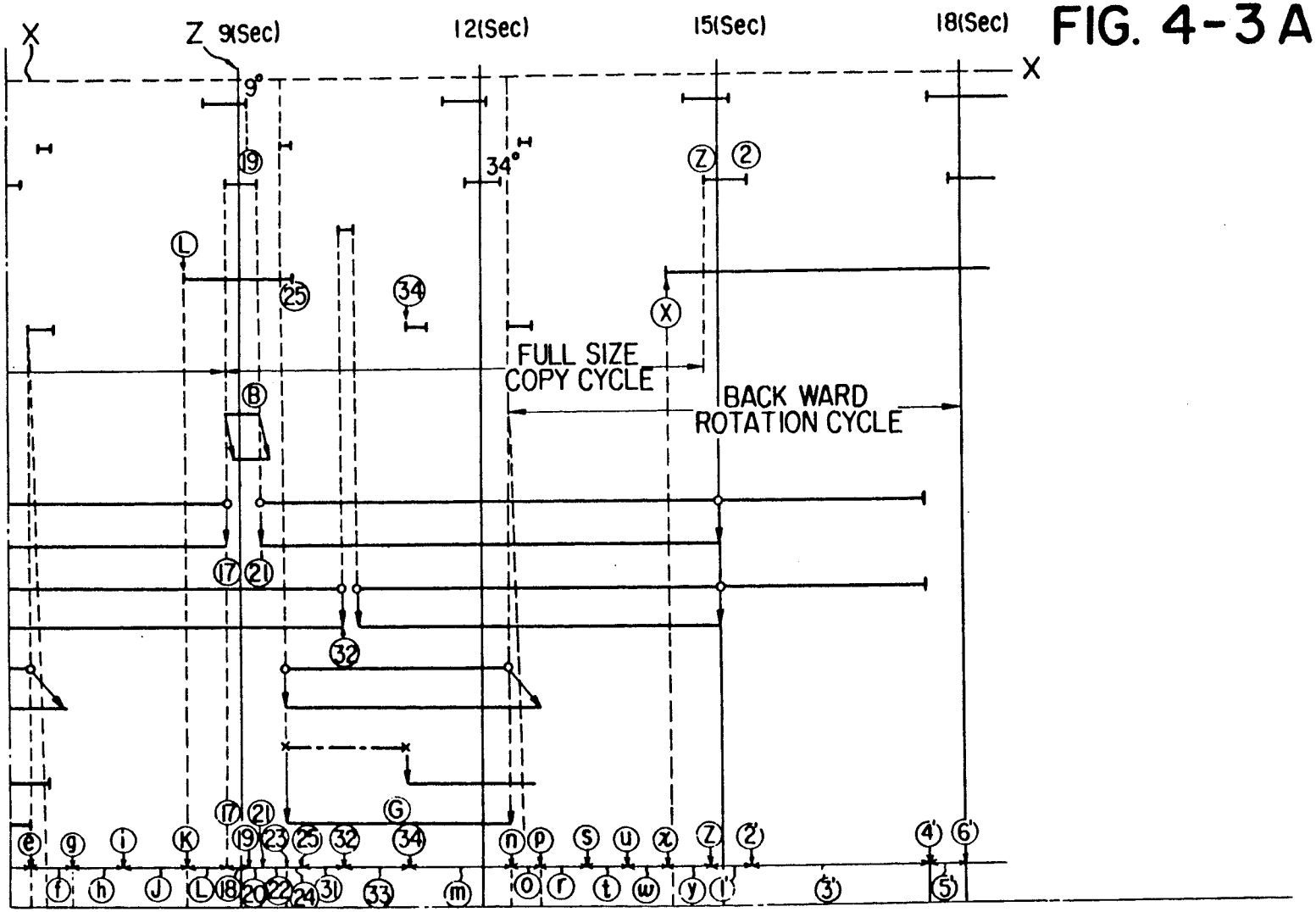

FIG. 3 shows the control timing chart with controlled loads when copying sheets in half size such as AD, B5, U2 are used while FIG. 4 shows the control timing chart with controlled loads when copying sheets in full size such as A3, B4, U1 and so on are used.

U-1 and U-2 are universal cassettes, and the cassette $U_1$ contains the copying sheets one half in size of the copying sheets in the cassette $U_2$. SW is a power switch. When it is closed, "POWER SUPPLY" lamp is turned on. M1 is a motor for driving the fixing rollers and is energized when the power switch is closed. L1 is a wait lamp which is kept turned on until the fixing rollers reach a predetermined fixing temperature as described elsewhere. H1 and H2 are fixing heaters incorporated in the fixing rollers. M2 is a motor for driving a cooling blower for cooling the heaters H1 and H2. A main motor drives the drum. PL is a plunger for moving downward the feed roller 24 which is normally rotated. A first register PL is a plunger for driving the first rollers 25. A second register PL is a plunger for driving the pair of timing rollers 29. A developer PL is a plunger for driving a screw for mixing and agitating the toner. ATR is a photosensor for detecting the decrease in concentration of toner. A hopper is actuated in response to the output from the photosensor. A pre-exposure lamp L2 uniformly illuminates the photosensitive member prior to the formation of an electrostatic latent image. M4-F is a motor for driving forward the optical system while M4-B is a motor for driving backward or returning the optical system to its initial position. L3 is a lamp for focusing the image of the original upon the photosensitive member. A blanking lamp L4 illuminates uniformly the photosensitive member when no image is focused on it. L5 is a lamp for uniformly illuminating the photosensitive member in the whole exposure process. A primary transformer Tr1 is for operating the primary charger and the charger for transferring the toner image from the drum to a copying sheet.

The operation timing will be described in detail later.

Directly derived from the central processing unit CPU are the following.

The control signal A for driving the main motor, the motor for the cooling fan and the transformer Tr3 for an AC charger; the control signal B for operating the plunger of the feed roller of the upper cassette;

the control signal E for operating the motor F for driving forward the optical system, the exposure lamp L3 and the plunger PL for the developer;

the control signal F for driving the motor B for returning the optical system;

the control signal G for turning on and off the pre-exposure lamp L2;

the control signal for turning on and off the jam display lamp and for operating the reset plunger;

the control signal J for obtaining a desired voltage from an AC transformer;

the control signal K for controlling the primary transformer Tri which so controls the waveform that the surface potential becomes zero; and the control signal L for turning on and off the blanking lamp L4.

The first register plunger control signal C, the second register plunger control signal D and the control signal for turning on and off the whole surface exposure lamp are derived by the logical combinations of the control signals derived directly from the central processing unit CPU. That is, $$C=A\cdot\overline{B},$$

$$D=(\overline{RG\cdot E})\cdot A,$$

and $$H=E+L.$$

In addition to the above control signals, the central processing unit CPU generates a signal UL for selecting the upper cassette, the control signal TC for controlling the total counter and so on. (As described elsewhere, RG is the signal which is generated by the microswitch disposed in the passage of the optical system and which represents the second registration position.)

The inputs signals applied to the input ports or pins PI5–PI8 of the central processing unit CPU are as follows:

the drum home position signal DHP (which is generated by the switch which is actuated by the cam attached on the drum as described elsewhere), the optical system home position signal OHP (which is generated by the microswitch located at the end of this scanning path), the copying sheet feed signal PF (which is generated by a microswitch which is actuated by a cam attached to the drum), and the pulse signal CP which is generated by the pulse generator 36 one at every rotation of the drum through 1°. Instead of the pulse generator 36 of the type described elsewhere, an oscillator which generates a train of clock pulses in synchronism with the rotation of the drum 35 may be employed.

In order to drive the set and copy counters 25 and 26, the digit drive signals $CT_{1-1}$, $CT_{1-2}$, $CT_{2-1}$ and $CT_{2-2}$ are generated in a time division manner as shown in FIG. 6-6, and the segment drive signal which consists of four binary digits are derived from the output terminals a, b, c and d as described elsewhere.

Entered in parallel from the pins PI1–PI4 into the central processing unit CPU are the signals generated when the keys in the numeral key group 21 and the in the instruction code key groups 22 and 23, namely the "COINCIDENCE" signal generated when the copying sheets in the same size are contained in both the upper and lower copying sheet cassettes and "SIZE" signal indicating whether the selected upper or lower cassette contains the copying sheets in half size or in full size in time-division relationship with the digit drive signals CT1-1 through CT2-2 and the output signal E.

Applied to the input ports INTO and INTI of the central processing unit CPU are the "STOP" signal generated when neither of the upper or lower cassette is selected even when the selection button is depressed, when no copying sheet is contained in the selected cassette or when "STOP" key is depressed during the copying operation (See FIG. 6-4), and "CPOS" signal generated when a copy is detected by the detector 2 (See FIG. 1) as being discharged into the tray.

Central Processing Unit and Peripheral Circuits

FIG. 7 is a circuit diagram of the one-chip microcomputer PPS4/-1, a product of ROCKWELL CORP. (For details, reference is made to the manual of PPS4/1) which is used in the present invention.

Referring further to FIG. 6-1, the relationship among the signals used in the one-chip microcomputer PPS4/1 and the control signals used in the present invention are as follows:

$$DI\sqrt{o}\ 0,\ DI\sqrt{o}\ 1,\ DI\sqrt{o}\ 2,\ DI\sqrt{o}\ 3,\ DI\sqrt{o}\ 4,$$

$$DI\sqrt{o}\ 5,\ DI\sqrt{o}\ 6,\ DI\sqrt{o}\ 7,\ DI\sqrt{o}\ 8 \text{ and } DI\sqrt{o}\ 9 =$$

$$CT1\text{-}1,\ CT1\text{-}2,\ CT2\text{-}1,\ CT2\text{-}2,\ B,\ E,\ F,\ G\ I \text{ and } TC,$$

respectively,

SERIAL OUT=UL, $$RI/\overline{o5},\ RI/\overline{o6},\ RI/\overline{o7},\ RI/\overline{o8},\ RI/\overline{o},\ RI/\overline{o},\ RI/\overline{o} \text{ and}$$
$$RI/\overline{o} = A,\ J,\ K,\ L,\ a,\ b,\ c \text{ and } d, \text{ respectively,}$$

INTO=CP$\overline{o}$S

INTI=STOP

PI1=the common junction between the keys "0", "4" and "8", the "MULTI" key and the "UPPER and LOWER CASSETTE" selection keys, PI2=the common junction between the numeral keys "1", "5" and "9", the "SINGLE" key, and "AUTO" key, PI3=the common junction between the numeral keys "2" and "6", the "INTERRUPT" key, the "CLEAR" key and the "COINCIDENCE" key, PI4=the common junction between the numeral key "3", and "7", "RECALL" switch, the "JAM" switch and "SIZE" switch, PI5, PI6, PI7 and PI8=PF, OHP, DHP and CP.

When PF, OHP and DHP are detected, the one-chip microcomputer is turned on and is delivered with "0" level inputs.

The "ORIGINAL" lamp is turned on when the signal J is applied to the inverter 601, so that OR signal is generated. The signal C which is $(A-\overline{B})$ is derived from AND gate 603 to which is applied the signal A and the output from the inverter 602 to which is applied the signal B. The signal D which is $(\overline{RG\cdot E})\cdot A$ is derived from the combination of AND gate 604, NAND gate 605 and an inverter 606. The inverted signal $\overline{RG}$ is applied to the inverter 606 and the output from the inverter 606 and the signal E are applied to NAND gate 605. The output from NAND gate 605 and the signal A are applied to AND gate 604 which delivers the signal D. The signal H which is equal to L+E is derived from OR gate 607 to which are applied L and E.

Each of the digit display units of the set and copy counters 25 and 26 consists of seven bars or segments. The corresponding segments of the four digit display units or light-emitting segment arrays are connected together and to the corresponding output terminals of the driver 608 which decodes a 4-bit signal from the input terminals a, b, c and d for generating the segment activating or driving signals. The scan lines CT1-1, CT1-2, CT2-1 and CT2-2 are set and reset in the order named, whereby the digit display units or light-emitting segment arrays may be sequentially activated. The inputs which are generated when switches at 16 crossovers between the scan lines CT1-1, CT1-2, CT2-1 and CT2-2 on the one hand and the input lines PI1–PI4 on the other hand are time-multiplexed to the four inputs of the central processing unit CPU in the time division manner. That is, the signals "0", "1", "2" and "3" are entered only when the scan line CT1-1 is energized. In like manner, the signals "4", "5", "6" and "7" are entered only when the scan line CT1-2 is energized. The signals "8", "9", "INTERRUPT" and "RECALL" are entered only when the scan line CT2-1 is energized. The signals "MULTI", "SINGLE", "CLEAR" and "JAM" are deciphered only when the scan line CT2-2 is activated. The signals "UPPER CASSETTE", "LOWER CASSETTE", "AUTO", "COINCIDENCE" and "SIZE" are deciphered only when there exists the signal E representing that the exposure lamp is turned on. Diodes 19 are provided in order to prevent the flow of current in the reverse direction.

Referring to FIGS. 6-2, 6-3 and 6-4, switches MS13, 19 and 21 are provided in order to detect the size of the copying sheets in the upper cassette, and whether or not the upper cassette is inserted is detected by a switch MS15. These switches generate a binary signal "0" or "1", and the successive digits from right to left represent weights equal to successive powers of 2; that is, 1, 2, 4 and 8. Switches MS12, 20 and 22 detect the size of the copying sheets in the lower cassette, and whether or not the lower cassette is inserted is detected by a switch MS16. The successive digits also represent weights 1, 2, 4 and 8. The coded signals are applied to a multiplexer 609 which in turn passes the code signal representative of the upper or lower cassette in response to the selection signal UL from the one-chip microcomputer CPS to a decoder 611 which decodes the transmitted coded signal. For instance, when the copying sheets are A3 in size, only the switch MS15 is closed. As a result, the output from the decoder 611 is "0" so that a drive circuit 612 turns on the lamp A3. When the sizes are A4, U1, U2, B4 and B5, the outputs from the decoder 611 are "2", "3", "4" and "5", respectively. When the cassette is not inserted, the output is "8". When the cassette is not sufficiently inserted, neither MS15 or MS16 is turned on so that the weight "8" becomes "1" and consequently the output from the decoder 611 is one of "9"–"15". As a result, no lamp is turned on (See FIG. 5).

The outputs "0", "2" and "4" are applied to OR gate 610 so that the "SIZE" signal is "1" when the copying sheets in full size are contained in the cassette but is "0" when the copying sheets are in half size. The "SIZE"

signal selects a sequence of copying processes depending upon the size of copying sheets to be used.

The outputs from a switch bank consisting of MS13, 19 and 21 and a switch bank consisting of 12, 20 and 22 are applied to a magnitude comparator 610 which in turn generates the "COINCIDENCE" signal "1" when the two outputs coincide with each other. The "1" "COINCIDENCE" signal means that both the upper and lower cassettes contain the copying sheets in the same size.

When the "UPPER CASSETTE" button is depressed, the one-chip microcomputer CPU generates the cassette selection signal UL which is "0". As a result, a transistor 621 is disabled so that an upper cassette detection circuit is energized while the "0" signal UL is inverted by an inverter 623 and applied to a transistor 622, whereby the latter is enabled. As a result, a lower cassette detection circuit is disabled.

When the upper cassette which has been selected is emptied, the resistance across a photosensor CdS615 drops so that the potential at the input 6 of an operational amplifier 613 becomes lower than the potential at the terminal 5 so that the output from the operational amplifier 613 changes to "1" which is the "STOP" signal. The mode of operation of the lower cassette detection circuit when the signal UL is "1" is substantially similar to that described above of the upper detection circuit. When UL=1, and B=1, the sheet feed roller of the lower cassette is actuated, and when UL=0, B=1, the sheet feed roller of the upper cassette is actuated.

Referring to FIG. 6-4, when the "STOP" key is depressed when the main motor is being driven, a flip-flop 617 is set so that the output KSTOP is "1" because A is "1". When the main motor is not driven, A is "0", the flip-flop 617 is not reset. When the main motor is stopped, the flip-flop 617 is reset.

The output KSTOP from the flip-flop 617, the outputs from the upper and lower cassette detection circuits and the signal representing that no cassette is inserted into the copying machine are applied to OR gate 618. The "1" output signal from the OR gate 618 is the "STOP" signal, which is applied to the input port INTI of the central processing unit (See FIG. 1).

Flags in RAM

The following flags are provided in order to set and reset the bits in the RAM (Random Access Memory), thereby controlling various sequences by the one-chip microcomputer:

Flag 1: which is set upon depression of the "SINGLE" key but is reset upon depression of the "MULTI" key.

Flag 2: which is set when the copying sheets are in full size and is reset when they are in half size.

Flag 3: which is set when the contents in the set counter coincides with the contents in the copy counter.

Flag 4: which is set when the discharge of a copy is delayed or when the copy is jammed.

Flag 5: which is set in response to the leading edge of the copying sheet feed signal for the second copy in the "MULTI-COPY" mode.

Flag 6: which is set when the optical system starts its second copying cycle in the "MULTI-COPY" mode.

Flag 7: which is set when the "MULTI" or "SINGLE" key is depressed in the "MULTI-COPY" mode.

Flag 8: which is set when the discharge of a copy is delayed or when a copy is jammed (for instance when a copy is overlying the detector).

Flag 9: which is set when the drum 35 is not in its home position (the initial position) when the power switch is closed and is reset when the drum is returned to its home or initial position and then starts its last half rotation. Flag 9 is also set when the "SINGLE" key is depressed when the drum is in its last half rotation and is reset when the "MULTI" key is depressed.

Flag 10: which is kept set until the number of input pulses has not reached a predetermined number, and is reset when a predetermined number of input pulses has been counted.

Flag 11: which is set in the last half rotation of the drum in the HALF SIZE COPY mode when the optical system has been returned to its home or initial position before the drum rotates through 150° from the time when the optical system has started its reverse or return stroke, and is reset when the drum has been rotated through 150° from the above described time.

Flag 13: which is set when the scan line CT1-1 is energized and is reset when the scan line CT1-1 is de-energized.

Flag 14: which is set and reset in response to the energization and de-energization of the scan line CT1-2.

Flag 15: which is set and reset in response to the activation and deactivation of the scan line CT2-1.

Flag 16: which is set and reset in response to the energization and de-energization of the scan line CT2-2.

Flag 17: which is reset when the upper cassette is selected and is set when the lower cassette is selected. In the "AUTO" mode when the upper cassette which has been previously selected is emptied, the flag 17 is set so that the copying sheets are fed from the lower cassette if and only if the latter contains the copying sheets of the same size as the upper cassette.

Flag 18: which is set when the "INTERRUPT" key is depressed and is reset when the RECALL key is depressed.

Flag 19: which is set when the JAM CHECK OMIT switch is closed whereby the jam check program will not be executed even when the copying sheet feed failure occurs. It is noted here that the JAM CHECK OMIT switch may be actuated by application of either one of input signals "0" or "1 ". Similarly, it is possible to provide a program omit switch for inhibiting the prosecution when no sheet and no cassette.

Various programs are executed depending upon the states of the flags described above.

Sequence Control Flow Chart

Figures 1, 5:
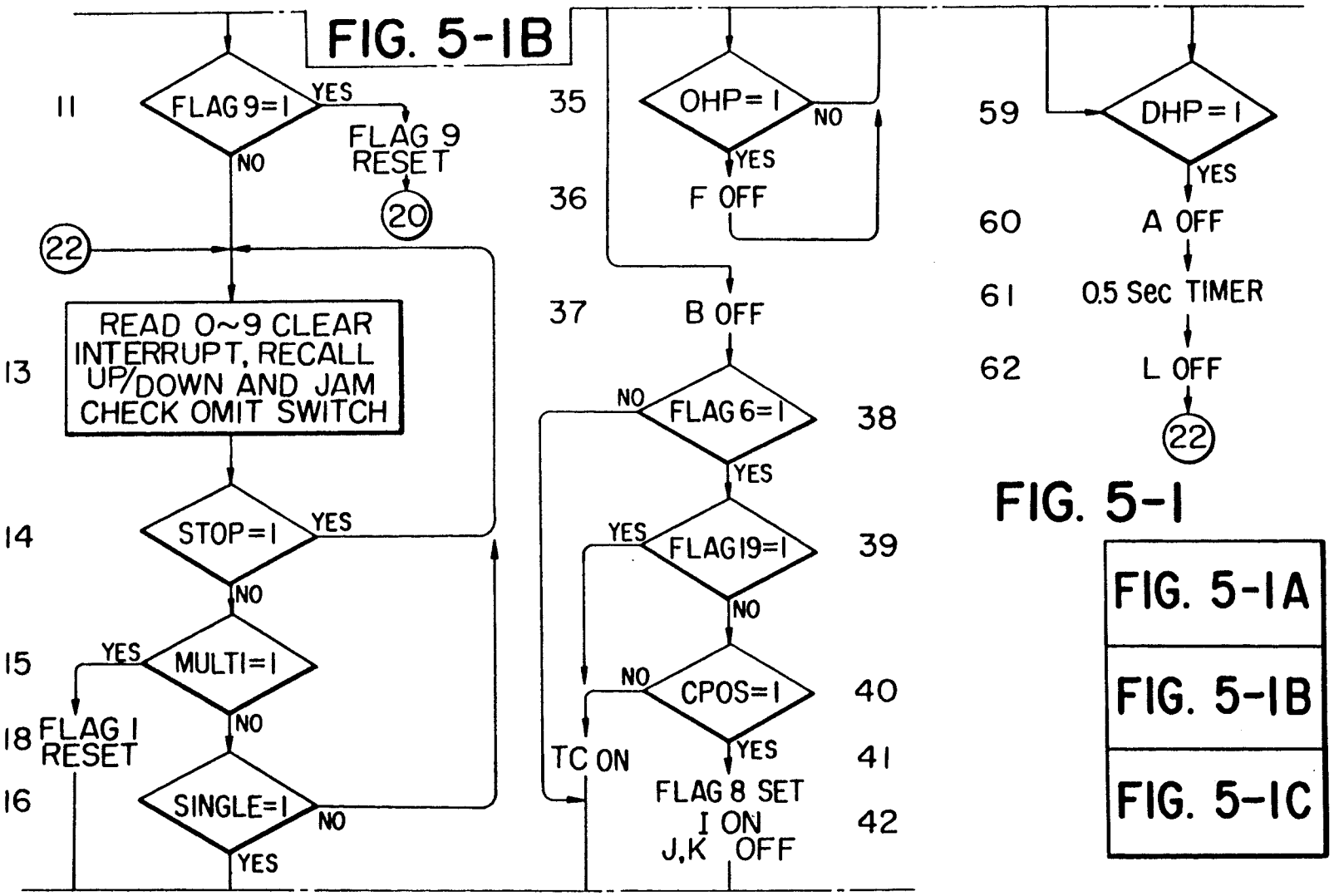
Figures 1A, 5:
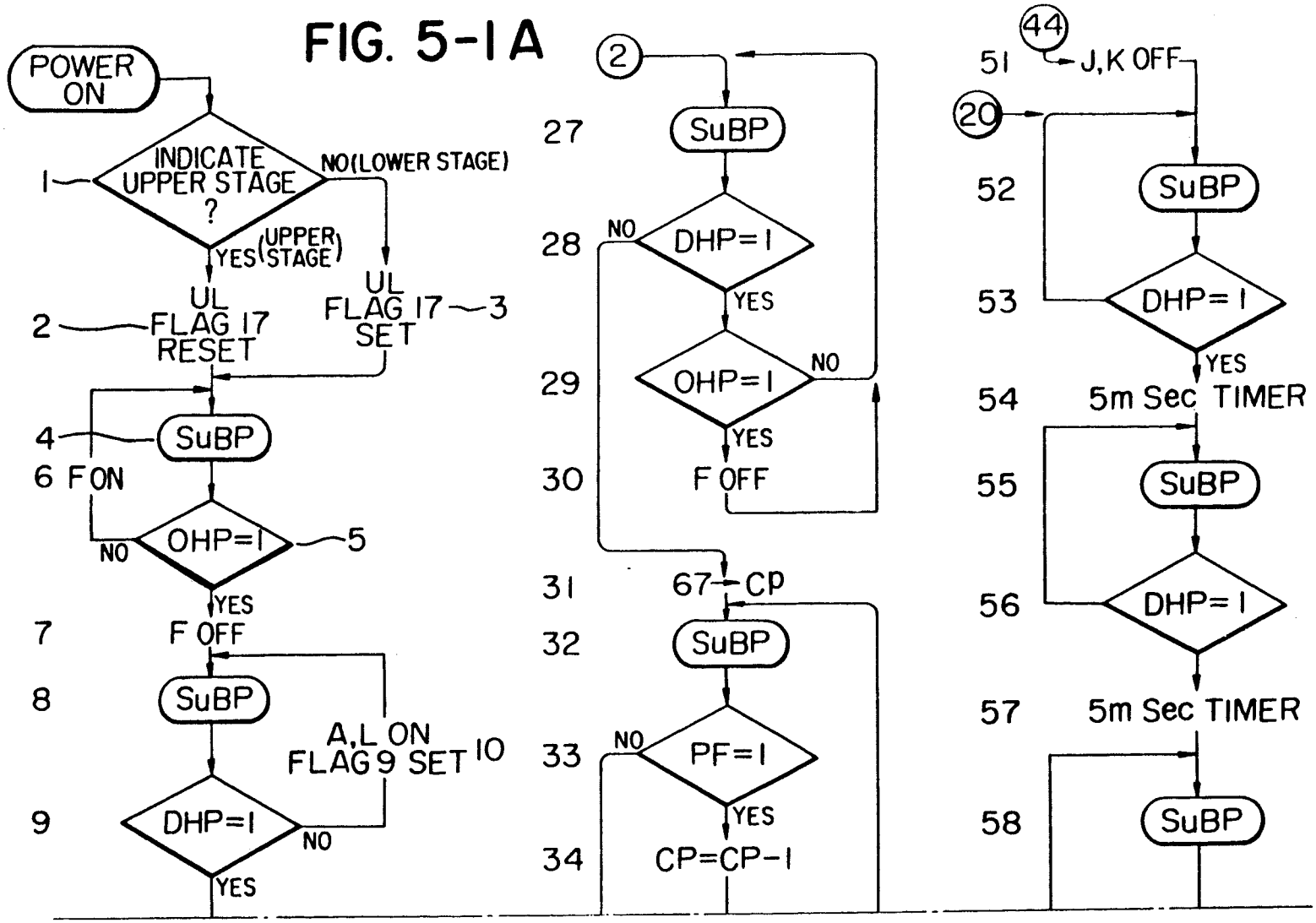
Figures 1C, 5:
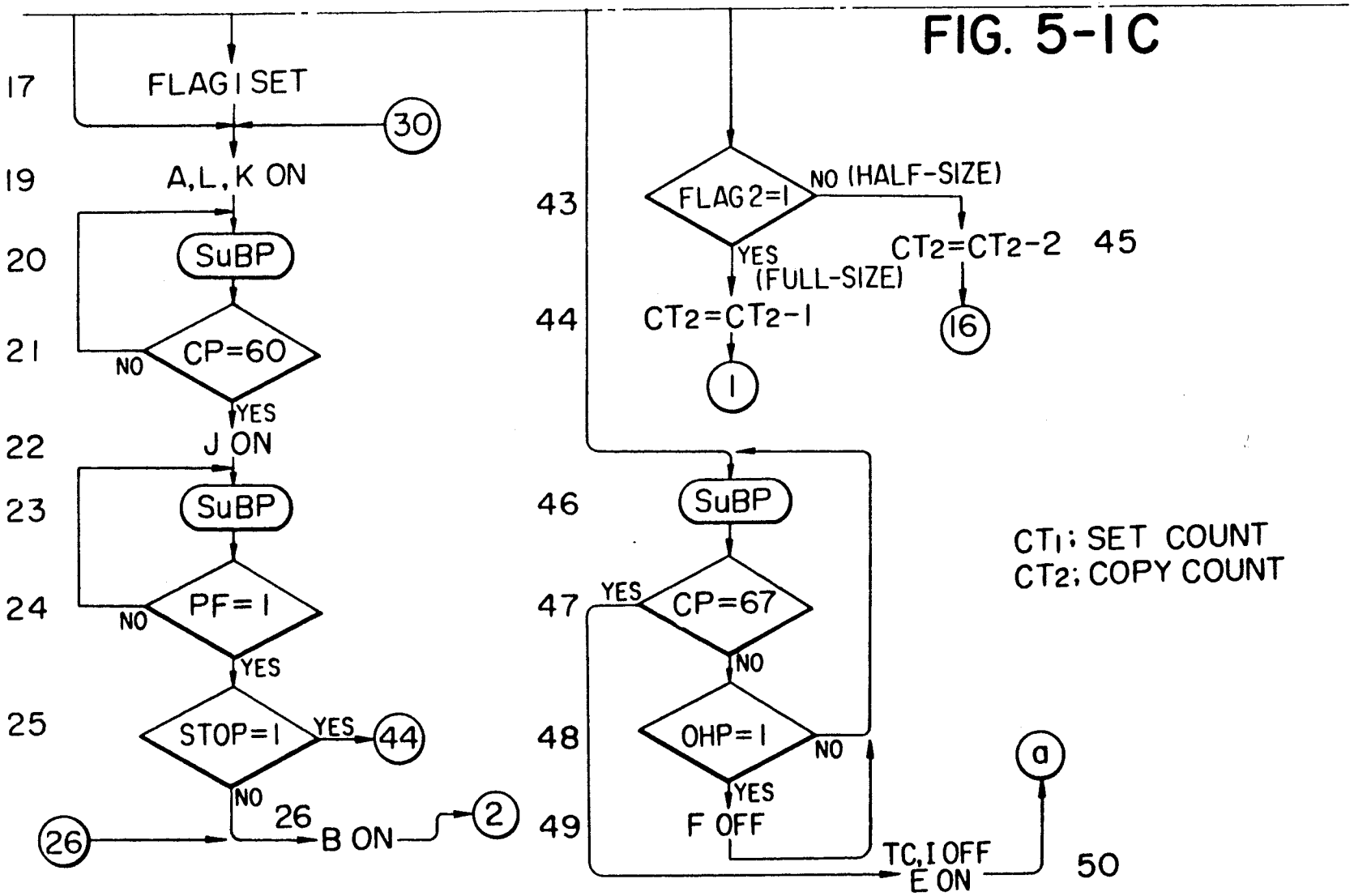
Figures 2, 5:
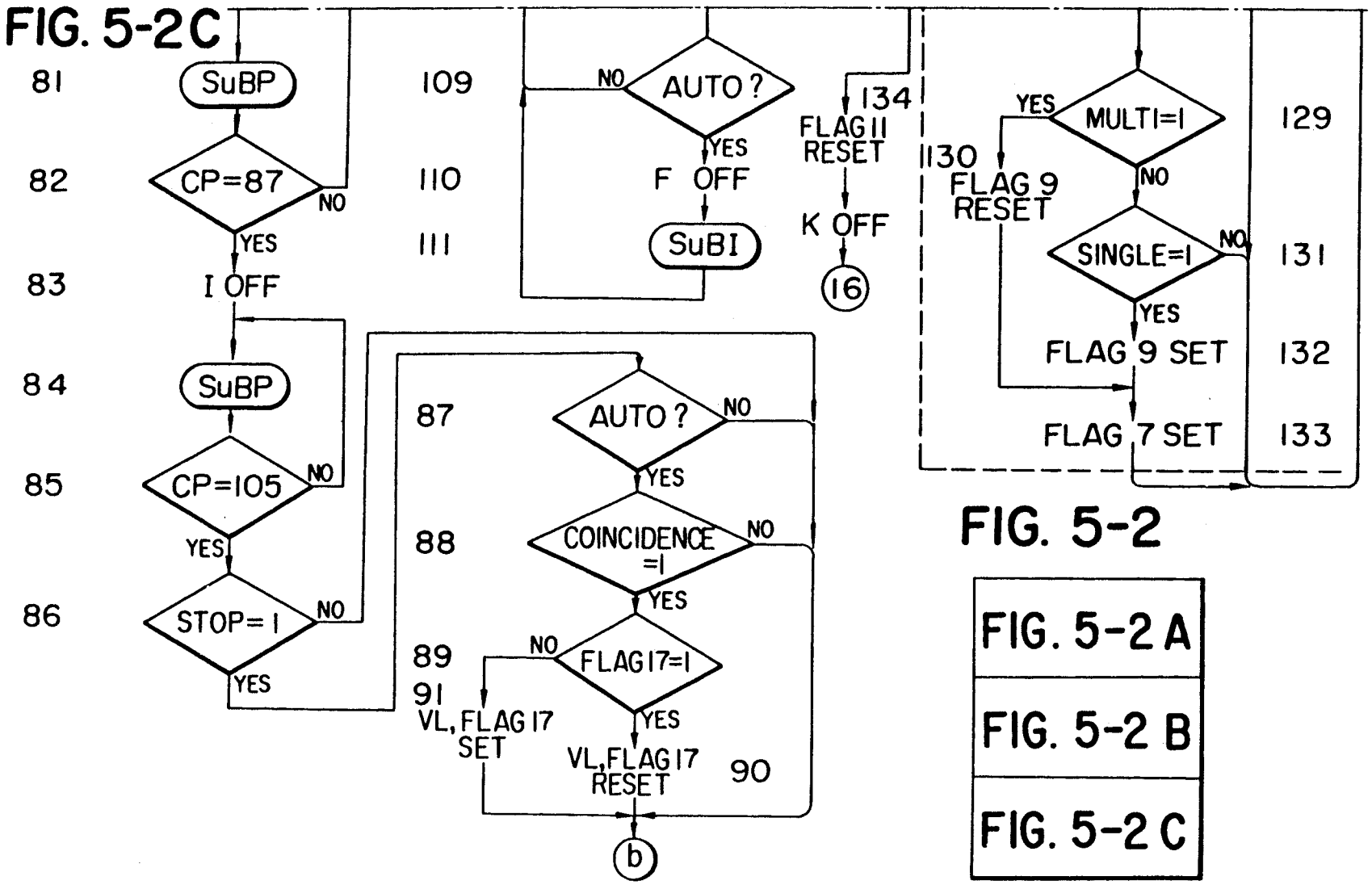
Figures 2, 5:
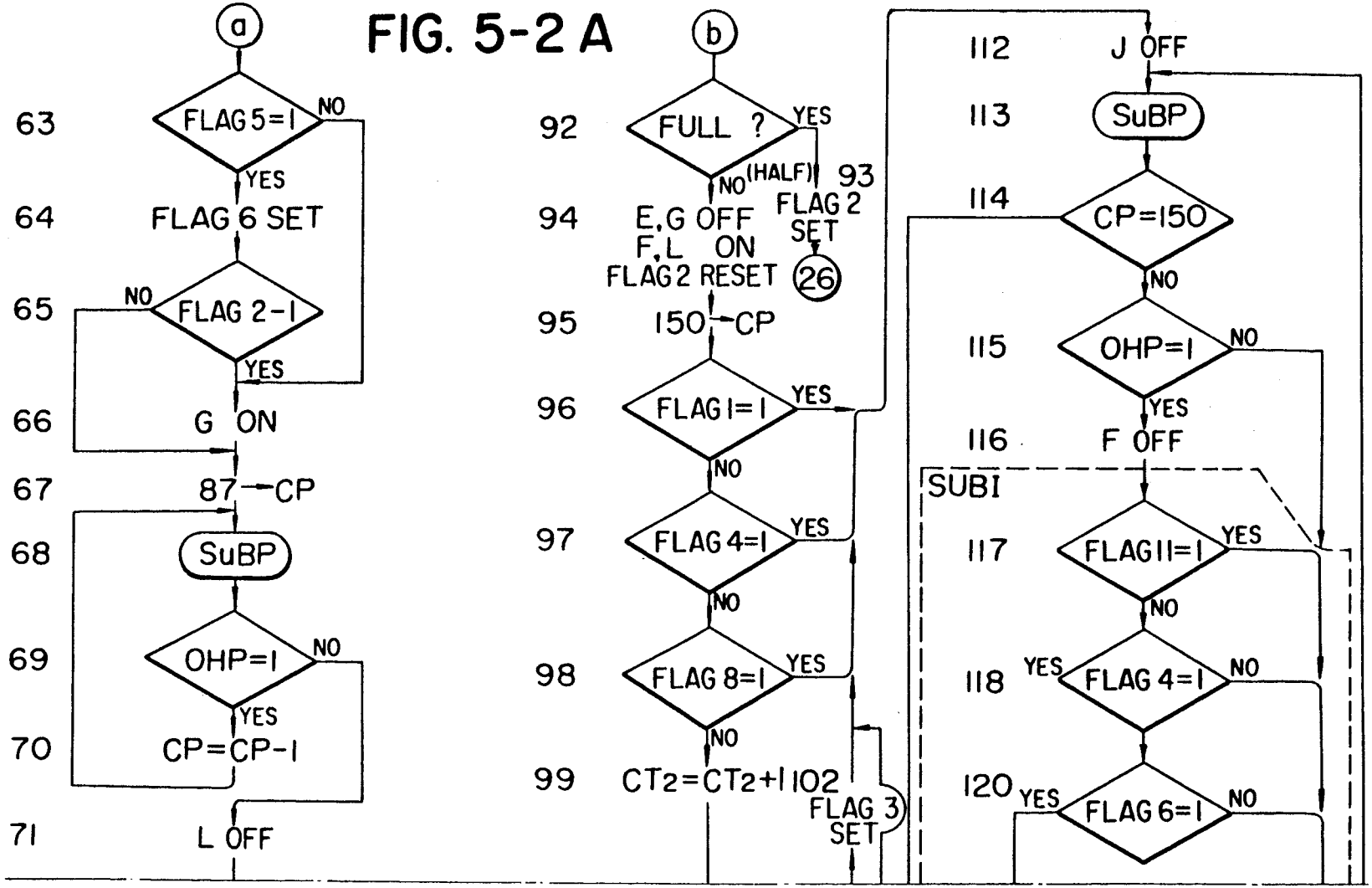
Figures 2B, 5:
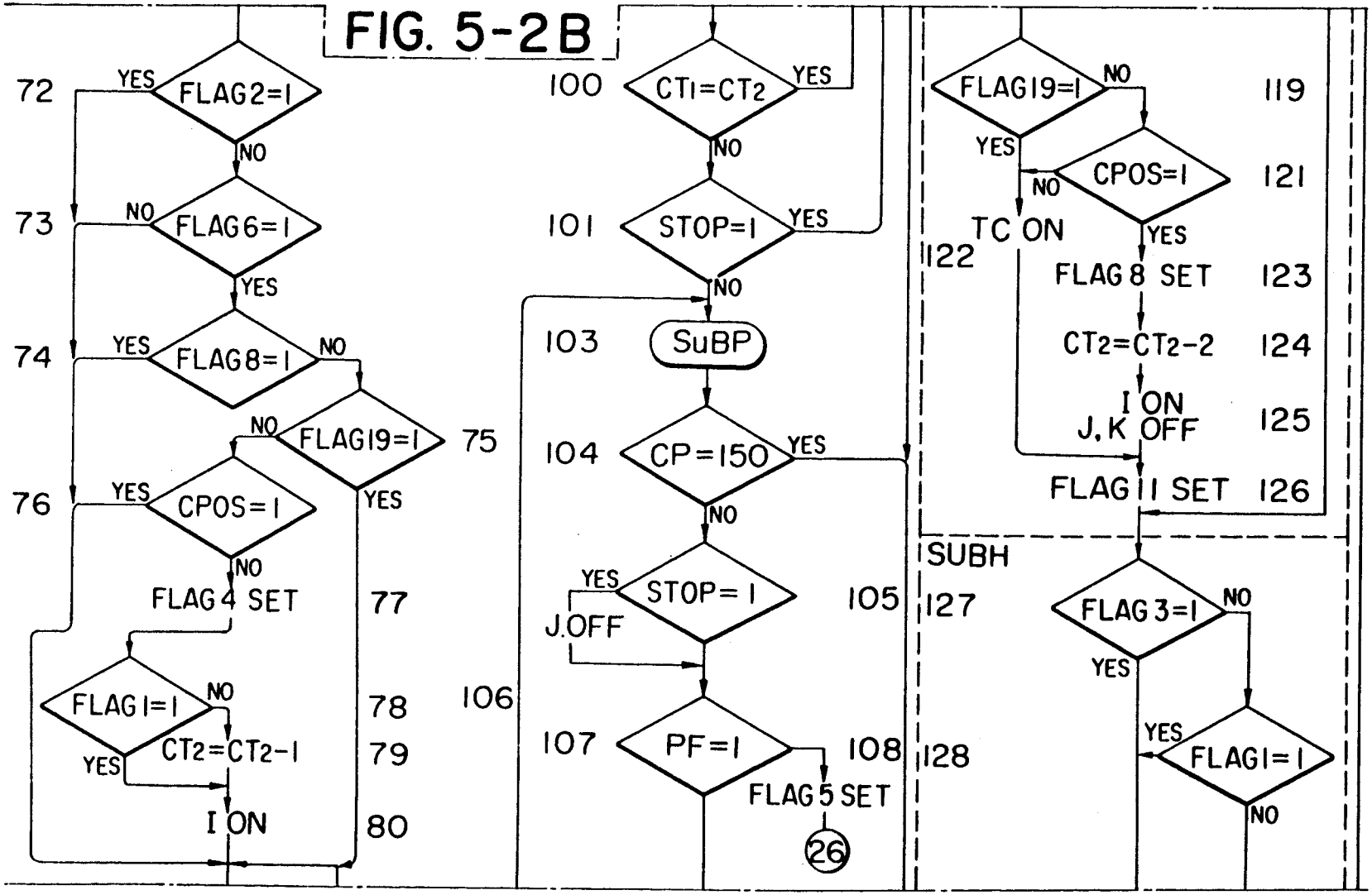
Figures 3, 5:
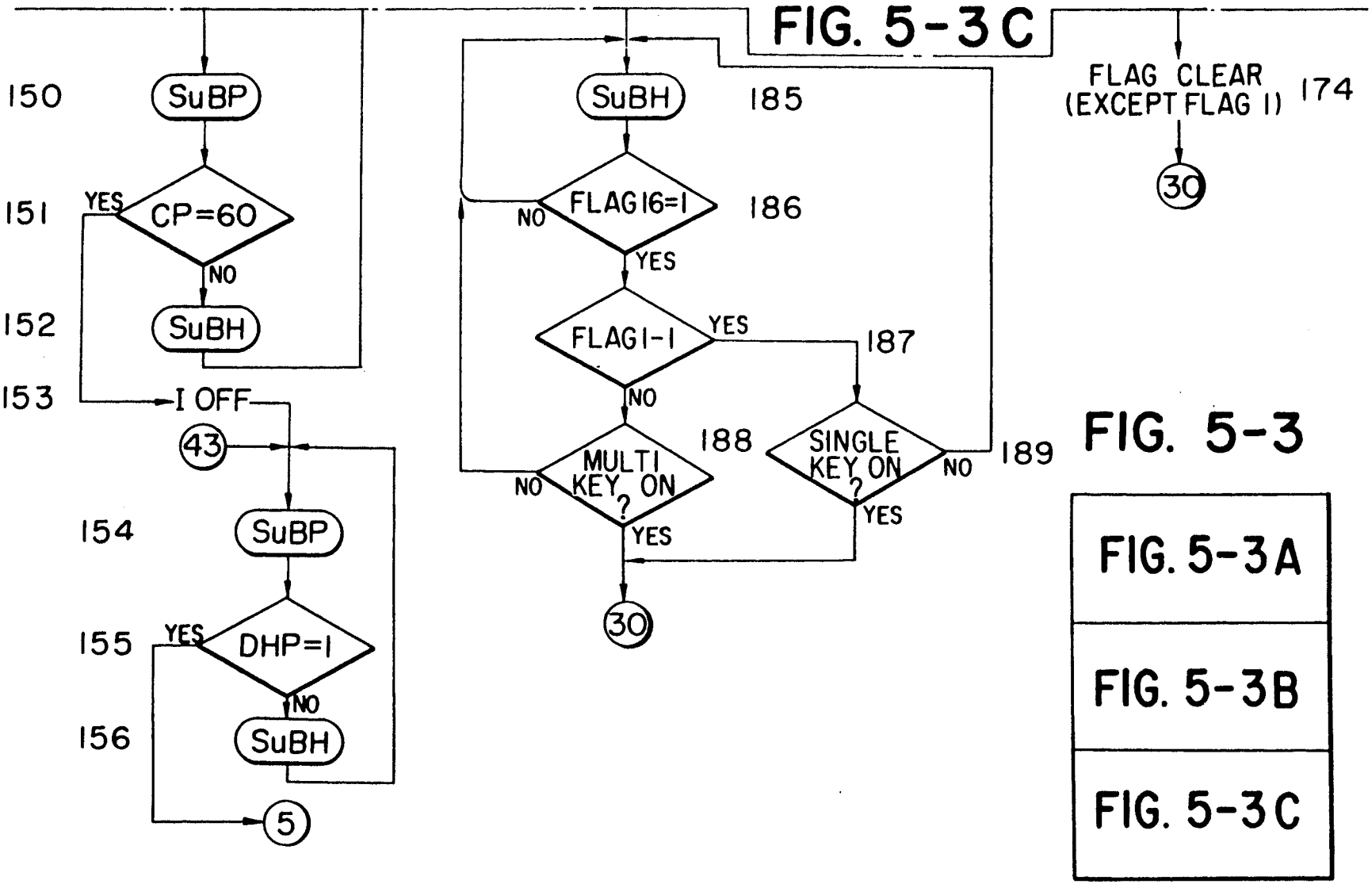
Figures 3, 5:
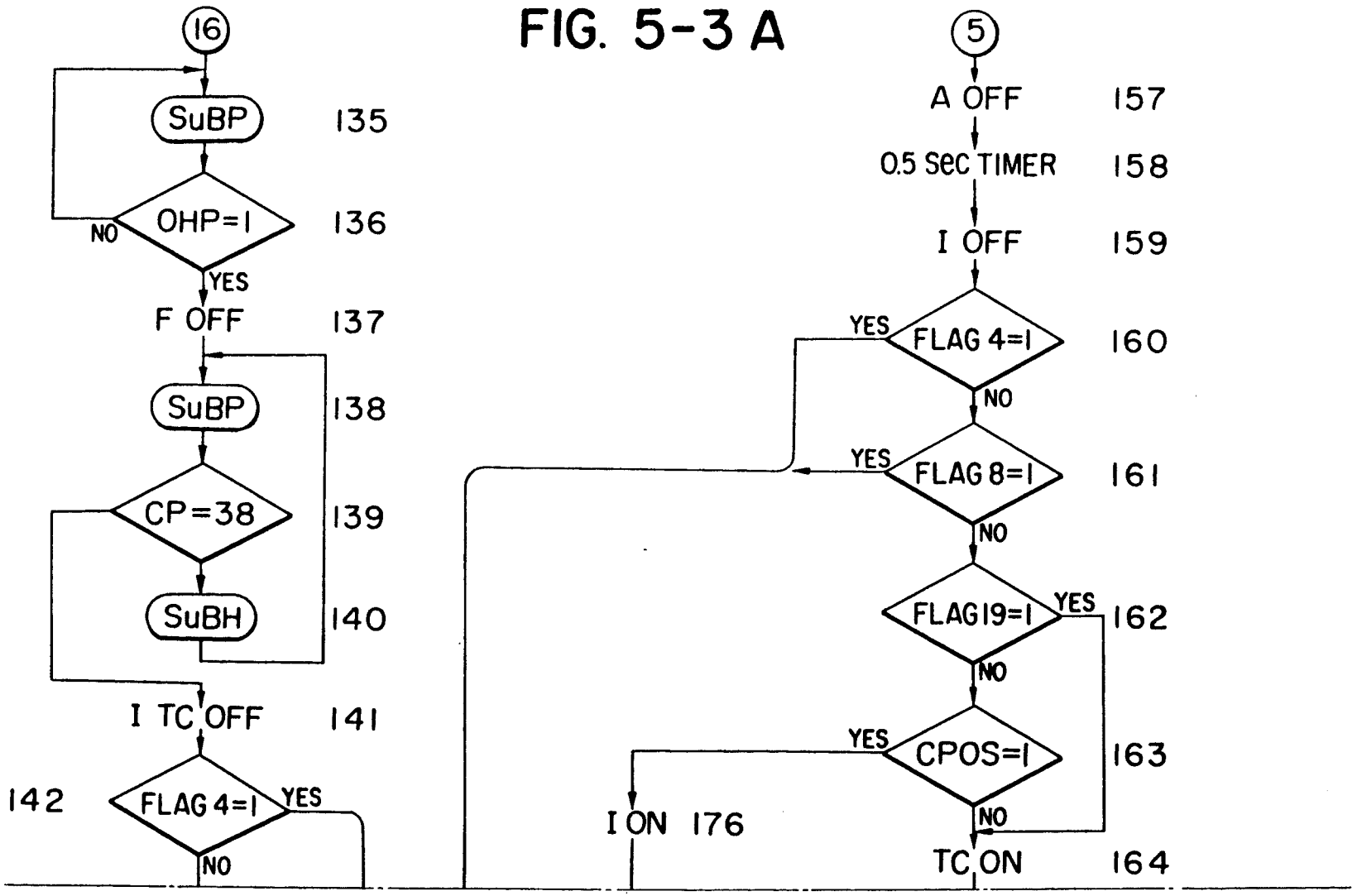
Figures 3B, 5:
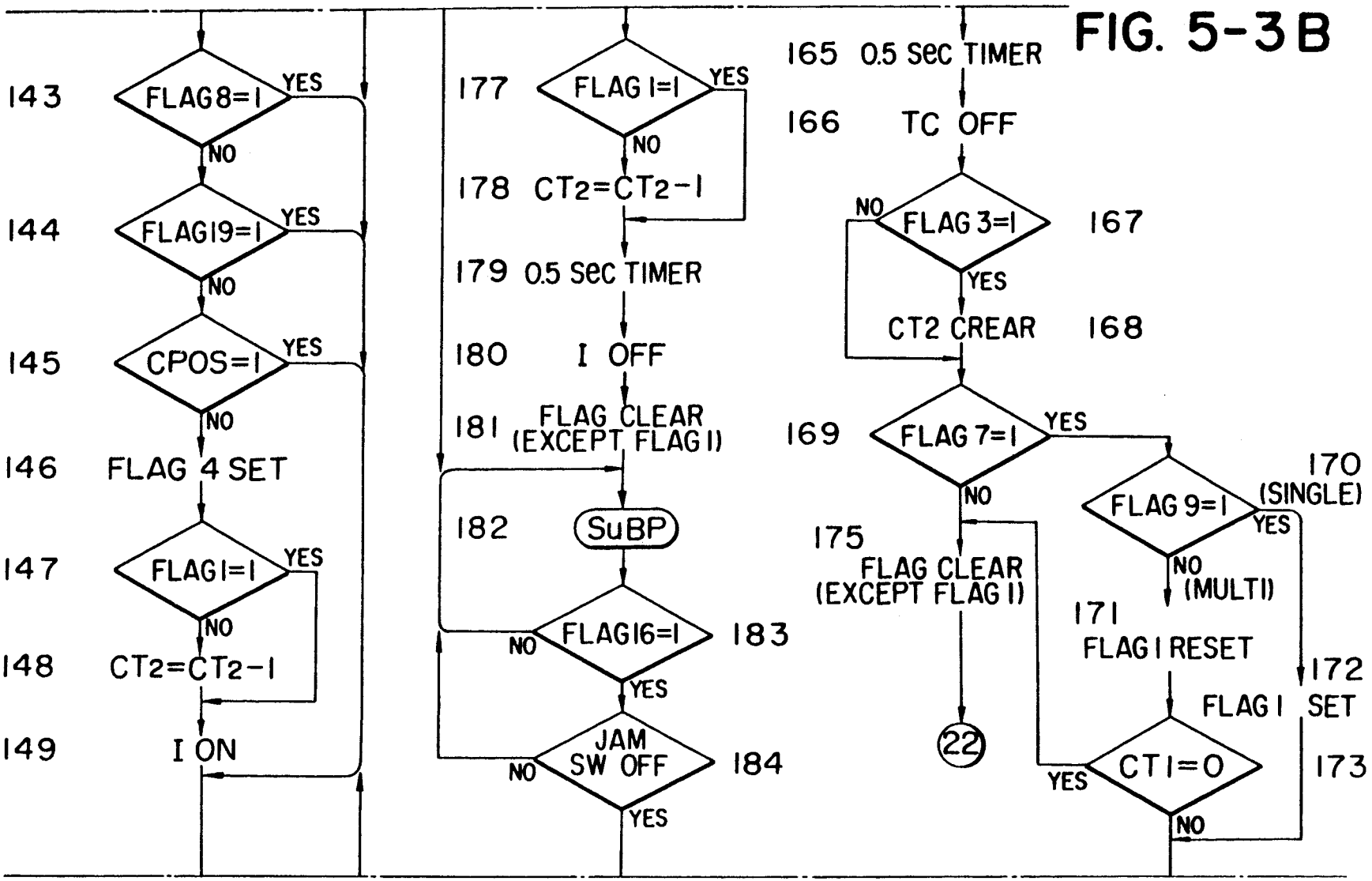
Figures 4, 4C, 5:
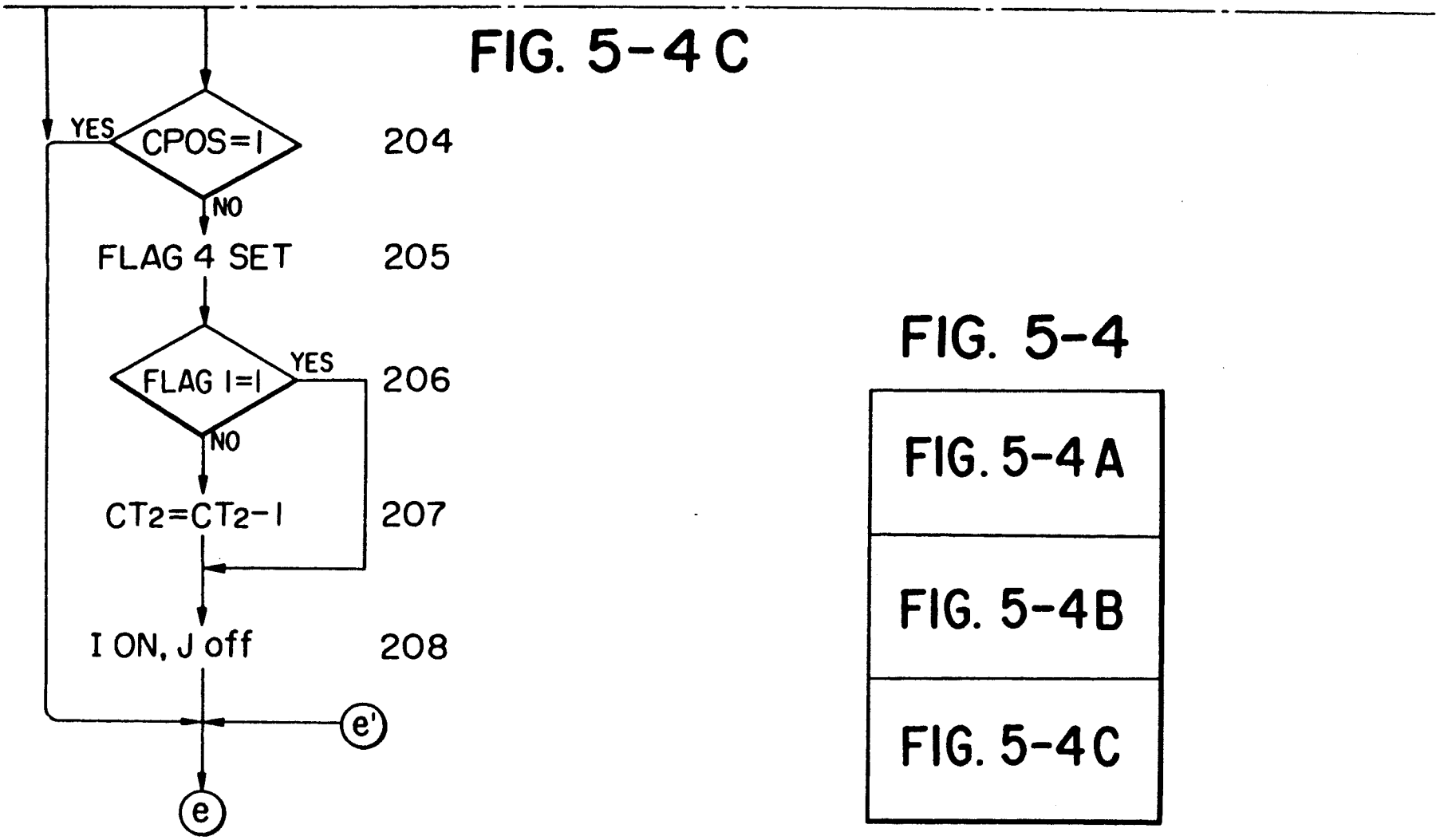
Figures 4A, 5:
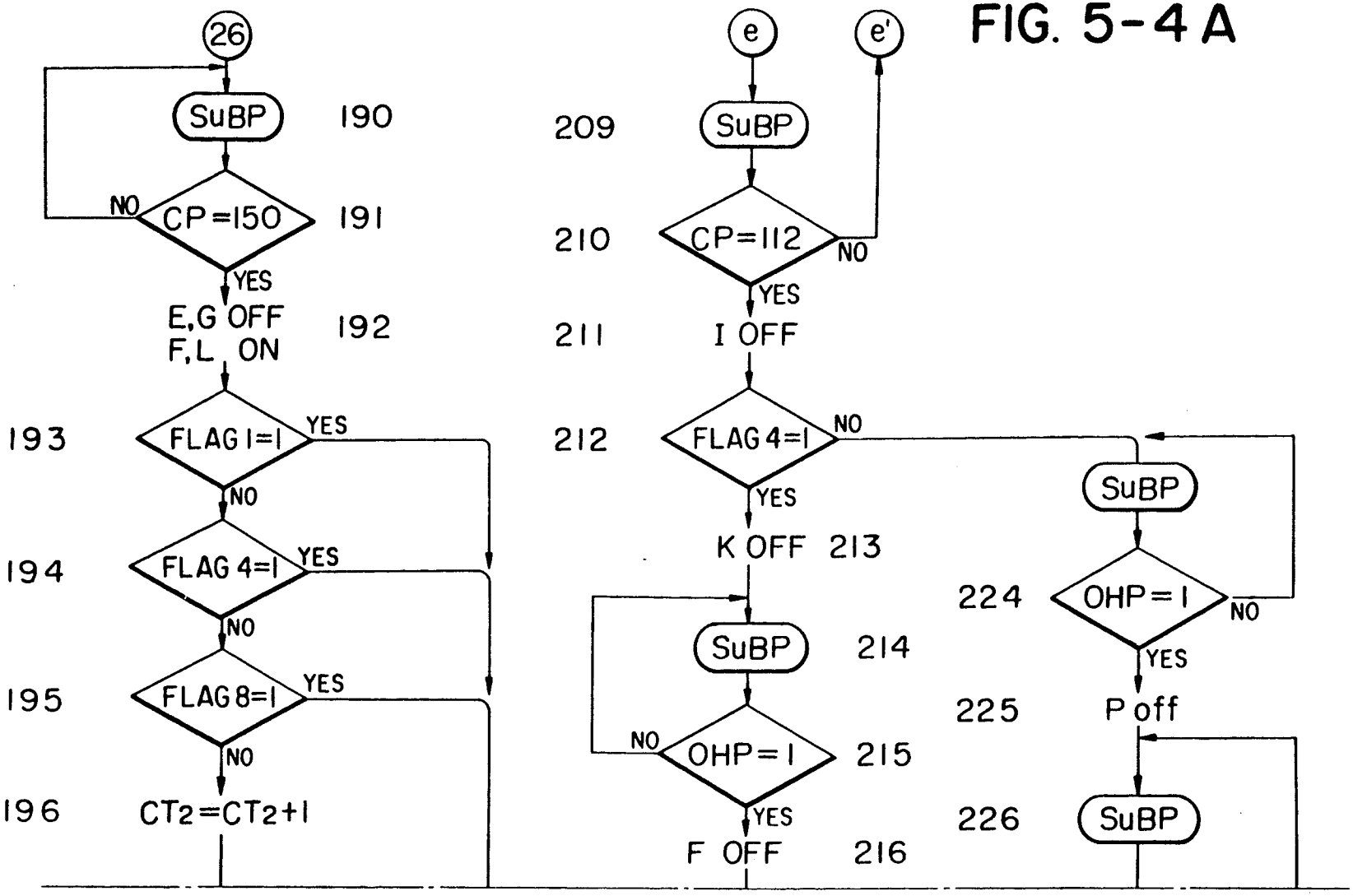
Figures 4B, 5:
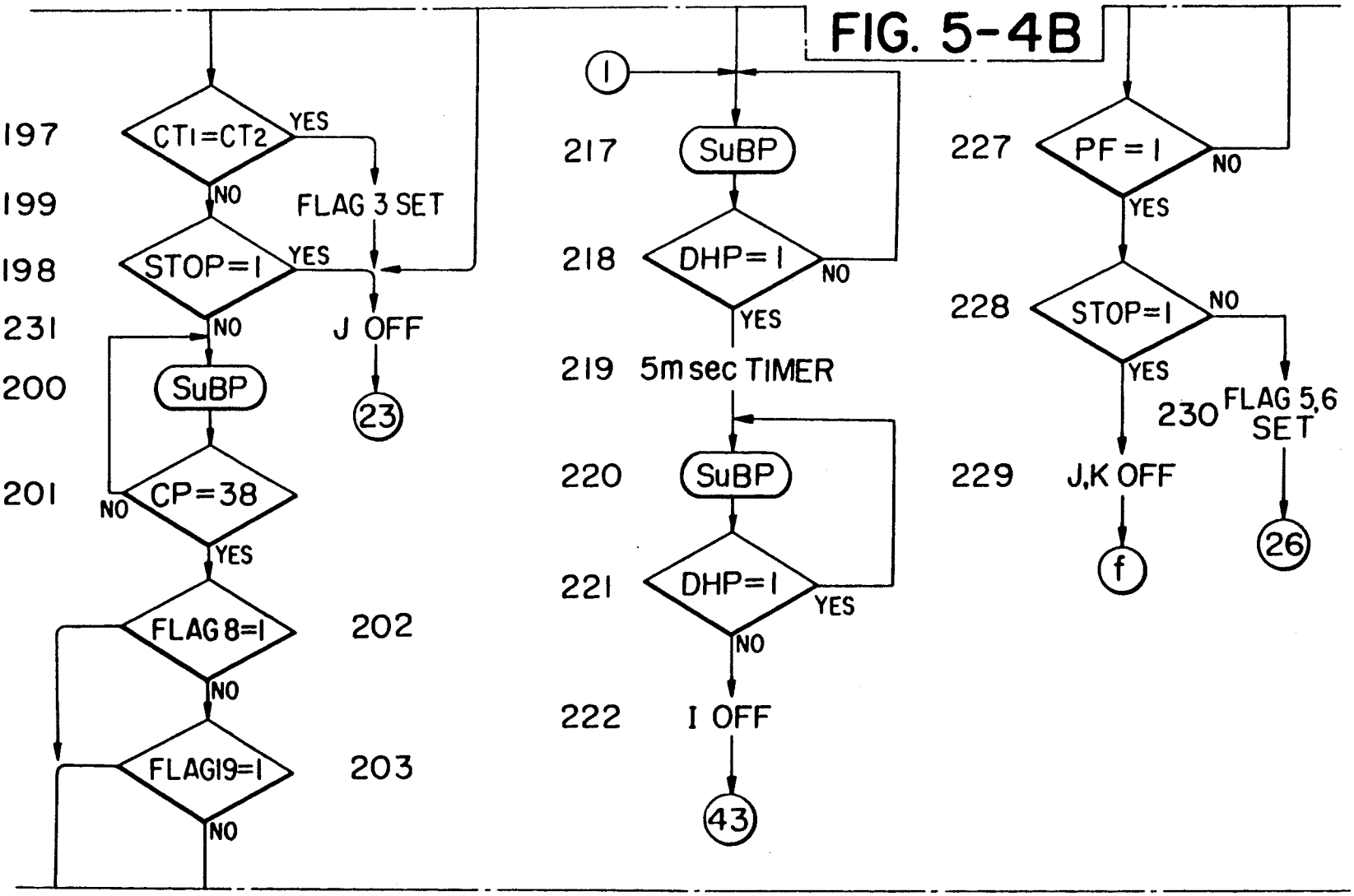
Figures 5, 5B:
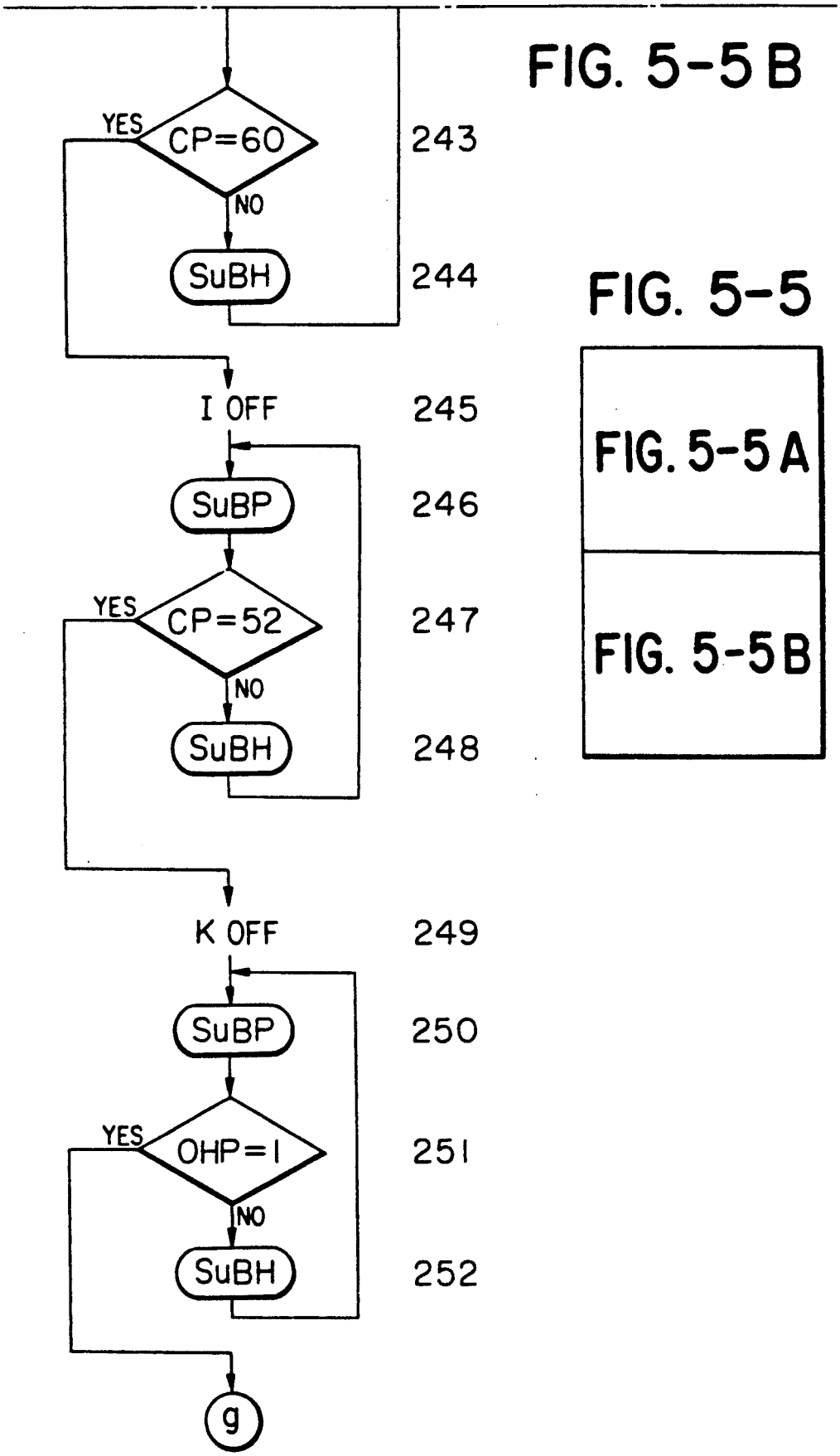
Figures 5, 5A:
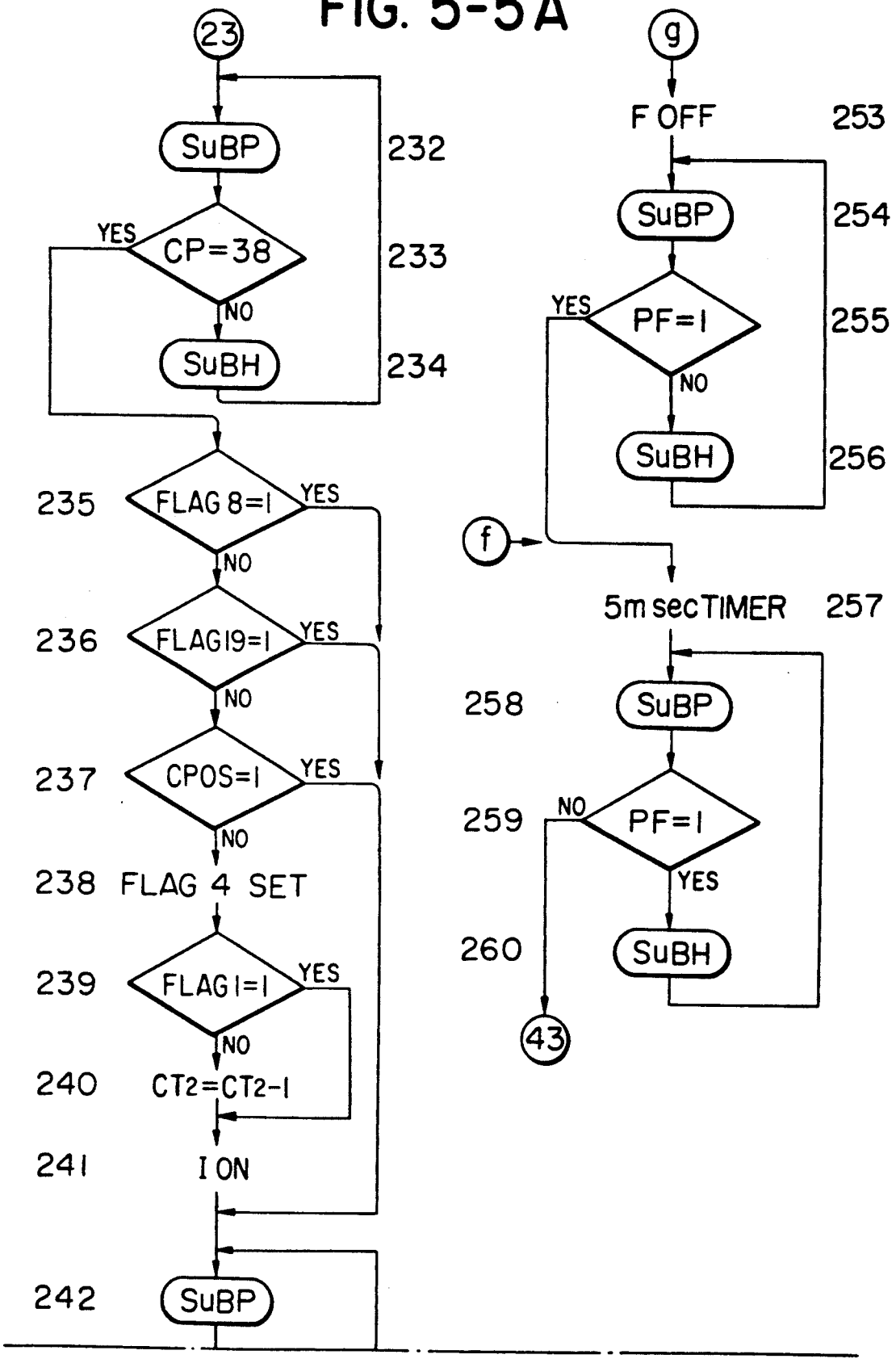
Figures 5, 6, 6B:
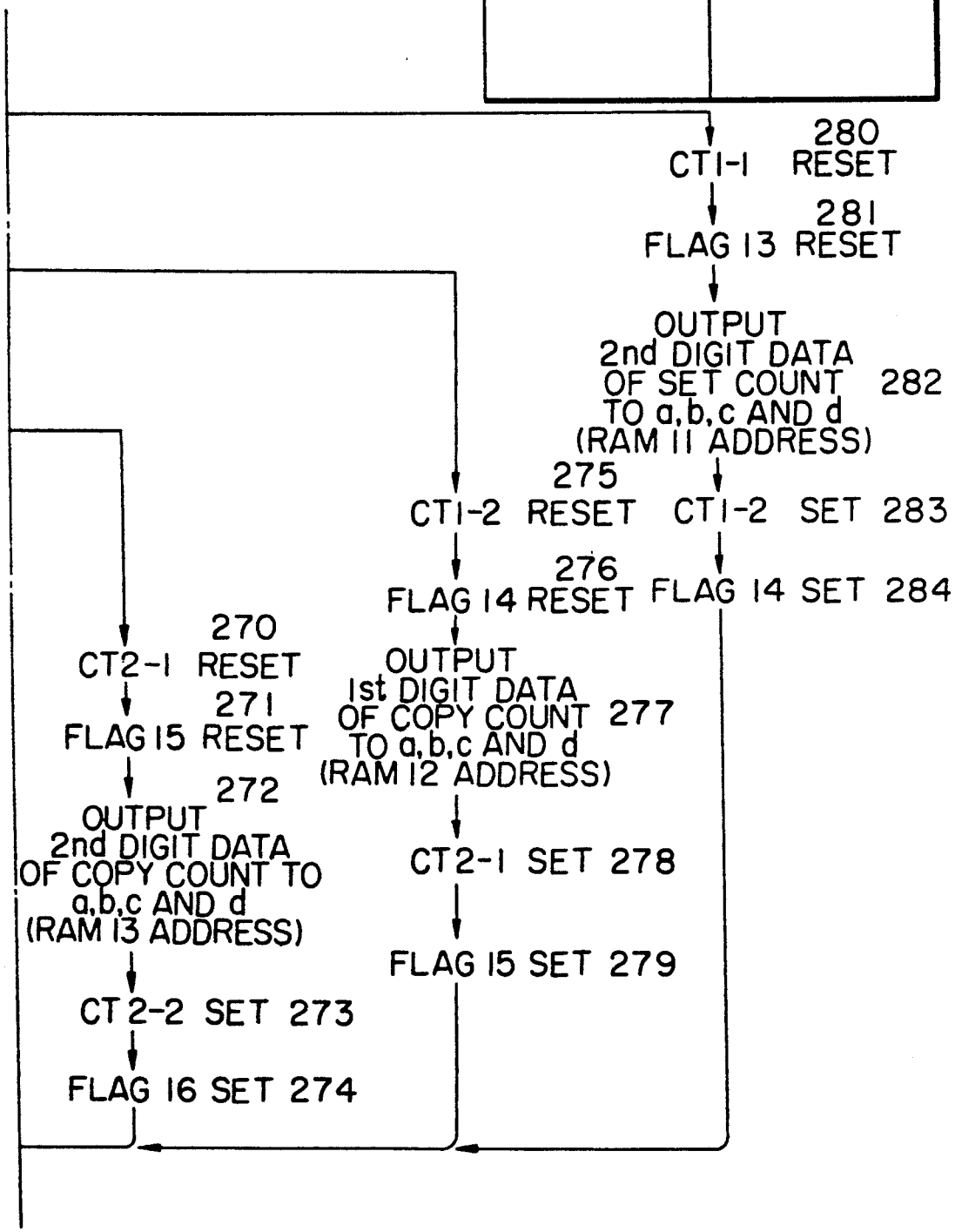
Figures 5, 6:
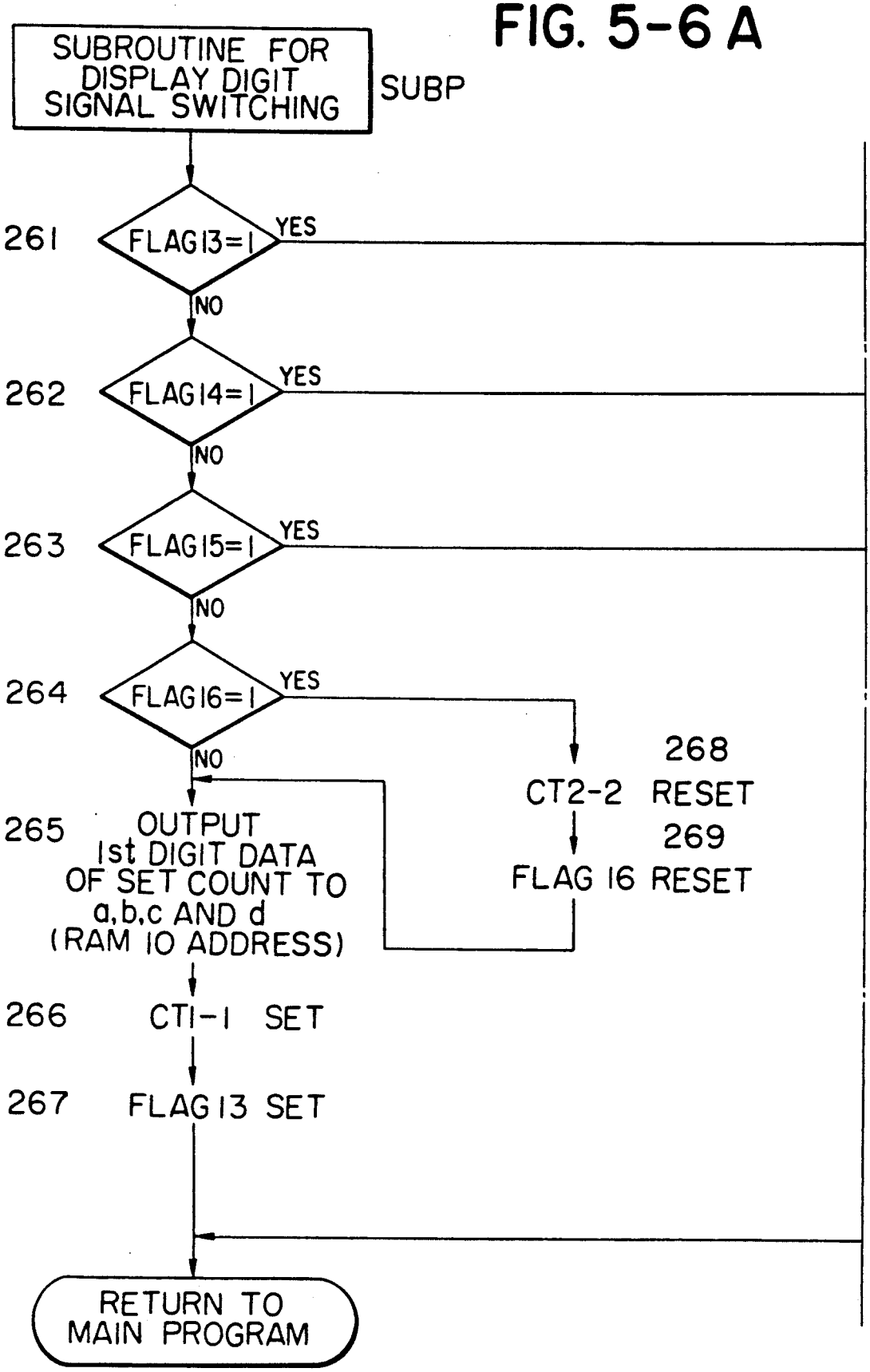
Figures 5, 6, 7, 7D:
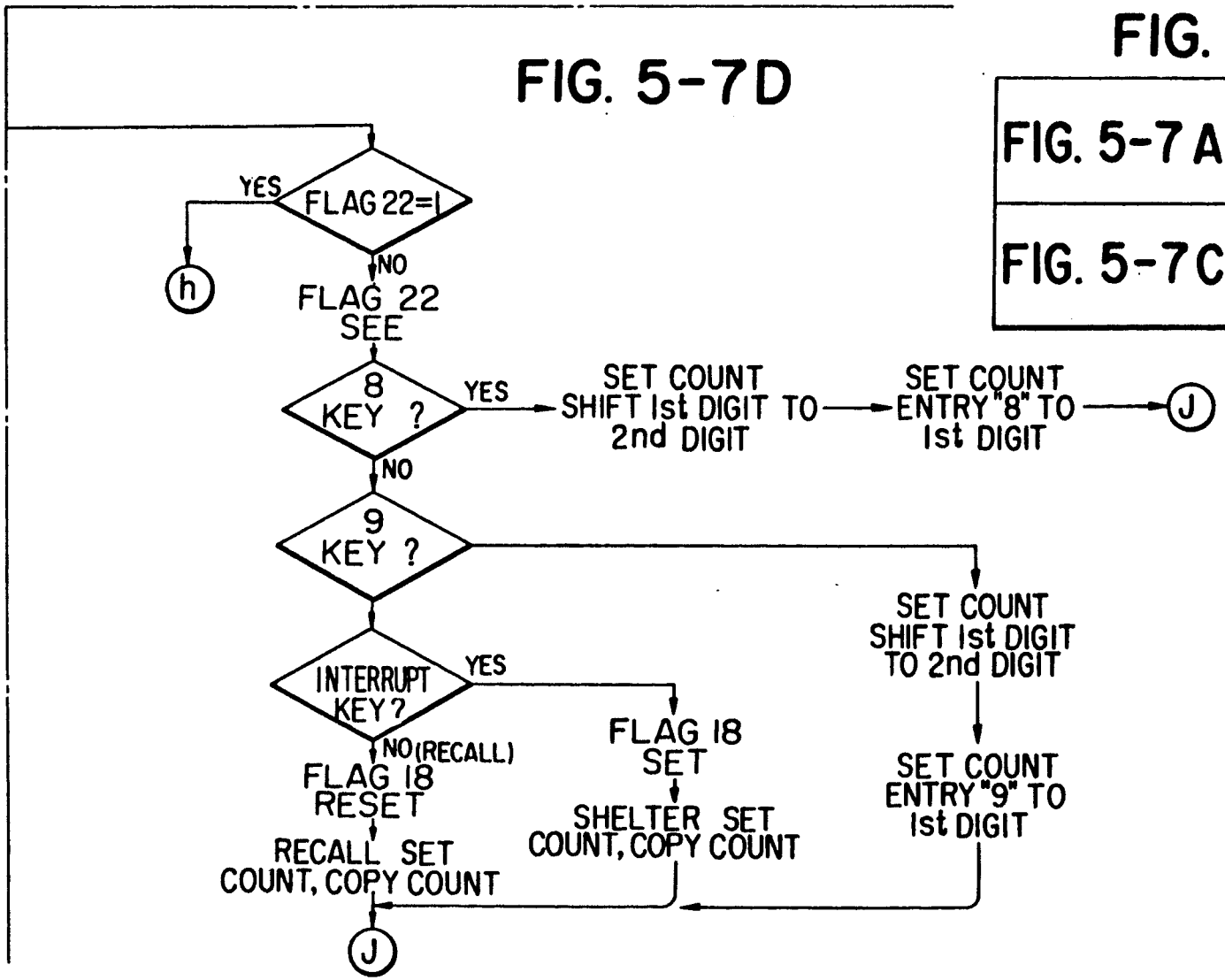
Figures 5, 6, 7, 7A:
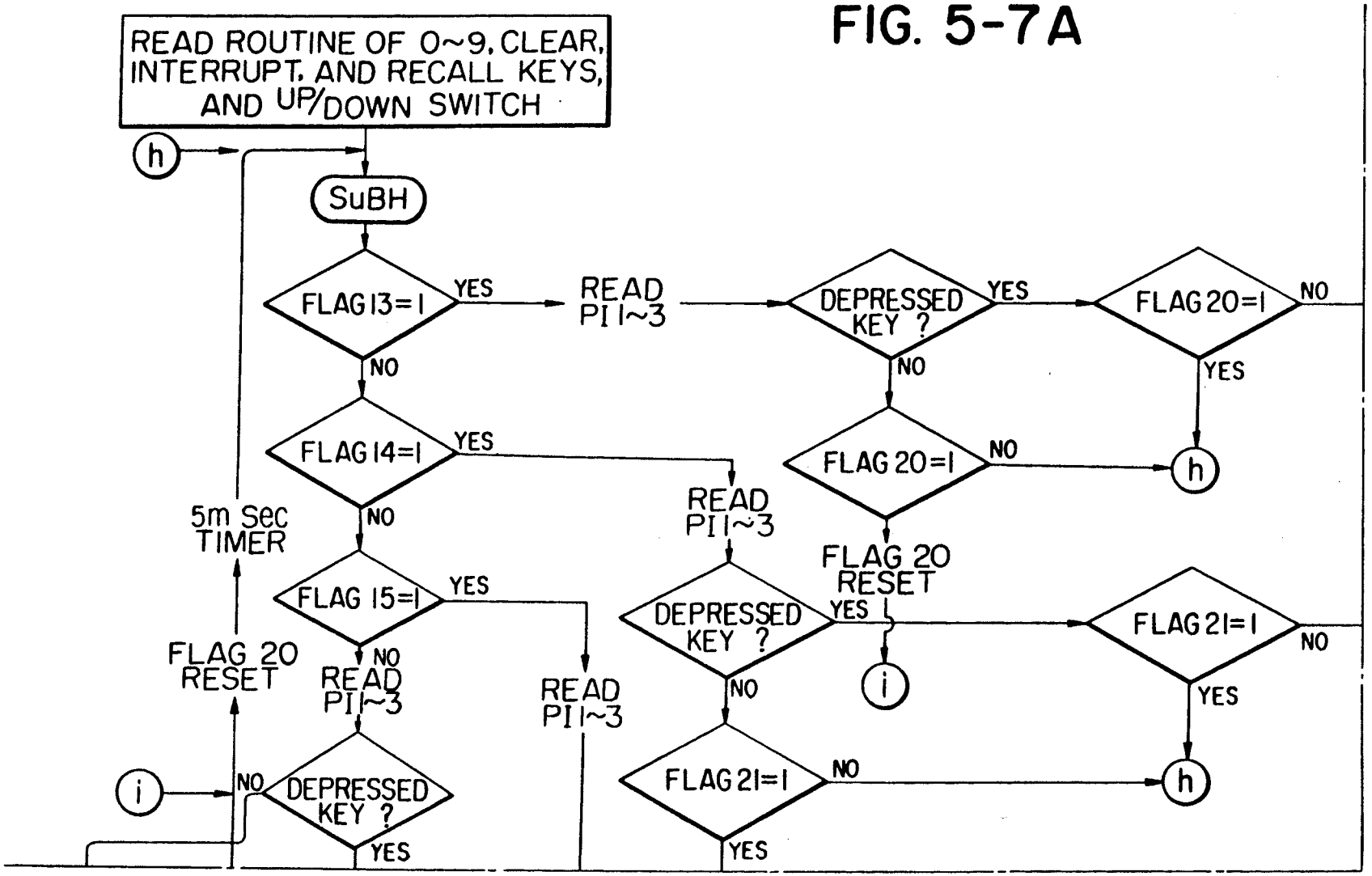
Figures 5, 6, 7, 7B:
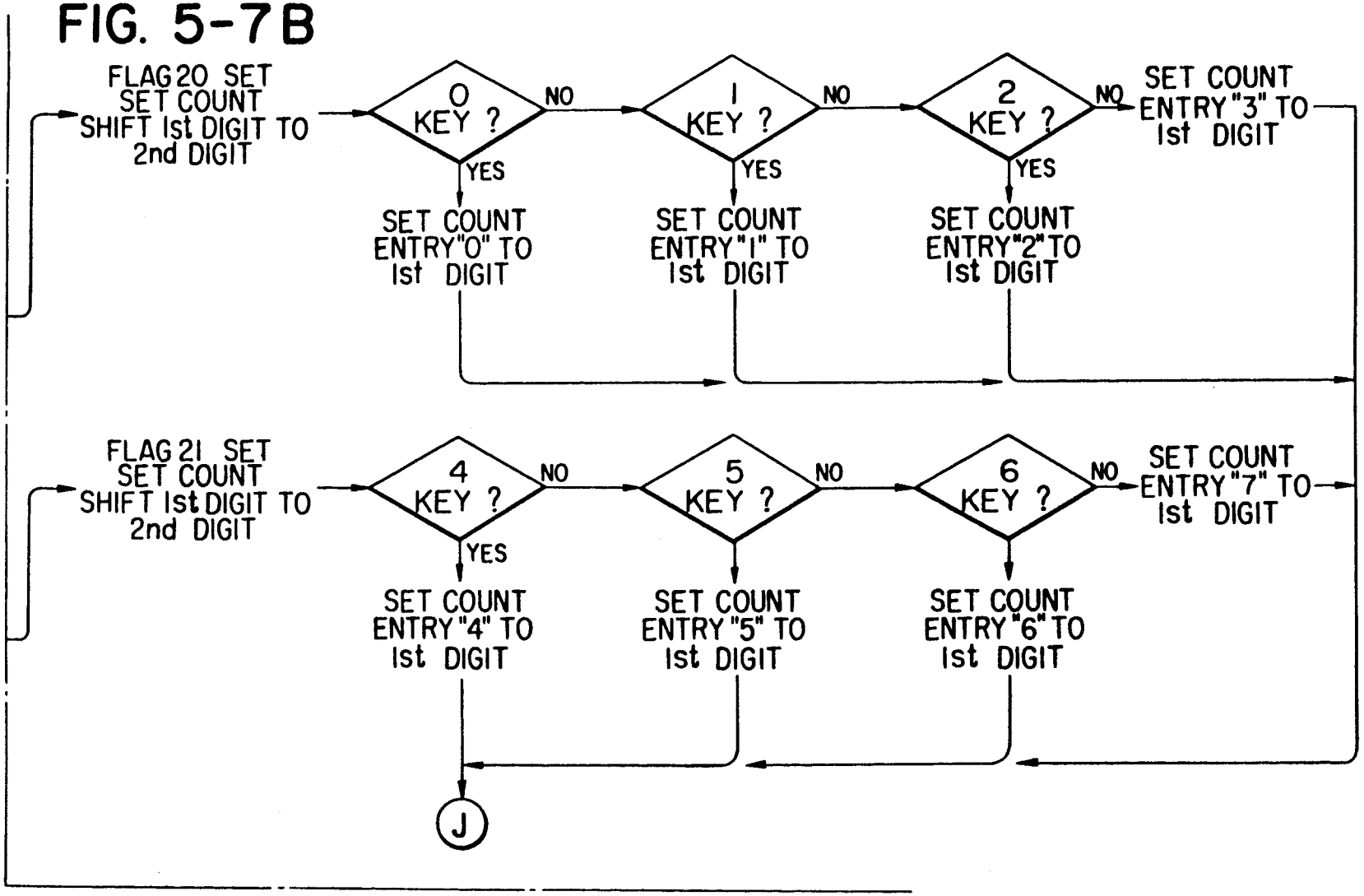
Figures 5, 6, 7, 7C:
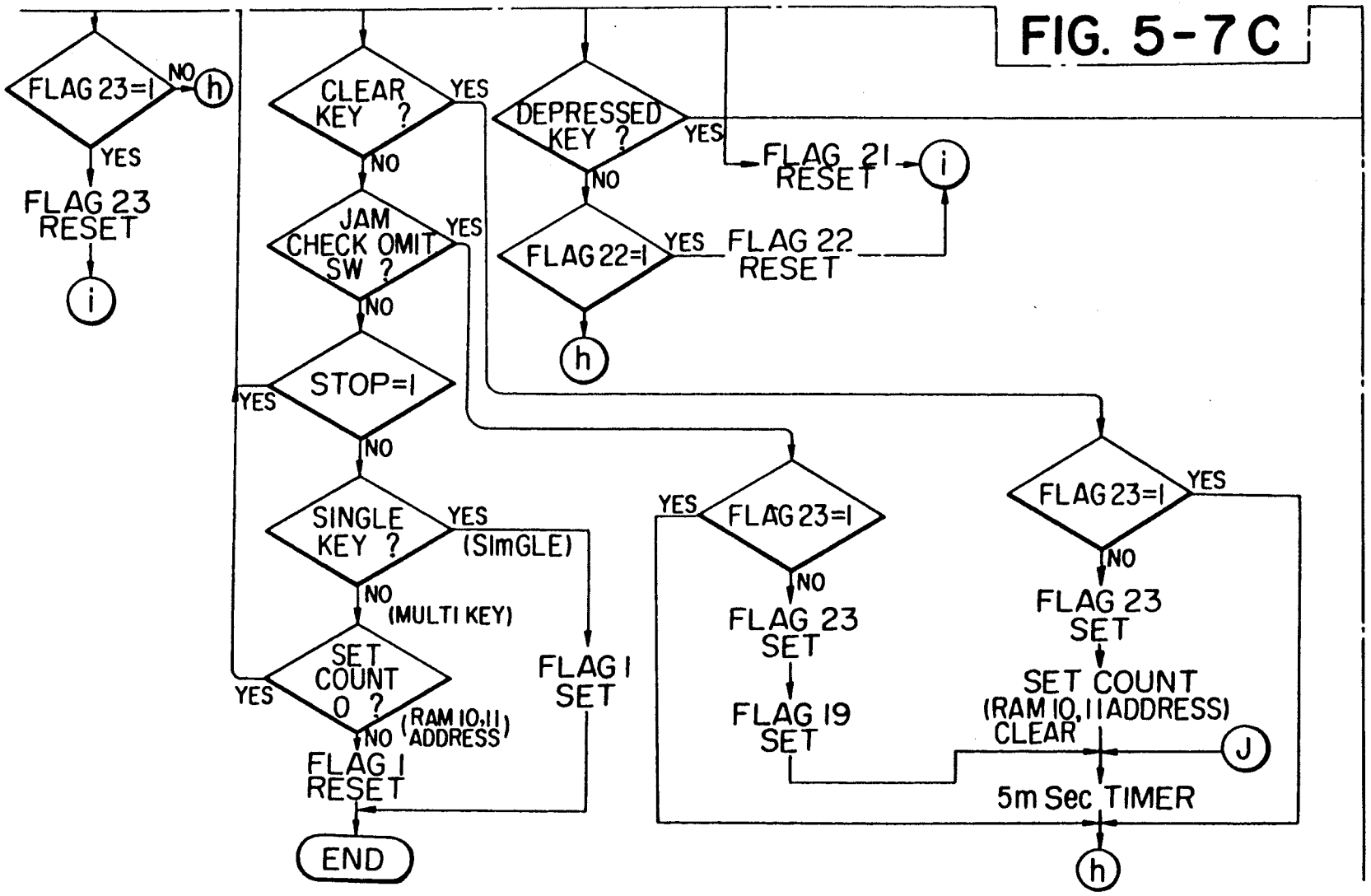

FIG. 5 shows a system flow chart which is stored in the read-only memory ROM in the one-chip microcomputer in order to execute the operations shown in FIGS. 3 and 4. The sequence program will be described step by step.

At 1, 2 and 3 after the power switch is closed so that all of the circuits are reset, one of the lamps indicating the size of the copying sheets to be used is turned on, and depending upon the depression of the UPPER CASSETTE or LOWER CASSETTE key the signal UL becomes "1" or "0" as described elsewhere.

The step 4 is a subroutine including the steps from 261 to 284 (See FIG. 5-6) for operating the copy and set counters. This subroutine SUBP is executed when the clock pulses are counted or the change in input signal is stayed. Therefore the counters are operated dynamically with a duty of approximately ¼ so that no flicker occurs in practice.

The steps 4, 5 and 6 are repeated when the optical system is not at its home or initial position when the power switch is closed so that the optical system may be returned to the home or initial position. At the step 7, the optical system is stopped when it reaches the OHP position. When the drum is not in its home or initial position, the steps 8, 9 and 10 are repeated to search for DHP. Upon detection of DHP, the steps 11, 12, 52 through 62 are executed. That is, at the steps 55 and 56 the drum is caused to make one rotation after the detection of DHP. The steps 58 and 59 are included in order to avoid chattering of the detection signal by the microswitch which detects DHP. The rotation of the drum is effected in order to attain the uniform potential distribution over the surface of the drum. That the drum is not stopped at DHP means that the drum has not been cleaned and discharged. This will be described in more detail with further reference to FIG. 8. When the optical system or the drum is not in its home or initial position, the set and copy counters 25 and 26 display only "00" and "00", respectively. The entry of digits with digit keys becomes possible only after the optical system has been returned to its home or initial position and the drum has also been returned to its home or initial position after one rotation. When both the optical system and the drum have been found to be in their home or initial positions when the power switch is closed, the steps 13, 14, 15 and 16 are executed after the steps 4, 5, 7, 8, 9 and 11.

FIG. 3 is the timing chart when two copies in half size are reproduced. The flow chart will be explained when the operator sets "2" in the set counter 25 and depresses the MULTI key. After the steps 13, 14, 15 and 18, a sequence routine following the step 19 is executed. The step 19 corresponds to the time point 1 in FIG. 3 at which the main motor, the blanking lamp and the primary transformer are energized. The steps 20 and 21 correspond to the time interval (2) in FIG. 3 during which 60 input clock pulses are counted. Furthermore during this interval, the subroutine SUBP is executed so that the set and copy counters 25 and 26 are turned on while the sequence control is effected.

At the step 22 the signal J is energized after 60 clock pulses have been counted, whereby the transformer tap point is selected. Therefore the AC corona discharge voltage rises. The steps 23 and 24 correspond to the time interval (3) in FIG. 3. This is a routine for waiting for the input of the copying sheet feed signal.

At the time point (5) in FIG. 3-2 the drum reaches the end of its first half rotation. When the copying machine is switched to the STOP mode prior to this time, the timing is as shown at (1) in FIG. 3-2. Therefore at the step 25 in FIG. 5-1 when the STOP is "1", the program jumps to the step 51 where the signals J and K are de-energized. The step 51 corresponds to the time point (5), the steps 52–56 correspond to the interval (6); the steps 57–59 correspond to the interval (7); the step 60 corresponds the time point (8); the step 61 corresponds to the time point (9); and the step 92 corresponds to the point (10). At the steps 60, 61 and 62 the lamp is turned off after the motor has been stopped in order to avoid the non-uniform discharge of the photosensitive surface due to the inertial of the drum.

When it is not in the STOP mode at the time point (5), the step 26 where the signal B is energized is executed. That is, the step 26 corresponds to the timing point (5); and the step 26 to the step 30 corresponds to the time interval (11) during which the detection of DHP is waited. The step 31 to the step 36 corresponds to the time interval (13) during which turning off of PH is waited. At the step 31 PF is read in synchronism with the clock signals CP for entering the number of set pulses into 67. That is, not only the state of PF is being detected but also the counting of the clock pulses is made at the step 34. The step 37 corresponds to the time point (14). In this case, the jam check for the second and succeeding copies consisting of the steps of 38–45 is executed. However, since the first copy is being reproduced, the flag 6 is not set at the step 38 so that the program jumps to the step 46. The steps 46–49 correspond to the interval (15) during which the counting of clock pulses up to 67 which was started at the time point (5) is waited.

At the step 50 which corresponds to the time point (16) in FIG. 3, 67 clock pulses have been counted. The developer plunger, the motor for driving forward the optical system and the exposure lamp are energized. The pre-exposure lamp is also turned on. In case of the HALF SIZE, the exposure lamp is turned on only during the copying cycle of the first copy and is turned off from the second copying cycle. Therefore at this time point, whether the copying sheet is in full size or in half size is detected at the step 65, and whether the first copy is in full size or in half size is detected in the step 63. Since the first copy is in half size, the program jumps from the step 63 to the step 66 and the signal G is energized. From the time point (16), the counting of clock pulses up to 87 is started. The routine for waiting for the turning off of OHP are steps 67–70 which correspond to the interval (21) in FIG. 3. The time point when OHP is turned off is (26) in FIG. 3 which corresponds to the step 71.

At this point, the jam check is executed in case of the HALF SIZE and MULTI copy mode. Since the first copy is being reproduced, the program jumps from the step 73 to the step 81 in response to the state of the flag 6. The jam check routine in case of the HALF SIZE copying mode are steps 72–80. In the steps 81 and 82 which correspond to the time interval (27) in FIG. 3 the counting of clock pulses to 87 is stayed. At the steps 84 and 85 which correspond to the time interval (29) in FIG. 3, 105 clock pulses are counted. At the steps 86–101 and the step 112, 105 clock pulses have been counted. These steps correspond to the time point (30) in FIG. 3 at which the movement of the optical system is reversed. At this point, as shown at the steps from 86 to 91, whether or not the selected cassette has been emptied, is detected. When the cassette has been emptied (Step 86), whether the AUTO button has been depressed or not is detected (Step 87) and furthermore whether or not the copying sheets in the same size are loaded or not must be detected (Step 88). After the step 89, the signal UL is activated or deactivated at the step 90 or 91. At the step 86, the STOP signal becomes "1" when the STOP key is depressed or when the cassette has been withdrawn from the machine in addition to the case when the cassette has been emptied. In this case, the UL signal is once changed, but at the step 101 whether the STOP signal is "1" or "0" is detected again. Thus, the signal UL is returned to the original state at the time when the program is returned again to the step 13 of KEY-READ-IN routine after the step 112.

Since the time point (30) in FIG. 3 is a point at which the movement of the optical system is reversed, the step 92 detects whether the copying sheet being used is in full size or in half size. When the copying sheet is in full size, the program jumps from the step 93 to the full size mode routine starting from the step 190 (See FIG. 5-4).

However, the copying sheet in half size is being reproduced now so that the program proceeds to the step 94. In the steps from 96 to 102 the count CT2 is incremented by 1 and is compared with the set number CT1. When CT1 and CT2 coincide with each other, the program jumps to the STOP mode following the step 112. CT1 and CT2 are stored in the memory words with the addresses 10, 11, 12 and 13 in the random access memory RAM.

In case of the STOP mode and when the jam occurs prior to the time point (30) in FIG. 3, the last half rotation routine starting from the step 112 is executed. Otherwise a routine from the step 103 to the step 111 is executed. That is, when the machine is set to the STOP mode from the time (30) when the movement of the optical system is reversed to the time when the signal PF is received (indicated by (3) in FIG. 3), the signal J is turned off (Step 106), and the program jumps to the last half rotation routine starting from the step 134 when 150 clock pulses have been counted. The steps are executed in the order of 103, 104, 105, 106, 107, 109, 103, 104 and 134. When the machine is not set to the STOP mode, the steps 103, 104, 105, 107, 109, 103, . . . are repeated until the signal PF is activated (the interval (16) in FIG. 3). When the signal PF is energized, the steps 103, 104, 105 and 108 are executed and the Flag 5 is set (indicating the start of the second copying cycle). Thereafter the program returns to the step 26 at which the feed roller signal B is energized. This corresponds to the time point (17) in FIG. 3. Thereafter the controls shown from (5) to (16) in FIG. 3 are cycled.

Next the routine for reversing the optical system (F) and the jam check routine both of which are involved in the copying cycles succeeding the second copying cycle will be described. The steps from 32 to 36 in the second copying cycle correspond to the time interval from the time when DHP is turned off to the time when the signal PF is also deactivated (the interval (20) in FIG. 3). When the optical system has been returned to its home or initial position OHP during this time interval, the signal F is de-energized by the steps 35 and 36. Since the drum motor is not synchronized with the motor for effecting the backward movement of the optical system, the time required for the optical system for returning to the home or initial position varies from one operation to another. Therefore the routine consisting of the steps 29 and 30 and the routine consisting of the steps 48 and 49 are inserted in the time interval (18) (corresponding to the steps 27–30) and in the time interval (22) (corresponding to the steps 46–49) in FIG. 3 in order to deactivating the signal F when the optical system has been returned to its home or initial position.

The jam check of the first copy is effected by the detection whether or not the first copy arrives at the detector 2 (COPS="1" when arrived) when the signal OHP is turned off as the optical system is advanced (E on) in the second copying cycle. That is, the detection is made at the time point (25) in FIG. 3. This is checked by the routine from the step 72 to the step 80 in FIG. 5-2. When the first copy fails to arrive at the detector, the steps are executed in the order of 72-73-74-75-76-77-78-79-80 so that the flag 4 is set. That is, the fact that the copy has been jammed is stored. At the same time, the copy counter or the signal CT2 is decremented by 1, and the jam solenoid signal is energized so that the jam switch is closed, whereby the high voltage sources are turned off.

When the jam check omit switch is closed and this instruction has been read in the key entry routine 13, the steps 77–80 are not executed in response to the state "1" of the flag 19 detected in the step 75. This means that the machine may be test run without the feed of the copying sheet. The activated signal I is turned off at the step 83 (corresponding to (32) in FIG. 3).

In FIG. 3 there is only shown the timing for reproducing two copies. When more than two copies are obtained, the jam check of the first copy is effected when the signal PF is de-energized in the third copying cycle as shown in the steps from 38 to 45. That is, when the first copy is jammed, the steps are executed in the order of 38, 39, 40, 42–43 and 45 and then the main program jumps to the last half rotation routine starting from the step 135. When the flag 18 is set so that the jam is stored in case of the HALF SIZE copy mode, the third copying cycle has been already started so that the copying counting signal CT2 is decremented by 2. However when no jamming occurs (that is, when CPOS="0"), the steps are executed in the order of 38, 39 and 41 so that the signal TC for incrementing the total counter by 1 is generated. The signal TC is deactivated at the step 50.

Assume that at the time point (25) in FIG. 3-2 the jam check has been completed and that the optical system has reached the point (34) at which the optical system is to be reversed in movement in the second copying cycle. Then the signal CT2 which has been incremented by 1 in the step 99 coincides with the signal CT1 at the step 102 so that the flag 3 is set. That is, the coincidence between the signal CT1 and the signal CT2 is stored. Thereafter the last half rotation routine starting from the step 112 is executed. The steps from 113 to 133 correspond to the interval (35) in FIG. 3. during which 150 clock pulses are counted. At the same time, the program waits for the optical system returning to its home or initial position (OHP). When the optical system has been returned to its initial or home position, the signal F is deactivated (in the steps 115 and 116) and at the same time the subroutine SUBI consisting of the steps from 117 to 126 is started in order to check if the first copy is jammed or not, and the flag 11 is set. Once the flag 11 is set, the jam check routine consisting of the steps from 118 to 125 is omitted by the step 117 even when the optical system is in its home or initial position. This time corresponds to the time point (36) in FIG. 3. That is, the jam check is made during the last half rotation only when the optical system has been returned to its home or initial position. Since the jam check omit switch is not closed, when the first copy is jammed, the steps are executed in the order of 117, 118, 119, 120, 121, 123, 124, 125 and 126, and the flag 8 is set so that the jamming is stored and the copy counting signal CT2 is decremented by 2. The jam solenoid signal I is also energized (See (4) in FIG. 3). Since the flag 11 has been set, the program jumps to the routine consisting of the steps from 117 to 127.

When no jamming is occurring when the optical system has been returned to the initial or home position, the steps are executed in the order of 117, 118, 119, 120, 122 and 126, and the total counter signal TC is activated. Until 150 clock pulses have been counted, the start key input routine consisting of the steps from 127 to 133 is always executed. Only when the last half rotation routine is started as a result of the coincidence between the signals CT1 and CT2 or only when the last half rotation routine is started in the SINGLE mode, the entry of the input by the depression of the MULTI or SINGLE key is permitted from the time point (34) in FIG. 3-2. That is, when the MULTI key is depressed, the steps 127, 128, 129, 130 and 133 are executed. When the SINGLE key is depressed, the steps are executed in the order of 127, 128, 129, 131, 132 and 133. Therefore upon depression of the MULTI key, flag 9 is set to "0" while flag 7 is set to "1". Upon depression of the SINGLE key, flag 9 is set to "1" and flag 7 is also set to "1". As described elsewhere, flag 9 indicates the MULTI or SINGLE mode while flag 7 which is in the state "1" indicates that the RE-START instruction has been received during the last half rotation mode.

150 clock pulses have been counted at the step 134 which corresponds to the time point (38) in FIG. 3. The steps 135, 136 and 137 are provided in order to safeguard the copying operation which is otherwise adversely affected due to the variation in timing of the optical system returning to its home or initial position.

The steps 138–140 correspond to the time interval (40) in FIG. 3-3 during which the clock pulses are counted from the time point (38) up to 38. When 38 clock pulses have been counted at the time point (41) in the FIG. 3-3, the signal I or TC which has been energized as the result of the jam check at the time point (36) is de-energized (at the step 141). Also the jam check of the last copy is carried out as shown in the steps from 142 to 149. That is, when no jamming has occurred prior to this time point and when the jam check omit switch has not been closed, the jam check is started.

When the last copy is jammed, the signal I is activated so that the flag 4 is set and the copy counter is decremented by 1. However, it should be noted that in case of the SINGLE mode no decrement occurs (See Step 147).

The steps 150, 151 and 152 which correspond to the time interval (42) in FIG. 33 counts 60 clock pulses. When 60 clock pulses have been counted at the time point 153, the signal I which has been energized is de-energized at the point (43) in FIG. 3-3. From the step 154 to the step 156 the program waits for the return of the drum to its home or initial position during the time interval (44) in FIG. 3-3. The subroutine SUBH consisting of the steps 140, 152 and 156 is provided in order to permit the entry of the input with the MULTI or SINGLE key during the time interval between (34) and (45) in FIG. 3-3. When the optical system has returned to its home or initial position OHP (the time point (45) in FIG. 3-3), the motor signal A is turned off at the step 157. The step 158 corresponds to the time interval (46) while the step 159 corresponds to the time interval (a). If the delay or jamming of the copy has been occurred prior to this time, the program jumps from the step 160 or 161 to the jam removing routine starting from the step 182. When no delay or jamming has been occurred and there is no jam check omit instruction (See Step 162), the jam check of the last copy is carried out. If no jamming is detected, the signal TC is turned on and off in the steps 164, 165 and 166. When the signals CT1 and CT2 conincide with each other so that the STOP mode is entered, the copy counter is cleared at the steps 167 and 168. When the MULTI or SINGLE key has not been depressed during the last half rotation mode, the steps from 169 to 175 are executed and the program is returned to the keying routine starting from the step 13. When the MULTI key has been depressed, the steps 169, 170 and 171 are executed and whether or not the set counter displays "0" is detected at the step 173. If "0", the program returns to the keying routine starting from 13 after the step 175 has been executed. That is, the machine will not respond to the depression of the MULTI key during the last half rotation mode. If not "0", the steps 173 and 174 are executed and the program jumps again to the step 19, whereby another copying cycle is started. When the SINGLE key has been depressed, the steps 171, 170, 172 and 174 are executed and the program jumps again to the step 19 so that the copying cycle in the SINGLE mode is started. When the jam is detected, the signal I is activated and the copy counter is decremented by 1 (See Steps 163, 176, 177, 178, 179, 180 and 181). However, in the SINGLE mode, the copy counter will not be decremented by 1.

The jam release routine consists of the steps from 182 to 189. The steps 182 to 184 wait for the turning on of a reset button for releasing or turning off the jam switch which has been closed by a jam mechanism (See FIG. 9-2) which in turn has been latched by the signal I. When the jam switch is turned off, the steps starting from the step 185 are executed. That is, the program waits for the re-depression of the MULTI key when the MULTI key had been depressed before the copying cycle was started. In like manner, the program waits the re-depression of the SINGLE key when this key had been depressed before the copying cycle was started. Thus when the MULTI key is depressed again, the steps 185, 186, 187 and 188 are executed and then the program jumps to the step 19 so that only the remaining copies are reproduced. Any combination of the steps except the above combination will not be accepted at all.

Next the FULL SIZE copying mode will be described with reference to FIGS. 4 and FIGS. 5-4 and 5-5. The operations starting from 1 and ending at (30) in FIG. 4-2 are substantially similar to those shown in FIG. 3 so that no explanation shall be needed. The FULL SIZE copying mode is different from the HALF SIZE copying mode from the time point (30) where the optical system is reversed in the HALF SIZE mode. This time point (30) corresponds to the steps 86–92. The size is detected in the step 92, and the program jumps from the step 93 to the routine starting from 190. The routine consisting of the steps 190 and 191 causes the optical system to advance further beyond the returning point in case of the HALF SIZE mode and waits until 150 clock pulses have been counted. The steps 190 and 191 therefore correspond to the time interval (d) in FIG. 4-2. When 150 clock pulses have been counted, the optical system is reversed at the time point (e) in FIG. 4 which corresponds to the steps from 192 to 198. At the returning point or the step 192, the signals E and G are deactivated while the signals F and L are activated. When the MULTI mode is detected in the step 193 and no jamming is detected by the steps 194 and 195, the copy counter 26 is incremented by 1 in the step 196. When the copy counter 26 or the signal CT2 coincides with the set counter 25 or the signal CT1 at the step 197, the steps 199–231 are executed and the step 232 is reached. When they do not coincide with each other in the STOP mode, the steps 199–231 are also executed and the program reaches the step 232. When they do not coincide with each other in any of the mode except the STOP mode the program jumps from the step 231 to the step 200. That is, the program has two alternations at the time point (30) for proceeding to the step 200 or the step 231.

First the flow after the step 231 will be described when the SINGLE mode is detected at the step 193, the jamming has detected at the steps 194 and 195, the coincidence between the signals CT1 and CT2 is detected at the steps 197 and 199 or the coincidence is not detected but the STOP mode is detected in the steps 197 and 198. That is, the time point (e) in FIG. 4 may be considered to have been shifted to the time point (n) in FIG. 4. Since the copy counter 26 displays "1", it may be considered that only in the STOP mode the time point (e) is shifted to the time point (n) and the following sequence is executed.

Since the first copy is being reproduced, the sequence after the step 200 after the copy counter has been incremented by 1 will be described. The steps 200 and 201 correspond to the interval (f) in FIG. 4-2, and 38 clock pulses have been counted at the time point (g) at which the jam check is started as indicated by the steps 202–208. This jam check is executed even when the jam check omit switch is opened as shown at the step 203. When the copy is delayed or jammed, the flag 4 is set; the solenoid signal I is energized; the copy counter is decremented by 1; and the signal J is de-energized. These timings are shown in FIG. 4-2. The decrement of the copy counting signal CT2 is not made when the SINGLE mode is detected at the step 206. The steps 209 and 210 count 112 clock pulses and correspond to the interval (h) in FIG. 4. When 112 clock pulses have been counted at the time point (i), the signal I which has been energized from the time point (g) is de-energized. At the time point (g) whether or not the jamming has occurred is detected by the step 212.

When jamming is detected in the step 212 (flag is set to "1"), the steps starting from the step 213 are executed with the timing shown at (2) in FIG. 4. At the time point (i) or the step 214 the signal K is deactivated, and the program waits for the optical system returning to its initial or home position (OHP) in the steps 214 and 215. This interval corresponds to the time interval (7') in FIG. 4. When the optical system has returned to the home or initial position OHP at (8'), the signal F is turned off. When the drum reaches its home or initial position in the steps 216, 217 and 218 (which correspond to the time interval (9') in FIG. 4), the steps 220 and 221 wait for the signal DHP being turned off (during the time interval (11') in FIG. 4). When the drum home position signal DHP is turned off, the program jumps to the step 154. The program waits for the drum returning to its home or initial position again and then stops the copying operation.

When no jamming is detected at the step 212, the steps 223 and 224 which correspond to the time interval (j) in FIG. 4 waits for the optical system returning to its home or initial position OHP. When the optical system has been returned to its home or initial position, the signal F is turned off (at the time point (k) in FIG. 4), and the steps 226 and 227 wait for the arrival of the signal PF (at the time interval (1) in FIG. 4). The signal PF arrives at the time point (17) in FIG. 4. When the machine is in the STOP mode at this time point or the step 228, the program proceeds to the step 229 where the signal J and K are deactivated. The steps 257 to 260 wait for the de-energization of the signal PF. Upon detection of the signal DHP after a further rotation of the drum, the copying operation is stopped.

When the STOP mode is not detected, the flags 5 and 6 are set at the step 230 and the program jumps to the step 26 for starting the second copying cycle. Therefore the timings from (17) in FIG. 4-3 to (32) are similar to those from (17) to (32) in FIG. 3. However, jam check is executed for the first copy at the time point (21) in the second copying cycle as indicated by the steps 38–45.

When the copy is jammed, the program jumps to the step 217 after the steps 38, 39, 40, 42, 43 and 44 have been executed. First the signals J and K are de-energized, secondly, the flag 8 is set, and thirdly, the copy counter is decremented by 1. After the program jumps to the step 217, the drum is kept rotated until the signal DHP is detected, and upon detection the copying cycle is stopped.

In the second copying cycle, the operations from the time point (17) to the time point (34) are similar to those for the HALF SIZE mode. That is, the copying processes are different from the time point (34) or the step 92. The time interval (m) shown in FIG. 4 corresponds to the steps 190, 191 and 192. At the time point (n), the optical system is reversed and the signal CT2=CT1 is detected at the step 197 so that the signal J is turned off, thereby causing the AC charging to be decreased. Thereafter the program jumps to the step 232 for the execution of the last half rotation routine.

The steps 232, 233 and 234 which correspond to the time interval (o) in FIG. 4 are provided for counting 38 clock pulses. When 38 clock pulses have been counted at the time point (p) in FIG. 4, the jam check for the last copy is executed as shown at the steps 235–241. That is, when the step 235 detects that no jamming has occurred and when the step 236 detects that the jam check omit switch has not been closed, the jam check is executed. However when the jamming has been detected, the jam solenoid signal I is activated and the copy counter is decremented by 1 at the step 240. In the case of the SINGLE mode, the copy counter is not decremented.

The steps 242, 243 and 244 correspond to the time interval (r) in FIG. 4 for counting 60 clock pulses. When 60 clock pulses have been counted at the time point (s) in FIG. 4, the signal I which has been energized from the step 241 is de-energized. When 52 clock pulses have been counted in the steps 246, 247 and 248 at the time point (t) in FIG. 4, the step 249 turns off the bias K at the time point (u) in FIG. 4.

During the steps 250, 251 and 252, the program waits for the optical system returning to its home or initial position OHP (The steps 250–252 correspond to the time interval (w) in FIG. 4), and the signal F is deactivated at the time point (x) in FIG. 4 which corresponds at the step 253. Thereafter the program waits for the feed cam signal PF being turned on during the steps from 254 to 256 (which correspond to the time interval (y) in FIG. 4). When this signal PF has been turned on, the program waits for this signal PF being turned off during the steps 258–260. After the signal PF has been turned off and the drum has made another rotation and returned to its home or initial position (See Steps 154–156 and (41) in FIG. 4), the copying cycle is stopped.

The subroutine SUBH consisting of the steps 234, 244, 248, 252, 256 and 260 is included so that after the time point (n) the entry of the input with the MULTI or the SINGLE key may be permitted.

The key entering routine shown in FIG. 5-7 is apparent to those skilled in the art, so that no explanation shall be made in this specification.

An interruption copy operation, before copy start, is carried out by key operation of INTERRUPT key, NUMERAL key and START key in sequence, the interruption key operation, after copy start, is carried out by key operation of STOP key, INTERRUPT key, NUMERAL key and START key.

The INTERRUPT key may be substantially similar in function to the STOP key. That is, upon depression of the INTERRUPT key, the machine is set to the last half operation mode. In other words, upon depression of the INTERRUPT key, the flip-flop 617 (See FIG. 6-4) is set, and an interrupt input is held, until it is read into CPU. When the interrupt copy is carried out, the contents in the set and displays 25 and 26 are moved into the pair of registers in the random access memory RAM, and a number of copies desired may be set into the set display 25. Thereafter the program is executed from the key entry routine. When the RECALL key is depressed after the copying operation has been completed so that the machine has been set to the last half rotation mode, the contents in the registers are transferred into the memory words with the addresses 10–14 in the random access memory RAM and then into the set and displays 25 and 26. Thereafter upon depression of the MULTI key, the remaining copies may be reproduced.

Alternatively, the main program may include such instructions that in the last half rotation mode or when the machine is stopped after the depression of the INTERRUPT key, the contents in the set and displays 25 and 26 may be automatically returned to the predetermined memory areas in the RAM so that they may be displayed by the displays 25 and 26. Also this may be manually done by STOP key operation.

FIG. 6-7 shows the circuit diagram, whereby upon depression of INTERRUPT key, the machine is shifted into the INTERRUPT mode and upon stopping of the motor (A "0") the RECALL is effected.

Figures 1B, 6:
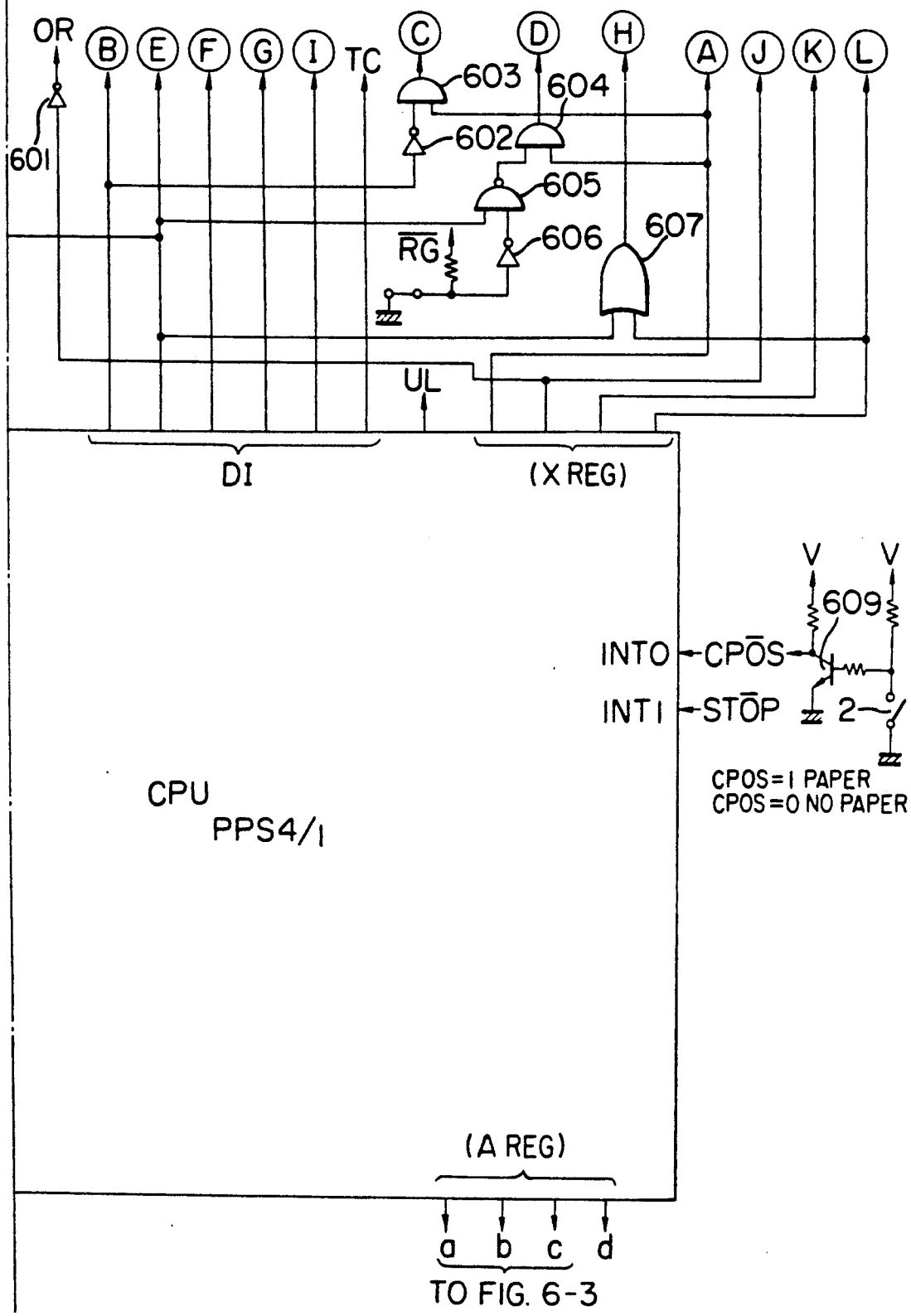
Figures 2, 6:
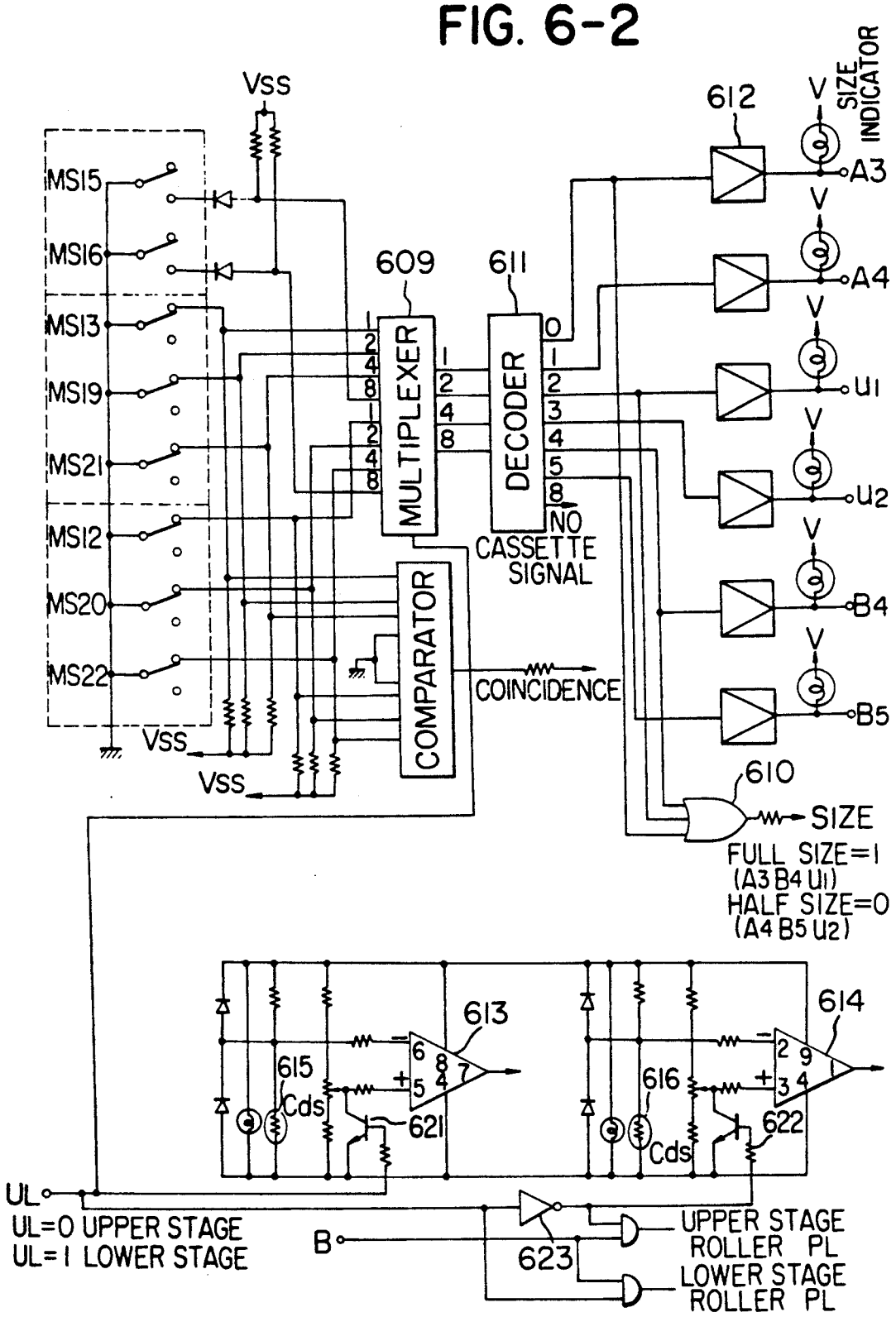
Figures 3, 6:
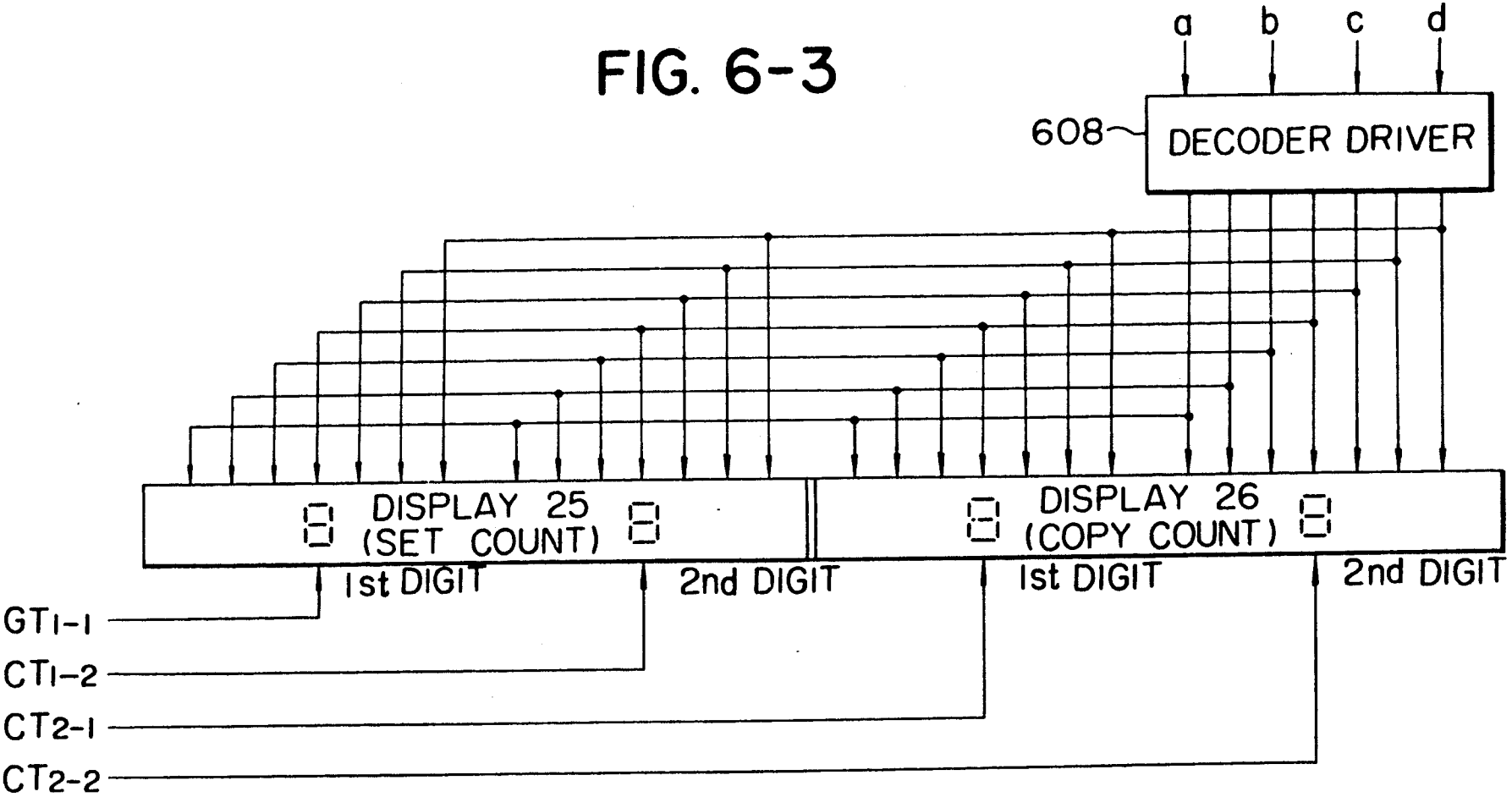
Figures 6, 7, 8:
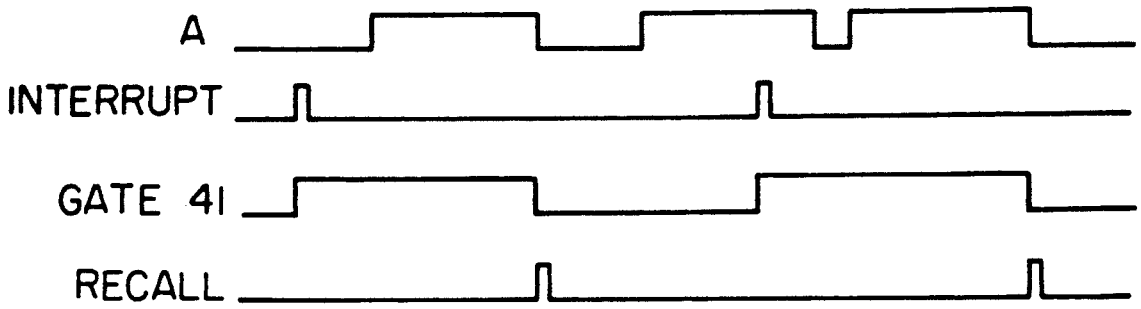
Figure 8:
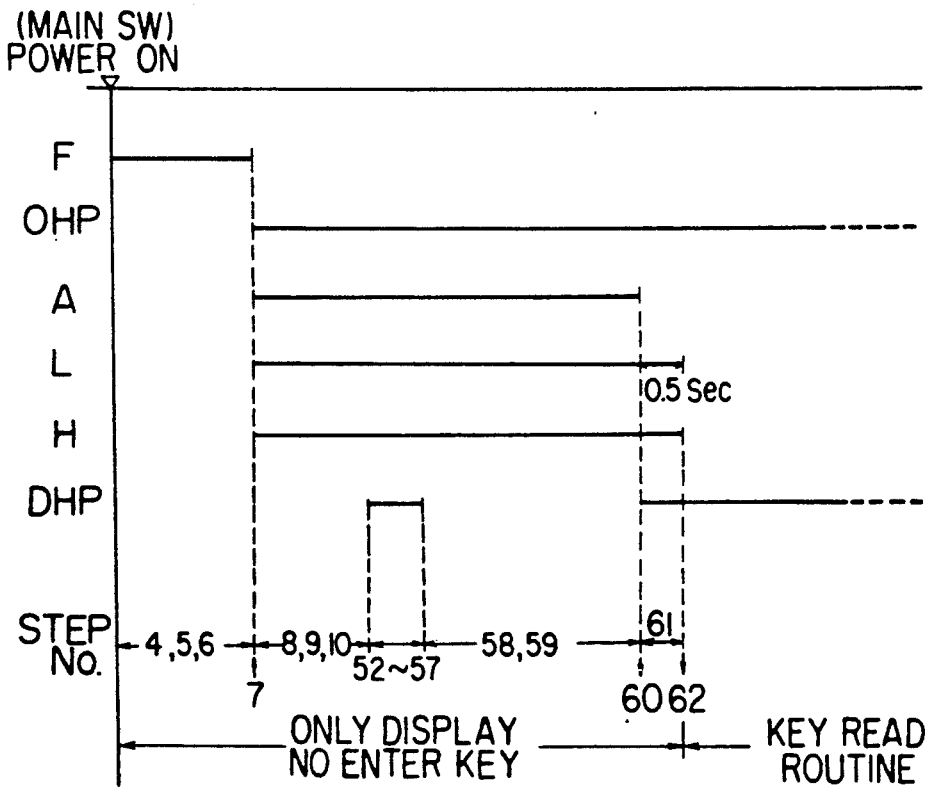
Figures 7, 7B:
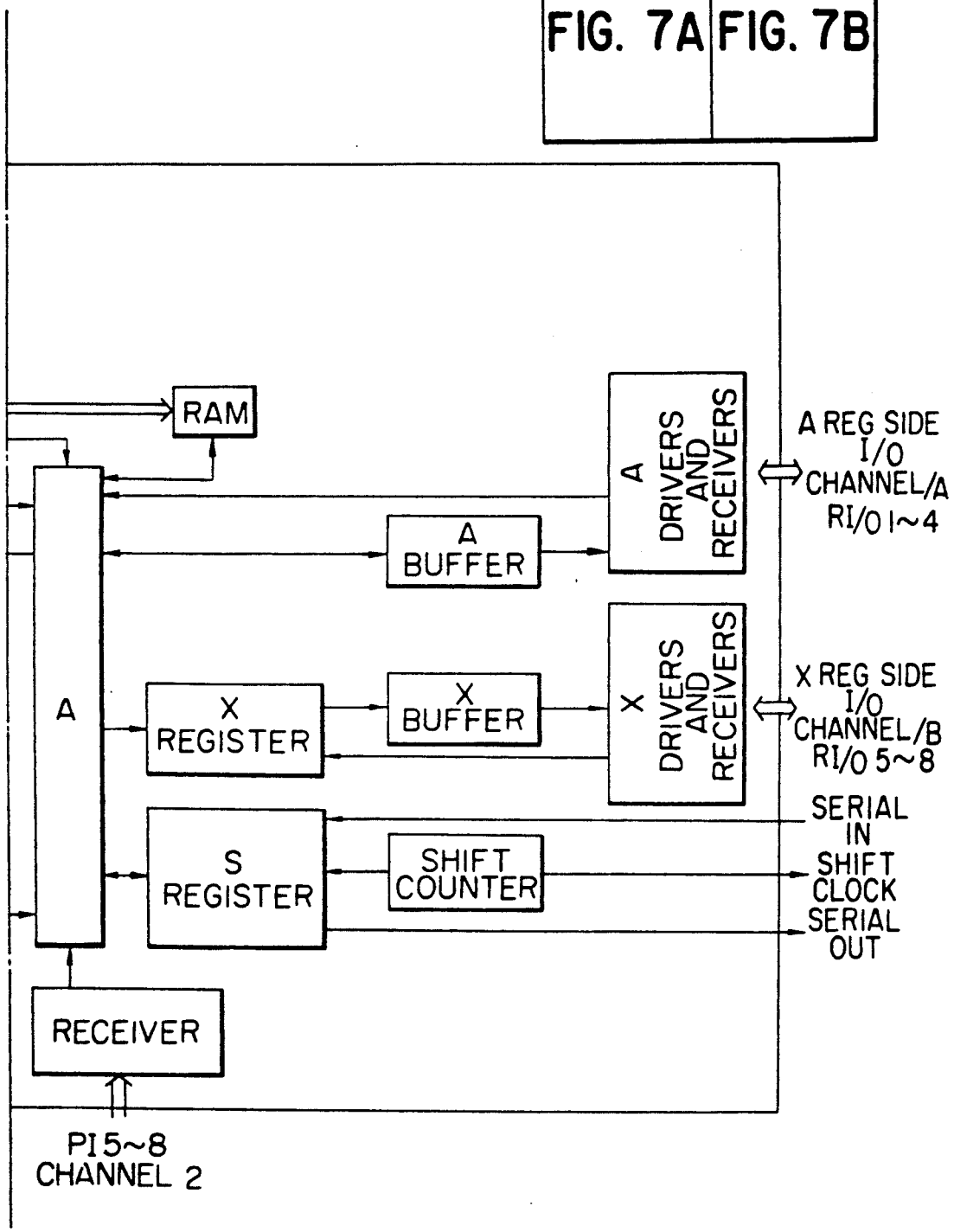
FIG. 7 including segment A and B is a block diagram of a one-chip microcomputer used in the control system.
Figure 7A:
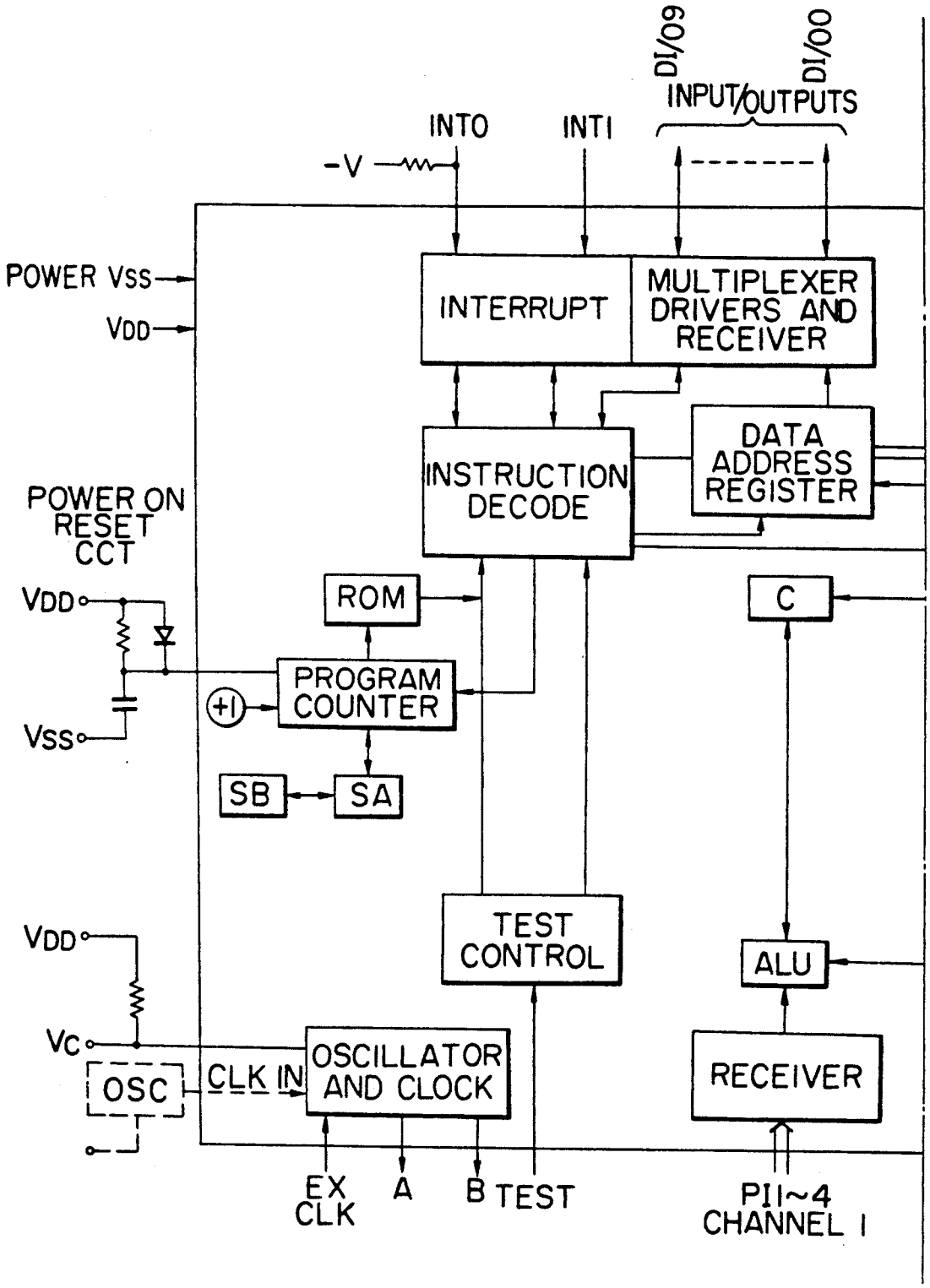

In FIG. 6-8, capacitors 48 and 51 generate a pulse at the leading and trailing edges of the signal A, respectively while capacitor 49 generates a pulse at the trailing edge of the signal pulse A after the interrupt copy. Flip-Flop comprising Gates 41 and 42 is set by INTERRUPT key. If this set time is before copy start, immediate interrupt copy is permitted, and if this set time is during copy period, the interrupt copy is permitted after the copy is finished. STOP key operation serves to inhibit the interrupt copy operation, and after that, effects RECALL. None of the keep except STOP key effects RECALL. The outputs of PI3 and PI4 are turned off after 1 second. CASSETTE MODE may be sheltered by INTERRUPT key operation.

Figures 1, 9:
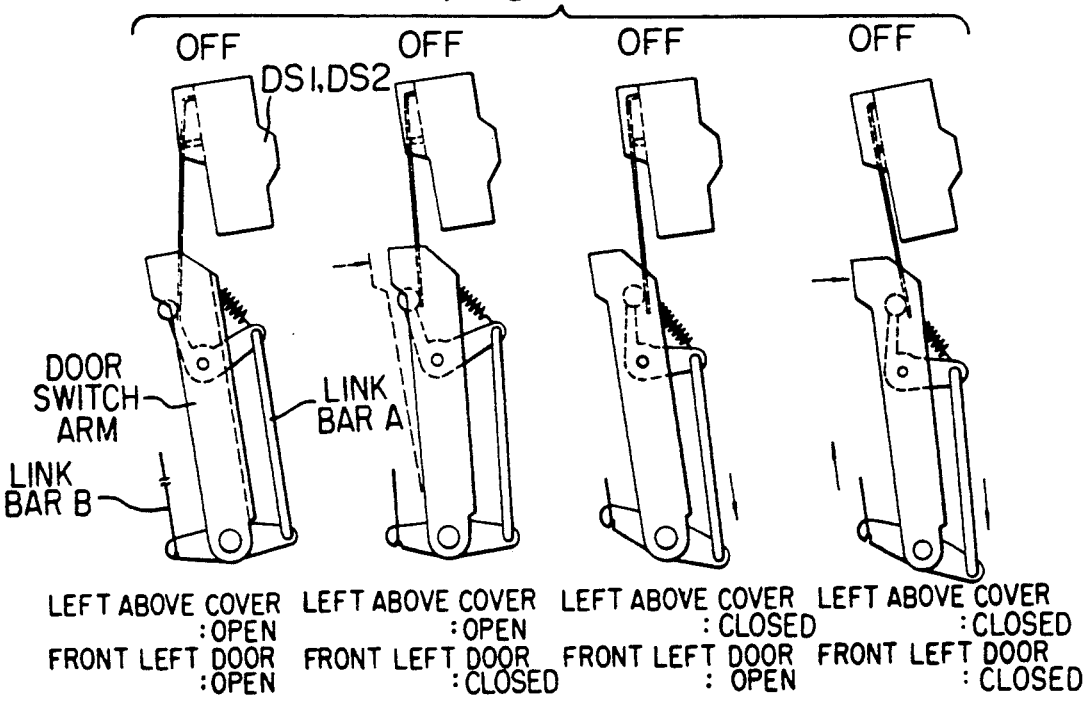
Figures 2, 9:
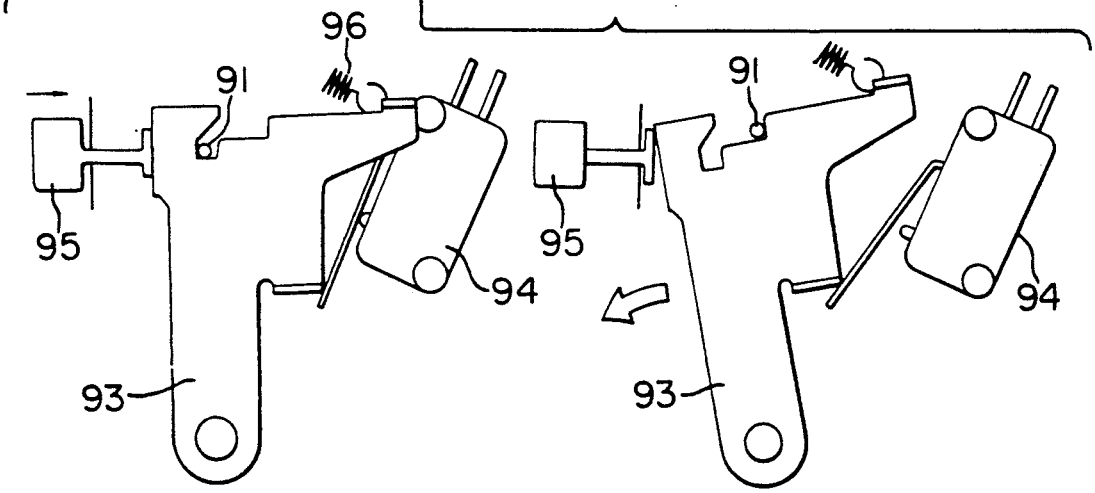
Figures 3, 9:
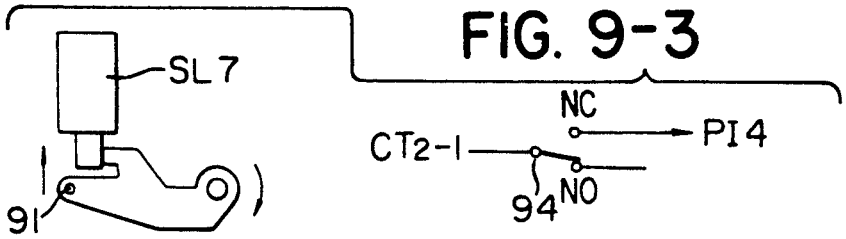

FIG. 9 shows the jam release mechanism. That is, FIG. 9-1 shows door switches DS which turn on and off the power source when a cover and a door are closed and opened, whereby the safety of the operator may be ensured when he or she removes the jammed copy from the machine. FIG. 9-2 shows a mechanism which turns off the power source of the fixing device and the DC high voltage sources when the jam solenoid is energized. When jamming occurs, the solenoid SL is energized so that a lever 92 having a projection 91 is lifted and consequently a release lever 93 which has been stopped by the projection 91 is swung under the force of the spring 96 about its pivot pin, whereby a microswitch 94 is opened. As a result, the machine is stopped. After removing the jammed copy, the operator pushes a reset switch 95 which in turns pushes the lever 93 to its operative position shown at the left in FIG. 9-2. The main motor is however kept energized until the copy would have been discharged unless it had not been jammed.

The switch 93 is connected as shown in FIG. 9-3.

Table 1 shows a list of program codes based on the manual of PPS-4/1 for executing the operations shown in FIGS. 5-1 to 5-7.

TABLE 1

| Program Step | | |
|---|---|---|
| (SOURCE STATEMENT) | | |
| | ORG | X'000 |
| LBHO | LAI | 2 |
| | LXA | |
| | OX | |
| | LB | 14 |
| | LAI | 3 |
| | X | 1 |
| | LAI | 12 |
| | X | 1 |
| LB35 | BM | SUBC |
| | SKBF | 2 |
| | B | LB35 |
| | LAI | 0 |
| | LXA | |
| | OX | |
| LB36 | BM | SUBP |
| | LB | 0 |
| | I2C | |
| | X | 0 |
| | SKBF | 1 |
| | B | LB36 |
| | INTIL | (Stop judgement) |
| | B | LBRE |
| LBHA | LB | 4 |
| | SOS | |
| LB37 | BM | SUBP |
| | LB | 0 |
| | I2C | |
| | KB | 0 |
| | SKBF | 3 |
| | B | LBC |
| | SKBF | 2 |
| | B | LB37 |
| | LB | 6 |
| | ROS | |
| | B | LB37 |
| LEFE | LA1 | 6 |
| | LXA | |
| | OX | |
| | B | LBTO |
| LBC | B | LB38 |
| | ORG | X'100 |
| LBTO | BM | SUBM |
| LB39 | BM | SUBP |
| | LB | 0 |
| | I2C | |
| | X | 0 |
| | SKBF | 3 |
| | B | LB39 |
| | LAI | 7 |
| | LXA | |
| | OX | |
| | BM | SUBD |
| | LAI | 15 |
| | LXA | |
| | OX | |
| | B | LBNI (key read in) |
| LB38 | LB | 14 |
| | LAI | 12 |
| | X | 1 |
| | LAI | 11 |
| | X | 1 |
| LB40 | BM | SUBC |
| | LB | 0 |
| | SKBF | 1 |
| | B | LB41 |

TABLE 1-continued

| Program Step | | |
|---|---|---|
| | SKBF | 2 |
| | B | LB40 |
| | LB | 6 |
| | ROS | |
| | B | LB40 |
| LB41 | LB | 4 |
| | ROS | |
| | LB | 2 |
| | SKBF | 2 |
| | B | LB42 |
| | B | LBJ |
| LB42 | LB | 5 (jam omit judgement) |
| | SKBF | 3 |
| | B | LBJ |
| | INTCH | |
| | B | LB43 |
| | SB | 4 |
| | LB | 8 |
| | SOS | |
| | B | LB44 |
| LB43 | B | LBJ |
| | ORG | X'140 |
| LB44 | LAI | 6 |
| | LXA | |
| | OX | |
| | LB | 1 |
| | SKBF | 2 |
| | B | LB45 |
| | BM | SUBF |
| | B | LBTA |
| LB45 | BM | SUBE |
| | B | LBA |
| LBJ | BM | SUBC |
| | SKBF | 2 |
| | B | LB46 |
| | B | LB47 |
| LB46 | LB | 0 |
| | SKBF | 2 |
| | B | LBJ |
| | LB | 6 |
| | ROS | |
| | B | LBJ |
| LB47 | LB | 5 |
| | SOS | |
| | LB | 8 |
| | ROS | |
| | LB | 2 |
| | SKBF | 1 |
| | B | LB49 |
| | B | LB48 |
| LB49 | SB | 2 |
| | LB | 1 |
| | SKBF | 2 |
| | B | LB48 |
| | B | LB50 |
| LB48 | LB | 7 |
| | SOS | |
| LB50 | LB | 14 |
| | LAI | 8 |
| | X | 1 |
| | LAI | 10 |
| | X | 1 |
| | B | LB51 |
| | ORG | X'180 |
| LB51 | BM | SUBC |
| | LB | 0 |
| | SKBF | 2 |
| | B | LB52 |
| | B | LB51 |
| LB52 | LAI | 8 |
| | LXA | |
| | OX | |
| | LB | 1 |
| | SKBF | 2 |
| | B | LB54 |
| | LB | 2 |
| | SKBF | 2 |
| | B | LB53 |
| | B | LB54 |
| LB53 | BM | SUBN |
| LB54 | BM | SUBC |

TABLE 1-continued

| Program Step | | |
|---|---|---|
| | SKBF | 2 |
| | B | LB54 |
| | LB | 8 |
| | ROS | |
| | LB | 14 |
| | LAI | 16 |
| | X | 1 |
| | LAI | 9 |
| | X | 3 |
| LB55 | BM | SUBC |
| | SKBF | 2 |
| | B | LB55 |
| | B | LB475 |
| LB434 | LB | 5 |
| | LB | 5 |
| | ROS | |
| | LB | 6 |
| | SOS | |
| | LB | 7 |
| | ROS | |
| | LAI | 0 |
| | LXA | |
| | OX | |
| | B | LB67 |
| | ORG | X'100 |
| LB57 | LB | 14 |
| | LAI | 9 |
| | X | 1 |
| | LAI | 6 |
| | X | 1 |
| | BM | SUBL |
| | SKBF | 4 |
| | B | LB58 |
| LBRI | BM | SUBC |
| | INTIL | |
| | B | LB59 |
| | LB | 0 |
| | SKBF | 1 |
| | B | LB60 |
| | LB | 2 |
| | SB | 1 |
| | B | LBHA |
| LB59 | LAI | 2 |
| | LXA | |
| | OX | |
| | LB | 0 |
| LB60 | SKBF | 22 |
| | B | LB61 |
| | LB | 6 |
| | ROS | |
| | BM | SUBI |
| LB61 | LB | 3 |
| | SKBF | 2 |
| | B | LBRI |
| | B | LB62 |
| LB58 | RB | 4 |
| LBRO | BM | SUBH |
| | BM | SUBC |
| | LB | 0 |
| | SKBF | 2 |
| | B | LB63 |
| LB64 | LB | 6 |
| | ROS | |
| | BM | SUBI |
| LB63 | LB | 3 |
| | SKBF | 2 |
| | B | LBRO |
| LB62 | LB | 3 |
| | RB | 3 |
| | B | LB65 |
| | ORG | X'200 |
| LB65 | LAI | 6 |
| | LXA | |
| | OX | |
| LBTA | BM | SUBP |
| | LB | 0 |
| | I2C | |
| | X | 0 |
| | SKBF | 2 |
| | B | LBTA |
| | LB | 6 |

TABLE 1-continued

| Program Step | | |
|---|---|---|
| | ROS | |
| | LB | 14 |
| | LAI | 9 |
| | X | 1 |
| | LAI | 13 |
| | X | 1 |
| LB66 | BM | SUBH |
| | BM | SUBC |
| | SKBF | 2 |
| | B | LB66 |
| | LB | 8 |
| | ROS | |
| | LB | 1 |
| | SKBF | 4 |
| | B | LBKA |
| | BM | SUBN |
| LBKA | LB | 14 |
| | LAI | 3 |
| | X | 1 |
| | LAI | 12 |
| | X | 1 |
| LB67 | BM | SUBH |
| | BM | SUBC |
| | SKBF | 2 |
| | B | LB67 |
| | LB | 8 |
| | ROS | |
| LBRU | BM | SUBH |
| | BM | SUBP |
| | LB | 0 |
| | I2C | |
| | X | 0 |
| | SKBF | 3 |
| | B | LBRU |
| | B | LBO |
| LBO | LAI | 7 |
| | LXA | |
| | OX | |
| | BM | SUBD |
| | LAI | 15 |
| | LXA | |
| | OX | |
| | LB | 1 |
| | SKBF | 4 |
| | B | LBDD |
| | LB | 2 |
| | SKBF | 4 |
| | B | LBDD |
| | INTOH | |
| | B | LB68 |
| | B | LB223 |
| LB225 | BM | SUBE |
| LB226 | BM | SUBD |
| | LB | 8 |
| | ROS | |
| LBDD | BM | SUBJ |
| | BM | SUBK |
| | B | LBHO |
| LB68 | BM | SUBD |
| | LB | 1 |
| | SKBF | 3 |
| | B | LB69 |
| | B | LB70 |
| LB69 | LBL | #2F |
| | LAI | 0 |
| | X | 1 |
| | LAI | 0 |
| | X | 3 |
| LB70 | LB | 2 |
| | SKBF | 3 |
| | B | LB71 |
| | B | LB148 |
| LB71 | B | LB220 |
| LB148 | BM | SUBJ |
| | B | LBNI |
| | LB | 14 |
| | LAI | 9 |
| | X | 1 |
| | LAI | 6 |
| | X | 1 |
| LB240 | BM | SUBC |

TABLE 1-continued

| Program Step | | |
|---|---|---|
| | SKBF | 2 |
| | B | LB240 |
| | B9 | LB241 |
| LB242 | BM | SUBL |
| | SKBF | 4 |
| | B | LB72 |
| | LB | 14 |
| | LAI | 9 |
| | X | 1 |
| | LAI | 13 |
| | X | 1 |
| LB73 | BM | SUBC |
| | SKBF | 2 |
| | B | LB73 |
| | BM | SUBN |
| | LB | 1 |
| | SKBF | 4 |
| | B | LB74 |
| | B | LB75 |
| LB74 | LAI | 2 |
| | LXA | |
| | OX | |
| LB75 | LB | 14 |
| | LAI | 15 |
| | X | 1 |
| | LAI | 8 |
| | X | 1 |
| LB76 | BM | SUBC |
| | SKBF | 2 |
| | B | LB76 |
| | LB | 8 |
| | ROS | |
| | B | LBL |
| LB72 | RB | 4 |
| | B | LBNU |
| LBL | LB | 1 |
| | SKBF | 4 |
| | B | LB77 |
| LB78 | BM | SUBP |
| | LB | 0 |
| | I2C | |
| | X | 0 |
| | SKBF | 2 |
| | B | LB78 |
| | LB | 6 |
| | ROS | |
| LB79 | BM | SUBP |
| | LB | 0 |
| | I2C | |
| | X | 0 |
| | SKBF | 1 |
| | B | LB79 |
| | INTIL | |
| | B | LB80 |
| | LB | 2 |
| | SB | 1 |
| | SB | 2 |
| | B | LBHA |
| LB80 | LAI | 6 |
| | LXA | |
| | OX | |
| | B | LBSA |
| LB77 | LAI | 6 |
| | LXA | |
| | OX | |
| LB81 | BM | SUBP |
| | LB | 0 |
| | I2C | |
| | X | 0 |
| | SKBF | 2 |
| | B | LB81 |
| | LB | 6 |
| | ROS | |
| LBA | BM | SUBM |
| | LB | 8 |
| | ROS | |
| | B | LBRU |
| LBNU | LB | 14 |
| | LAI | 9 |
| | X | 1 |
| | LAI | 13 |

TABLE 1-continued

Program Step

| | | |
|---|---|---|
| | X | 1 |
| LB82 | BM | SUBH |
| | BM | SUBC |
| | SKBF | 2 |
| | B | LB82 |
| | BM | SUBN |
| | LB | 14 |
| | LAI | 3 |
| | X | 1 |
| | LAI | 12 |
| | X | 1 |
| LB83 | BM | SUBH |
| | BM | SUBC |
| | SKBF | 2 |
| | B | LB83 |
| | LB | 8 |
| | ROS | |
| | LB | 14 |
| | LAI | 11 |
| | X | 1 |
| | LAI | 12 |
| | X | 1 |
| LB84 | BM | SUBH |
| | BM | SUBC |
| | SKBF | 2 |
| | B | LB84 |
| | LAI | 6 |
| | LXA | |
| | OX | |
| LB85 | BM | SUBH |
| | BM | SUBP |
| | LB | 0 |
| | I2C | |
| | X | 0 |
| | SKBF | 2 |
| | B | LB85 |
| | LB | 6 |
| | ROS | |
| | B | LB86 |
| LB86 | BM | SUBH |
| | BM | SUBP |
| | LB | 0 |
| | I2C | |
| | X | 0 |
| | SKBF | 1 |
| | B | LB86 |
| LBSA | BM | SUBA |
| LB87 | BM | SUBH |
| | BM | SUBP |
| | LB | 0 |
| | I2C | |
| | X | 0 |
| | SKBF | 1 |
| | B | LB88 |
| | B | LB87 |
| LB88 | B | LBRU |
| LB220 | LB | 3 |
| | SKBF | 1 |
| | B | LB221 |
| | LB | 1 |
| | RB | 1 |
| | LAI | 0 |
| | LB | 15 |
| | SKMEA | |
| | B | LB222 |
| | EDB | 1 |
| | SKMEA | |
| | B | LB222 |
| | B | LB148 |
| LB221 | LB | 1 |
| | SB | 1 |
| LB222 | BMSUBJ | |
| | B | LBHO |
| LB223 | LB | 8 |
| | SOS | |
| | LB | 1 |
| | SKBF | 1 |
| | B | LB224 |
| | B | LB225 |
| LB224 | B | LB226 |
| LB241 | LB | 5 |

TABLE 1-continued

Program Step

| | | |
|---|---|---|
| | ROS | |
| | LB | 6 |
| | SOS | |
| | LB | 7 |
| | ROS | |
| | LAI | 0 |
| | LXA | |
| | OX | |
| | B | LB242 |
| | LB | 15 |
| LB1 | ROS | |
| | LAI | 0 |
| | X | 1 |
| | LAI | 0 |
| | X | 3 |
| | LAI | 0 |
| | X | 1 |
| | LAI | 0 |
| | KDSR | 3 |
| | B | LB1 |
| | LAI | 15 |
| | LXA | |
| | OX | |
| | IOA | |
| LB2 | BM | SUBP |
| | LB | 0 |
| | I2C | |
| | X | 0 |
| | SKBF | 2 |
| | B | LB3 |
| | LB | 6 |
| | ROS | |
| LB4 | BM | SUBP |
| | LB | 0 |
| | I2C | |
| | X | 0 |
| | SKBF | 3 |
| | B | LB5 |
| | LB | 3 |
| | SKBF | 1 |
| | B | LB6 |
| | B | LBNI |
| LB3 | LB | 6 |
| | SOS | |
| | B | LB2 |
| LB5 | LAI | 6 |
| | LXA | |
| | OX | |
| | LB | 3 |
| | SB | 1 |
| | B | LB4 |
| LB6 | RB | 1 |
| | B | LBTO |
| SUBA | LB | 0 |
| LB100 | LAI | 0 |
| LB101 | AISK | 1 |
| | B | LB102 |
| | B | LB101 |
| LB102 | INCB | 0 |
| | B | LB100 |
| | RT | |
| SUBB | LB | 15 |
| | X | 0 |
| | TR | 15 |
| | AISK | 15 |
| | B | LB103 |
| | X | 1 |
| | XAS | |
| | L | 1 |
| | X | 1 |
| | XAS | |
| | X | 1 |
| LB104 | BM | SUBA |
| | RT | |
| LB103 | X | 0 |
| | B | LB104 |
| SUBC | BM | SUBP |
| | LB | 0 |
| | I2C | |
| | X | 0 |
| | SKBF | 4 |

TABLE 1-continued

| Program Step | | |
|---|---|---|
| | B | LB105 |
| | B | SUBC |
| LB105 | BM | SUBP |
| | LB | 0 |
| | I2C | |
| | X | 0 |
| | SKBF | 4 |
| | B | LB105 |
| | LB | 14 |
| | X | 0 |
| | AISK | 1 |
| | B | LB106 |
| | B | LB107 |
| LB106 | X | 1 |
| | X | 0 |
| | AISK | 1 |
| | B | LB108 |
| | B | LB107 |
| LB108 | X | 1 |
| | LB | 3 |
| | RB | 2 |
| LB109 | RT | |
| LB107 | X | 0 |
| | LB | 3 |
| | SB | 2 |
| | B | LB109 |
| SUBD | BM | SUBP |
| | LBL | #10 |
| | L | 0 |
| | AISK | 1 |
| | B | LB110 |
| | B | LB111 |
| LB110 | X | 3 |
| | L | 0 |
| | AISK | 1 |
| | B | LB112 |
| | B | LB111 |
| LB112 | X | 1 |
| | L | 0 |
| | AISK | 1 |
| | NOP | |
| | TR | 15 |
| | AISK | 7 |
| | B | LB111 |
| | B | LB113 |
| LB111 | X | 0 |
| | B | SUBD |
| LB113 | LAI | 0 |
| | X | 3 |
| | RT | |
| SUBE | LBL | #3F |
| (CT2 = CT2 − 1 routine) | | |
| | L | 0 |
| | AISK | 15 |
| | B | LB114 |
| | LAI | 9 |
| | X | 1 |
| | L | 0 |
| | AISK | 15 |
| | NOP | |
| LB114 | X | 0 |
| | RT | |
| SUBF | LBL | #3F |
| (CT2=CT2 − 2 routine) | L | 0 |
| | AISK | 14 |
| | B | LB115 |
| | TR | 15 |
| | AISK | 1 |
| | B | LB116 |
| | LAI | 8 |
| LB117 | X | 1 |
| | L | 0 |
| | AISK | 15 |
| | NOP | |
| LB115 | X | 0 |
| | RT | |
| LB116 | LAI | 9 |
| | B | LB117 |
| SUBG | LBL | #3F |
| | L | 0 |

TABLE 1-continued

| Program Step | | |
|---|---|---|
| | AISK | 1 |
| | NOP | |
| | TR | 15 |
| | AISK | 5 |
| | B | LB118 |
| | DC | |
| | X | 1 |
| | L | 0 |
| | AISK | 1 |
| | NOP | |
| LB118 | X | 0 |
| | RT | |
| SUBH | LB | 4 |
| | SKBF | 4 |
| | B | LB119 |
| | B | LB123 |
| LB119 | LB | 1 |
| | SKBF | 3 |
| | B | LB120 |
| | SKBF | 1 |
| | B | LB120 |
| | B | LB123 |
| LB120 | LB | 0 |
| | LAI | 0 |
| | IISK | |
| | NOP | |
| | X | 0 |
| | SKBF | 1 |
| | B | LB121 |
| | LB | 3 |
| | RB | 1 |
| | B | LB122 |
| LB121 | SKBF | 2 |
| | B | LB123 |
| | LB | 3 |
| | SB | 1 |
| LB122 | LB | 2 |
| | SB | 3 |
| LB123 | RT | |
| SUBJ | LB | 3 |
| | LAI | 0 |
| | X | 0 |
| | LB | 2 |
| | LAI | 0 |
| | X | 0 |
| | LB | 1 |
| | RB | 2 |
| | RB | 3 |
| | RB | 4 |
| | RT | |
| SUBI | LB | 3 |
| | SKBF | 3 |
| | B | LB128 |
| | LB | 1 |
| | SKBF | 4 |
| | B | LB128 |
| | LB | 2 |
| | SKBF | 2 |
| | B | LB125 |
| | B | LB128 |
| LB125 | LB | 5 |
| | SKBF | 3 |
| | B | LB128 |
| | INIOH | |
| | B | LB127 |
| | SB | 4 |
| | BM | SUBF |
| | LB | 8 |
| | SOS | |
| | LAI | 6 |
| | LXA | |
| | OX | |
| LB127 | LB | 3 |
| | SB | 3 |
| LB128 | RT | |
| SUBK | BM | SUBP |
| | LB | 4 |
| | SKBF | 4 |
| | B | LB129 |
| | B | SUBK |
| LB129 | LB | 0 |

TABLE 1-continued

Program Step

| | | |
|---|---|---|
| | LAI | 0 |
| | IISK | |
| | NOP | |
| | X | 0 |
| | SKBF | 4 |
| | B | LB130 |
| | B | SUBK |
| LB130 | B | LB211 |
| SUBL | LB | 1 |
| | SKBF | 1 |
| | B | LB133 |
| | SKBF | 4 |
| | B | LB133 |
| | LB | 2 |
| | SKBF | 4 |
| | B | LB133 |
| | BM | SUBG |
| | LB | 15 |
| | L | 2 |
| | SKMEA | |
| | B | LB134 |
| | EOB | 3 |
| | L | 2 |
| | SKMEA | |
| | B | LB134 |
| | LB | 1 |
| | SB | 3 |
| LB133 | LAI | 2 |
| | LXA | |
| | OX | |
| | LB | 3 |
| | SB | 4 |
| LB135 | RT | |
| LB134 | INTIL | |
| | B | LB133 |
| | LB | 3 |
| | B | LB135 |
| SUBM | BM | SUBP |
| | LB | 0 |
| | I2C | |
| | X | 0 |
| | SKBF | 3 |
| | B | SUBM |
| | BM | SUBA |
| LB136 | BM | SUBP |
| | LB | 0 |
| | I2C | |
| | X | 0 |
| | SKBF | 3 |
| | B | LB137 |
| | B | LB136 |
| LB137 | BM | SUBA |
| | RT | |
| SUBP | LB | 4 |
| (display change routine) | | |
| | SKBF | 1 |
| | B | LB140 |
| | SKBF | 2 |
| | B | LB141 |
| | SKBF | 3 |
| | B | LB142 |
| | SKBF | 4 |
| | B | LB143 |
| LB144 | SB | 1 |
| | LBL | #3F |
| | L | 0 |
| | COM | |
| | IOA | |
| | LB | 0 |
| LB145 | SOS | |
| | RT | |
| LB140 | RB | 1 |
| | SB | 2 |
| | LB | 0 |
| | ROS | |
| | LBL | #2F |
| | L | 0 |
| | COM | |
| | IOA | |
| | LB | 1 |
| | B | LB145 |

TABLE 1-continued

Program Step

| | | |
|---|---|---|
| LB141 | RB | 2 |
| | SB | 3 |
| | LB | 1 |
| | ROS | |
| | LBL | #1F |
| | L | 0 |
| | COM | |
| | IOA | |
| | LB | 2 |
| | B | LB145 |
| LB142 | RB | 3 |
| | SB | 4 |
| | LB | 2 |
| | ROS | |
| | LB | 15 |
| | L | 0 |
| | COM | |
| | IOA | |
| | LB | 3 |
| | B | LB145 |
| LB143 | LB | 3 |
| | ROS | |
| | LB | 4 |
| | RB | 4 |
| | B | LB144 |
| SUBQ | LB | 4 |
| | LAI | 0 |
| | X | 0 |
| | LB | 3 |
| LB146 | ROS | |
| | DECB | 0 |
| | B | LB146 |
| | RT | |
| LB211 | BM | SUBP |
| | LB | 4 |
| | SKBF | 4 |
| | B | LB212 |
| | B | LB211 |
| LB212 | LB | 0 |
| | LAI | 0 |
| | IISK | |
| | NOP | |
| | X | 0 |
| | LB | 1 |
| | SKBF | 1 |
| | B | LB213 |
| | LB | 0 |
| | SKBF | 1 |
| | B | LB211 |
| LB214 | RT | |
| LB213 | LB | 0 |
| | SKBF | 2 |
| | B | LB211 |
| | B | LB214 |
| SUBN | LB | 2 |
| | SKBF | 4 |
| | B | LB131 |
| | LB | 5 |
| | SKBF | 3 |
| | B | LB131 |
| | INTOH | |
| | B | LB132 |
| | B | LB131 |
| | LB | 1 |
| LB132 | SB | 4 |
| | SKBF | 1 |
| | B | LB147 |
| | BM | SUBE |
| LB147 | LB | 8 |
| | SOS | |
| LB131 | RT | |
| LBNI | BM | SUBP |
| | LB | 4 |
| | SKBF | 1 |
| | B | LB401 |
| | B | LB403 |
| LB401 | LAI | 1 |
| | LB | 6 |
| | IISK | |
| | B | LB402 |
| | SKBF | 1 |

TABLE 1-continued

| Program Step | | |
|---|---|---|
| | B | LB403 |
| | SB | 1 |
| | TR | 15 |
| | AISK | 1 |
| | B | LB404 |
| | LAI | 1 |
| | B | LB407 |
| LB404 | TR | 15 |
| | AISK | 3 |
| | B | LB405 |
| | LAI | 2 |
| | B | LB407 |
| LB405 | TR | 15 |
| | AISK | 7 |
| | B | LB406 |
| | LAI | 3 |
| | B | LB407 |
| LB406 | LAI | 0 |
| LB407 | BM | SUBB |
| | B | LB403 |
| LB402 | RB | 1 |
| LB403 | LB | 4 |
| | SKBF | 2 |
| | B | LB408 |
| | B | LB450 |
| LB408 | LAI | 1 |
| | LB | 6 |
| | IISK | |
| | B | LB451 |
| | SKBF | 2 |
| | B | LB450 |
| | SB | 2 |
| | TR | 15 |
| | AISK | 1 |
| | B | LB452 |
| | LAI | 5 |
| | B | LB414 |
| LB450 | B | LB410 |
| LB451 | B | LB409 |
| LB452 | B | LB411 |
| LB411 | TR | 15 |
| | AISK | 3 |
| | B | LB412 |
| | LAI | 6 |
| | B | LB414 |
| LB412 | TR | 15 |
| | AISK | 7 |
| | B | LB413 |
| | LAI | 7 |
| | B | LB414 |
| LB413 | LAI | 4 |
| LB414 | BM | SUBB |
| | B | LB410 |
| LB409 | RB | 2 |
| LB410 | LB | 4 |
| | SKBF | 3 |
| | B | LB415 |
| | B | LB453 |
| LB415 | LAI | 1 |
| | LB | 0 |
| | IISK | |
| | B | LB416 |
| | SKBF | 3 |
| | B | LB453 |
| | SB | 3 |
| | TR | 15 |
| | AISK | 1 |
| | B | LB418 |
| | LAI | 9 |
| | B | LB422 |
| LB418 | TR | 15 |
| | AISK | 3 |
| | B | LB419 |
| | LB | 5 |
| | SKBF | 2 |
| | B | LB453 |
| | B | LB454 |
| LB419 | TR | 15 |
| | AISK | 7 |
| | B | LB420 |
| | LB | 5 |

TABLE 1-continued

| Program Step | | |
|---|---|---|
| | SKBF | 2 |
| | B | LB455 |
| | B | LB453 |
| LB420 | LAI | 8 |
| LB422 | BM | SUBB |
| | B | LB453 |
| LB416 | RB | 3 |
| LB453 | B | LB417 |
| LB454 | B | LB435 |
| LB455 | B | LB421 |
| LB435 | LB | 15 |
| (Recall routine) | | |
| | LAI | 0 |
| | X | 0 |
| | LB | 13 |
| | X | 0 |
| | LBL | #1F |
| | LAI | 0 |
| | X | 0 |
| | LBL | #1D |
| | X | 0 |
| | LBL | #2F |
| | LAI | 0 |
| | X | 0 |
| | LBL | #2D |
| | X | 0 |
| | LBL | #3F |
| | LAI | 0 |
| | X | 0 |
| | LBL | #3D |
| | X | 0 |
| | B | LB417 |
| LB421 | LB | 13 |
| (display shelter) | | |
| | LAI | 0 |
| | LB | 15 |
| | X | 0 |
| | LBL | #1D |
| | LAI | 0 |
| | X | 0 |
| | LBL | #1F |
| | X | 0 |
| | LBL | #2D |
| | LAI | 0 |
| | X | 0 |
| | LBL | #2F |
| | X | 0 |
| | LBL | #3D |
| | LAI | 0 |
| | X | 0 |
| | LBL | #3F |
| | X | 0 |
| LB417 | LB | 4 |
| | SKBF | 4 |
| | B | LB456 |
| | B | LB423 |
| LB456 | B | LB424 |
| LB424 | LAI | 0 |
| | IISK | |
| | LB | 0 |
| | X | 0 |
| | SKBF | 4 |
| | B | LB425 |
| | LB | 9 |
| | SOS | |
| | LB | 5 |
| | SB | 1 |
| | B | LB426 |
| LB425 | LB | 9 |
| | ROS | |
| | LB | 5 |
| | RB | 1 |
| LB426 | LB | 0 |
| | SKBF | 3 |
| | B | LB427 |
| | LAI | 0 |
| | LB | 15 |
| | X | 1 |
| | LAI | 0 |
| | X | 3 |
| | LAI | 0 |

TABLE 1-continued

| Program Step | | |
|---|---|---|
| | X | 1 |
| | LAI | 0 |
| | X | 3 |
| | B | LB423 |
| LB427 | INTIL | |
| | B | LB423 |
| | SKBF | 2 |
| | B | LB428 |
| | LB | 1 |
| | SB | 1 |
| | B | LB458 |
| LB428 | SKBF | 1 |
| | B | LB423 |
| | LB | 1 |
| | RB | 1 |
| | LB | 15 |
| | L | 1 |
| | TR | 15 |
| | AISK | 15 |
| | B | LB458 |
| | L | 1 |
| | TR | 15 |
| | AISK | 15 |
| | B | LB458 |
| LB423 | LAI | 0 |
| | LB | 6 |
| | SKMEA | |
| | B | LB457 |
| | B | SUBA |
| LB457 | B | LBNI |
| LB458 | B | LBHO |
| LB475 | LB | 5 |
| | SOS | |
| | LAI | 0 |
| | IISK | |
| | ROS | |
| | LB | 0 |
| | X | 0 |
| | SKBF | 3 |
| | B | LB429 |
| | SKBF | 2 |
| | B | LB429 |
| | INTIL | |
| | B | LB431 |
| | B | LB429 |
| LB431 | LB | 5 |
| | SKBF | 1 |
| | B | LB430 |
| | LB | 9 |
| | SOS | |
| | B | LB429 |
| LB430 | LB | 9 |
| | ROS | |
| LB429 | LB | 0 |
| | SKBF | 1 |
| | B | LB432 |
| | LB | 5 |
| | SB | 3 |
| | B | LB433 |
| I.B432 | LB | 5 |
| | RB | 3 |
| LB433 | LB | 0 |
| | SKBF | 4 |
| | B | LB436 |
| | LB | 1 |
| | RB | 2 |
| | B | LB434 |
| LB436 | LB | 1 |
| | SB | 2 |
| | B | LBHE |

What we claim is:

1. An image processing apparatus comprising:

processing means for forming an image on a recording medium, said processing means performing an adjustment operation after termination of the image forming operation;

input means for inputting a start instruction of image formation; and control means comprising a program memory for storing a program for sequence-controlling said processing means and a program for monitoring an abnormality, and further comprising a data memory capable of storing data associated with the image formation for controlling said processing means and for monitoring the abnormality on the basis of data stored in said data memory, wherein, in the event that a start instruction is entered at said input means while said processing means performs the adjustment operation after termination of the image forming operation, said control means is operable to cause data indicating entry of the start instruction to be set to said data memory, and wherein, in a first mode where an abnormality is not detected, said control means is operable to cause said processing means to perform a new image forming operation, without entry of a new start instruction, if the data indicating entry of the start instruction is set to said data memory, and in a second mode where an abnormality is detected, said control means is operable to cause said processing means to be inhibited from performing a new image forming operation, even if the data indicating entry of the start instruction is set to said data memory.

2. An apparatus according to claim 1, wherein said starting means starts a new image forming operation based on numerical value data set in a second area of said data memory.

3. An apparatus according to claim 1, wherein said processing means has a rotary photosensitive member, and said control means enables acceptance of the start instruction by said input means before rotation of said rotary photosensitive member is stopped.

4. An apparatus according to claim 1, wherein said control means comprises a one-chip computer.

5. An image processing apparatus comprising:

processing means for image formation;

key input means for inputting an image formation start instruction and a condition associated with the image formation; and control means for controlling said processing means in accordance with the processing condition in response to an input signal from said input means, wherein said control means comprises:

a memory for storing input data by said key input means;

means for enabling storage of the input data by said key input means to said memory in a standby state, for inhibiting the storage after the image formation is started, and for enabling the data storage to said memory means and the start instruction by said key input means after completion of the image formation; and means for stopping the image formation and for inhibiting the data storage to said memory and the start instruction by said key input means when an abnormality of said apparatus occurs, and for enabling the start instruction by said key input means and keeping inhibition of the data storage to said memory by said key input means after the abnormality state is eliminated.

6. An apparatus according to claim 5, wherein said control means comprises a one-chip computer.

7. An image processing apparatus comprising:

a reciprocable member for scanning an original image;

processing means for forming the scanned original image on a recording medium;

generating means for generating a size signal representing a size of the recording medium;

pulse means for generating a series of pulses; and control means for controlling operation of said reciprocable member in accordance with said size signal and in accordance with counting of said series of pulses;

wherein when said size signal is of a first size, said control means is operative to stop the scanning of said reciprocable member in response to termination of counting of a first predetermined number of pulses, and when said size signal is of a second size, said control means is operative to stop the scanning of said reciprocable member in response to termination of counting of a second predetermined number of pulses after termination of counting of the first predetermined number of pulses.

8. An apparatus according to claim 7, wherein said control means stops said reciprocable member and thereafter, returns said reciprocable member to a start position regardless of the first and second sizes.

9. An apparatus according to claim 7, wherein when said control means completes counting of the pulses by said first predetermined number, said control means resets the counting operation, and renews counting of the pulses by said second predetermined number.

10. An apparatus according to claim 9, wherein said second predetermined number is set in a memory when said first predetermined number is counted.

11. An apparatus according to claim 7, wherein said control means comprises a one-chip computer.

12. An image processing apparatus comprising:

processing means for processing an image;

input means for entering at least an instruction signal and a condition signal to select an operational sequence of said processing means;

a plurality of display means for mutually different displays; and control means for forming and outputting signals to control said processing means upon receipt of the signals input from said input means, said control means including a first memory for storing a program for applying signals for display to said plurality of display means, and a second memory for storing data based on the signals input from said input means and data for display, said control means further for outputting a latch signal necessary for a control operation of said processing means in accordance with the signals input from said input means and the program stored in said first memory, and for generating the pulse signals for display to said plurality of display means in accordance with the program stored in the first memory;

wherein, with a predetermined period, said control means alternately executes, while waiting for a change in the condition signal from said input means, an operation of generation of the pulse signals for display and an operation of determination as to whether there was a change in the condition signal.

13. An apparatus according to claim 12, wherein said control means alternately performs generating of pulses for a display on said display means and discriminating of the condition signal input from said input means.

14. An apparatus according to claim 12, wherein each of said display means comprises a segment display, consisting of a plurality of digits, capable of displaying the number of images.

15. An apparatus according to claim 12, wherein said control means comprises a one-chip computer.

16. An image processing apparatus comprising:

processing means for image formation;

a plurality of key means including an input key for inputting a condition associated with the image formation, and a stop key for stopping an image formation processing operation;

control means for causing said processing means to perform the image formation processing in accordance with the processing condition;

a first memory for storing data including the processing condition input at said input key; and a second memory for storing stop information for stopping the image formation processing operation input at said stop key;

wherein said control means includes:

initiating means for initiating the image formation processing operation based on the data stored in said first memory means;

determining means for determining the presence or absence of stop information stored in said second memory means during a predetermined period of time in the image formation processing operation, such that a stop processing for stopping the image formation processing operation is carried out in the event that it is determined that the stop information is present;

first inhibiting means for inhibiting storage of the condition information input at said input key into said first memory means after said initiating means initiates the image formation processing operation, and for releasing such inhibition so that the condition information input at said input key may be stored in said first memory means while in standby condition;

second inhibiting means for inhibiting the stop information input at said stop key from being stored in said second memory means while in standby condition, and, after said initiating means initiates the image formation processing operation, for releasing such inhibition such that the stop information input at said stop key may be stored in said second memory means.

17. An apparatus according to claim 16, wherein said control means comprises a one-chip computer.

18. An image forming apparatus comprising:

image forming means;

first input means for entering data concerning image formation count for repeatedly executing image formation;

first control means for repeatedly controlling said image forming means to sequentially form images in accordance with the data entered from said first input means;

storage means for storing a number associated with a remaining image formation count in a predetermined storage area of a memory;

display means for displaying a number associated with a remaining image formation count;

second input means for entering an instruction to interrupt the repetitive image formation operation before termination of the repetitive image formation operation according to the data entered from said first input means;

saving means for saving and storing the number associated with a remaining image formation count before the interruption, which has been displayed on said display means, in other storage area of the memory, at the time of interruption of the image formation operation by said second input means;

second control means for repeatedly controlling said image forming means during interruption of the image formation operation by said second input means to sequentially initiate and terminate the interruption image formation in accordance with data entered at said first input means concerning image formation count setting for repeatedly executing interruption image formation;

return means for returning the number associated with a remaining image formation count before the interruption, which has been saved and stored in the other storage area of the memory, to the predetermined storage area of the memory, after completion of the interruption image formation;

third control means for repeatedly controlling said image forming means after completion of the interruption image formation to sequentially resume and terminate the remaining image formation before the interruption in accordance with the number returned by said return means associated with the remaining image formation count before the interruption;

fourth control means for changing the display content of display means after interruption of the image formation operation by said second input means from the number of associated with the remaining image formation count before the interruption to the number associated with the remaining image formation count of the interruption image formation, and for changing the display content of display means after completion of the interruption image formation from the number associated with the remaining image formation count of the interruption image formation to the number associated with the remaining image formation count before the interruption, and fifth control means for controlling said image forming means to perform the interruption image formation for a predetermined image formation count, without an input from said first input means, when the image formation operation is interrupted by the instruction from said second input means.

19. An apparatus according to claim 18, wherein a one-chip computer is provided and includes said first, second, third and fourth control means.

20. An apparatus according to claim 18, wherein said display means is adapted to display a number associated with image formation count already executed.

21. An apparatus according to claim 18, wherein said storage means is adapted to store the data concerning image formation count entered by said first input means in a second predetermined storage area of the memory, and said display means is adapted to display said data.

22. An apparatus according to claim 21, wherein said saving means is adapted to save and store the data concerning image formation count entered by said first input means in a further storage area of the memory, and said return means is adapted to return said data, which has been stored in the further storage area of the memory, to the second predetermined storage area of the memory.

* * * * *

UNITED STATES PATENT AND TRADEMARK OFFICE

CERTIFICATE OF CORRECTION

PATENT NO. : 5,192,971

DATED : March 9, 1993

INVENTOR(S) : KATSUICHI SHIMIZU, et al.

It is certified that error appears in the above-identified patent and that said Letters Patent is hereby corrected as shown below:

On the cover page of the patent, beneath "United States Patent" at [19], "Smimizu et al." should read -- Shimizu et al. --, and at [75], the name "Katsuichi Smimizu" should read -- Katsuichi Shimizu --.

COLUMN 2

Line 64, "FIG. 7" should read -- FIG. 7, -- and "B" should read -- B, --.

COLUMN 5

Line 67, "now" should read -- nor --.

COLUMN 6

Line 14, "One" should read -- When one --.

COLUMN 7

Line 10, "x X y switches" should read -- xXy switches --.

COLUMN 8

Line 17, "Tri" should read -- Tr1 --.

COLUMN 9

Line 33, "G I" should read -- G, I --;

Line 52, "key" should read -- keys --;

Line 64, "$(\overline{RG \cdot E}) \cdot A$" should read -- $(\overline{\overline{RG}} \cdot E) \cdot A$ --

COLUMN 10

Line 50, "CPS" should read -- CPU --.

COLUMN 13

Line 67, "waited." should read -- stayed. --.

COLUMN 14

Line 1, "waited." should read -- stayed. --;

Line 13, "waited." should read -- stayed. --.

UNITED STATES PATENT AND TRADEMARK OFFICE

CERTIFICATE OF CORRECTION

PATENT NO. : 5,192,971

DATED : March 9, 1993

INVENTOR(S) : KATSUICHI SHIMIZU, et al.

It is certified that error appears in the above-identified patent and that said Letters Patent is hereby corrected as shown below:

COLUMN 15

Line 55, "(COPS="1"" should read -- (CPOS="1" --.

COLUMN 17

Line 57, "been" should be deleted;
Line 61, "conincide" should read -- coincide --.

COLUMN 22

Line 3, "turns" should read -- turn --.

Signed and Sealed this

Eleventh Day of January, 1994

Bruce Lehman

*Attest:*

BRUCE LEHMAN

*Attesting Officer*

*Commissioner of Patents and Trademarks*